US008679712B2

(12) United States Patent
Tanaka et al.

(10) Patent No.: US 8,679,712 B2
(45) **Date of Patent: *Mar. 25, 2014**

(54) PHOTORECEPTOR AND IMAGE FORMING METHOD, IMAGE FORMING APPARATUS, AND PROCESS CARTRIDGE USING THE PHOTORECEPTOR

(75) Inventors: Yuuji Tanaka, Shizuoka (JP); Kazukiyo Nagai, Shizuoka (JP); Tetsuro Suzuki, Shizuoka (JP); Yuusuke Koizuka, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 6 days.

This patent is subject to a terminal disclaimer.

(21) Appl. No.: 13/553,184

(22) Filed: Jul. 19, 2012

(65) Prior Publication Data

US 2013/0022903 A1 Jan. 24, 2013

(30) Foreign Application Priority Data

Jul. 20, 2011 (JP) ..... 2011-158745

(51) Int. Cl.
*G03G 5/00* (2006.01)

(52) U.S. Cl.
USPC ..... 430/66; 430/58.7; 430/56; 399/159

(58) Field of Classification Search
USPC ..... 430/66, 58.7, 56; 399/159
See application file for complete search history.

(56) References Cited

U.S. PATENT DOCUMENTS

| | | | |
|---|---|---|---|
| 4,818,650 | A | 4/1989 | Limburg et al. |
| 4,956,440 | A | 9/1990 | Limburg et al. |
| 5,411,827 | A | 5/1995 | Tamura et al. |
| 5,496,671 | A | 3/1996 | Tamura et al. |
| 5,840,816 | A | 11/1998 | Kobayashi et al. |
| 5,879,847 | A | 3/1999 | Yoshinaga et al. |
| 5,888,690 | A | 3/1999 | Yoshinaga et al. |
| 6,143,452 | A | 11/2000 | Sakimura et al. |
| 6,180,303 | B1 | 1/2001 | Uematsu et al. |
| 6,406,825 | B1 | 6/2002 | Sakimura et al. |

(Continued)

FOREIGN PATENT DOCUMENTS

| | | |
|---|---|---|
| JP | 56-48637 | 5/1981 |
| JP | 64-1728 | 1/1989 |

(Continued)

*Primary Examiner* — Mark A Chapman
(74) *Attorney, Agent, or Firm* — Oblon, Spivak, McClelland, Maier & Neustadt, L.L.P.

(57) ABSTRACT

A photoreceptor including an electroconductive substrate; and a photosensitive layer overlying the electroconductive substrate, wherein the uppermost surface layer of the photosensitive layer has a three-dimensional cross-linked product formed by polymerization reaction of a charge transport compound A represented by the following Chemical Structure 1 and a charge transport compound B having three or more [tetrahydro-2H-pyran-2-yl)oxy]methyl groups linked with aromatic rings in which part of the [tetrahydro-2H-pyran-2-yl)oxy]methyl groups is severed and detached.

Chemical Structure 1

In the Chemical Structure 1, $Ar_1$ represents an aromatic hydrocarbon group having 6 to 20 carbon atoms that may have an alkyl group having one to four carbon atoms as a substitution group.

11 Claims, 10 Drawing Sheets

(56) References Cited

U.S. PATENT DOCUMENTS

| | | | |
|---|---|---|---|
| 6,998,210 | B2 | 2/2006 | Yoshimura et al. |
| 7,897,313 | B2 | 3/2011 | Sugino |
| 7,932,006 | B2 | 4/2011 | Dejong et al. |
| 2004/0101774 | A1 | 5/2004 | Yoshimura et al. |
| 2008/0299472 | A1 | 12/2008 | DeJong et al. |
| 2009/0238602 | A1 | 9/2009 | Iwasaki et al. |

FOREIGN PATENT DOCUMENTS

| | | |
|---|---|---|
| JP | 4-281461 | 10/1992 |
| JP | 5-216249 | 8/1993 |
| JP | 6-118681 | 4/1994 |
| JP | 8-262779 | 10/1996 |
| JP | 9-124943 | 5/1997 |
| JP | 9-190004 | 7/1997 |
| JP | 2000-66425 | 3/2000 |
| JP | 2000-171990 | 6/2000 |
| JP | 2003-186223 | 7/2003 |
| JP | 2004-184991 | 7/2004 |
| JP | 2006-84711 | 3/2006 |
| JP | 2006-251771 | 9/2006 |
| JP | 2007-293197 | 11/2007 |
| JP | 2008-299327 | 12/2008 |
| JP | 2009-229549 | 10/2009 |

PHOTORECEPTOR AND IMAGE FORMING METHOD, IMAGE FORMING APPARATUS, AND PROCESS CARTRIDGE USING THE PHOTORECEPTOR

CROSS-REFERENCE TO RELATED APPLICATION

This patent application is based on and claims priority pursuant to 35 U.S.C. §119 to Japanese Patent Application No. 2011-158745, filed on Jul. 20, 2011, the entire disclosure of which is hereby incorporated by reference herein.

BACKGROUND OF THE INVENTION

1. Field of the Invention

The present invention relates to a photoreceptor (image bearing member) and an image forming method, an image forming apparatus, and a process cartridge using the photoreceptor.

2. Description the Background Art

Organic photoconductors (OPC) (photoreceptors) have good characteristics and have been used in place of inorganic photoreceptors in photocopiers, facsimile machines, laser printers, and multi-functional devices thereof in light of various advantages. Specific reasons for this supersession include: (1) good optical characteristics, for example, a broad range of optical absorption wavelengths and a large amount of light absorption; (2) superior electrical characteristics, for example, high sensitivity and stable chargeability; (3) a wide selection of materials; (4) ease of manufacturing; (5) inexpensive cost; and (6) non-toxicity.

In addition, in an attempt to manufacture a compact image forming apparatus, the diameter of the photoreceptor is constantly being reduced. Furthermore, with the advancement toward higher speed performance and maintenance-free machines, a photoreceptor having excellent durability has been desired. From this point of view, an organic photoconductor is soft in general and wears out easily because the charge transport layer of the organic photoconductor is mainly made of a low molecular weight charge transport material and an inert polymer. Thus, the organic photoconductor repetitively used in the electrophotographic process tends to be easily abraded under the mechanical stress by a developing system or a cleaning system.

Moreover, to meet with the demand for high-quality images, toners consisting essentially of smaller toner particles have been used recently. The smaller particles require better cleaning performance, which leads to inevitable usage of a harder cleaning blade and an increase in the contact pressure between the cleaning blade and the photoreceptor. This is another factor accelerating the abrasion of the photoreceptor.

Such abrasion of the photoreceptor causes deterioration of electrical characteristics such as the sensitivity and the chargeability, resulting in production of defective images having, for example, a low image density and background fouling. Localized damage to the photoreceptor due to abrasion causes production of defective images with streaks ascribable to bad cleaning of the photoreceptor.

A number of attempts have been made to improve the abrasion resistance of the organic photoconductor. For example, Japanese Patent Application Publication No. S56-048637 (JP-S56-048637-A) describes a photoreceptor using a curable binder resin in the charge transport layer; JP-S64-001728-A describes a photoreceptor using a charge transport polymer; JP-H04-281461-A describes a photoreceptor having a charge transport layer in which inorganic fillers are dispersed; Japanese Patent No. 3262488 (JP-3262488-B) describes a photoreceptor containing multi-functional acrylate monomer cured materials; JP-3194392-B describes a photoreceptor having a charge transport layer formed by a liquid application formed of a monomer having a carbon-carbon double bonding, a charge transport material having a carbon-carbon double bonding, and a binder resin; JP-2000-66425-A describes a photoreceptor containing a compound formed by curing a positive hole transport compound having two or more chainable polymerizable functional groups in a single molecular; JP-H06-118681-A describes a photoreceptor using a curable silicon resin containing colloidal silica; JP-H09-124943 and JP-H09-190004 describe photoreceptors having a resin layer formed by binding an organic silicon modified positive hole transport compound in a curable organic silicon-based polymer; JP-2000-171990-A describes a photoreceptor formed by curing a curable siloxane resin having a charge transport property imparting group to have a three dimensional network structure; JP-2003-186223-A describes a photoreceptor containing a binder resin cross-linked in three dimensions with a charge transport material having one or more hydroxyl group and electroconductive particulates; JP-2007-293197-A describes a photoreceptor containing a cross-linked resin formed by cross-linking a reactive charge transport material, a polyol having two or more hydroxyl groups, and an aromatic isocyanate compound; JP-2008-299327-A describes a photoreceptor containing a melamine formaldehyde resin which is three-dimensional cross-linked with a charge transport material having one or more hydroxyl group; and JP-4262061-B describes a photoreceptor containing a resol-type phenolic resin which is three-dimensional cross-linked with a charge transport material having a hydroxyl group.

Furthermore, JP-2006-251771-A describes a photoreceptor containing an optically functional organic compound that can form a cured film, sulfonic acid and/or its derivative, and an amine having a boiling point of 250° C. or lower; and JP-2009-229549-A describes a photoreceptor formed of a cross-linked material prepared by a liquid application that contains either or both of a guanamine compound and a melamine compound and at least one charge transport material having one or more substitution groups selected from the group consisting of —OH, —$OCH_3$, —$NH_2$, —SH, and —COOH, where the concentration of the solid portion of the material selected from the guanamine compound and the melamine compound in the liquid application ranges from 0.1% by weight to 5% by weight and the concentration of the solid portion of the at least one charge transport material in the liquid application is 90% by weight or more.

Among these photoreceptors, those having a three-dimensional cross-linked surface layer have excellent mechanical durability, which is advantageous in prolonging the working life of the photoreceptors. For example, the photoreceptor described in JP-2000-66425-A mentioned above can have a three-dimensional cross-linked layer formed by radical polymerization using ultraviolet light or an electron beam and demonstrates an excellent abrasion resistance. However, such a photoreceptor accompanies problems such that large-scale instrumentation to emit the ultraviolet light or the electron beams, thereby degrading the productivity. Moreover, the charge transport material tends to deteriorate due to the irradiation by these, which results in deterioration of the voltage characteristics of the photoreceptor. By contrast, the photoreceptors described in JP-2007-293197-A, JP-2008-299327-A, JP-4262061-B, JP-2006-251771-A, and JP-2009-229549 mentioned above are easy to produce because the three-dimensional layer can be formed by thermosetting, and moreover they demonstrate excellent abrasion resistance.

However, since the photoreceptor described in JP-2007-293197-A mentioned above is cured by urethane bonding, the charge transport property is inferior and the photoreceptor exhibits poor electrical characteristics. The photoreceptors described in JP-2008-299327-A, JP-4262061-B, JP-2006-251771-A, and JP-2009-229549-A mentioned above have a surface layer formed by three-dimensional cross-linking the charge transport compound having a polar group such as a hydroxyl group and a reactive active species such as melamine and demonstrates relatively excellent electrical characteristics. In particular, the photoreceptor described in JP-2009-229549-A mentioned above demonstrates excellent charge transportability and good sensitivity because it uses a charge transport compound with a high ratio of 90% or more by weight. However, the polar groups such as OH group contained in the charge transport compound inevitably remains in the three dimensionally cross-linked layer, thereby reducing the charge. As a result, the image density tends to decrease in a high temperature, high humidity environments, as well as with exposure to $NO_x$ gas, etc, produced by a charger.

JP-2006-84711-A describes a photoreceptor formed by curing a compound in which OH groups, etc. in a charge transport compound are blocked with a reactive activated species such as a melamine. In this case, although it is possible to prevent the polar group from remaining in the cross-linked layer, the blocked OH group and the reactive activated species tend not to react easily. Therefore, forming a three-dimensional cross-linked layer having excellent mechanical characteristics is difficult.

As described above, photoreceptors having a three-dimensional cross-linked layer on the surface have been investigated and prove to be effective in improving the abrasion resistance.

On the other hand, there is a defect of the three dimensional cross-linked layer, which is that the charge transport property deteriorates because the charge transport compound is fixed in a cured matrix. As in JP-2009-229549-A mentioned above, if simply a charge transport compound having a high polar group such as OH group is used in an amount of 90% or more, the remaining amount of the charge transport compound having non-reacted OH group tends to increase, which makes it difficult to reduce the electrical potential variation caused by the operating environment.

Therefore, it is not possible to have a good combination of charge transport and the stability (for environment, gases, etc,).

Moreover, a different problem arises if a three dimensional cross-linked layer in which a charge transport compound is molecule-dispersed is used.

Once the surface of a photoreceptor having an improved abrasion resistance is damaged and/or foreign objects are firmly attached thereto, such a state continues to remain, resulting in continued production of defective images.

In particular, to deal with the demand for improvement in the quality of images and energy-saving, smaller toner particles having a lower softening temperature have been used in recent years. With regard to such toner, inorganic particulates such as silica are used to secure the fluidity of the toner.

Such silica particulates easily stick to the surface of the organic photoconductor in the development process and wax components etc., of the toner accumulate around the stuck silica particulates, which causes production of defective images having white spots.

The three dimensionally cross-linked layer in which a charge transport component having no cross-linking reactivity is molecule-dispersed tends to be phase-separated during cross-linking reaction. This easily leads to occurrence of image defects such as white spots and prevents attaining a good combination of the charge transport property and the inherent abrasion resistance of the three-dimensional cross-linked layer.

Therefore, a photoreceptor has not been provided which is highly durable and stable while maintaining inherent abrasion resistance of a three-dimensional cross-linked layer to prevent production of detective images such as white spots over repetitive use and reduce the electrical potential variation in operating environments and an image forming method, an image forming apparatus, and a process cartridge for image forming which use the photoreceptor have not been provided, either.

As the photoreceptor that stably outputs quality images in any operating environment, it is necessary to have excellent mechanical characteristics (such as abrasion resistance and damage resistance) to reduce the electrical potential variation caused by the layer thickness variation, excellent charge transport property, and excellent stability to reduce the electrical potential variation in an operating environment.

SUMMARY OF THE INVENTION

Because of these reasons, the present inventors recognize that a need exists for a long-working-life photoreceptor having a surface stably having both an excellent mechanical durability and an excellent charge transport property and, in particular, stably producing quality images even under the exposure to the $NO_x$ in a high humidity and high concentration conditions and an image forming method, an image forming apparatus, and a process cartridge using the photoreceptor.

Accordingly, an object of the present invention is to provide a long-working-life photoreceptor having a surface stably having both an excellent mechanical durability and an excellent charge transport property and, in particular, stably producing quality images even under the exposure to the $NO_x$ in a high humidity and high concentration conditions and an image forming method, an image forming apparatus, and a process cartridge using the photoreceptor.

Briefly this object and other objects of the present invention as hereinafter described will become more readily apparent and can be attained, either individually or in combination thereof, by a photoreceptor including an electroconductive substrate; and a photosensitive layer overlying the electroconductive substrate, wherein the uppermost surface layer of the photosensitive layer has a three-dimensional cross-linked product formed by polymerization reaction of a charge transport compound A represented by the following Chemical Structure 1 and a charge transport compound B having three or more [tetrahydro-2H-pyran-2-yl)oxy]methyl groups linked with aromatic rings in which part of the [tetrahydro-2H-pyran-2-yl)oxy]methyl groups is severed and detached Chemical Structure 1

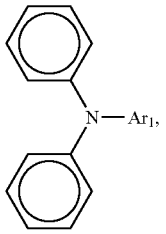

where $Ar_1$ represents an aromatic hydrocarbon group having 6 to 20 carbon atoms that may have an alkyl group having one to four carbon atoms as a substitution group.

As another aspect of the present invention, an image forming method is provided which includes charging the surface of the photoreceptor mentioned above, irradiating the surface of the photoreceptor with light to form a latent electrostatic image thereon, developing the latent electrostatic image with toner to obtain a visual image, transferring the visual image onto a recording medium; and fixing the visual image on the recording medium.

As another aspect of the present invention, an image forming apparatus is provided which includes the photoreceptor mentioned above, a charger to charge the surface of the photoreceptor, an irradiator to irradiate the surface of the photoreceptor with light to form a latent electrostatic image thereon, a development device to develop the latent electrostatic image with toner to form a visual image, a transfer device to transfer the visual image onto a recording medium, and a fixing device to fix the visual image on the recording medium.

As another aspect of the present invention, a process cartridge detachably attachable to an image forming apparatus is provided which includes the photoreceptor mentioned above, and at least one device selected from the group consisting of a charger, an irradiator, a development device, a transfer device, a cleaning device, and a discharger.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE PRESENT DISCLOSURE

Figure 1:
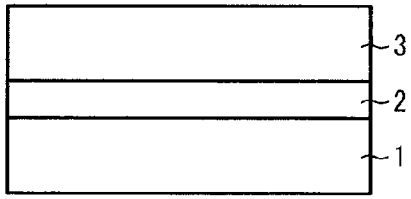
FIG. 1 is a schematic diagram illustrating an example of a layer structure of a photoreceptor of the present disclosure.

The photoreceptor of the present disclosure has an uppermost surface layer that contains a three-dimensional cross-linked product formed by coexistence of polymerization of a charge transport compound B and a charge transport compound A. The charge transport compound A (hereinafter referred to as compound A) is represented by the following Chemical Structure 1 and the charge transport compound B (hereinafter referred to as compound B) is a charge transport compound having three or more [tetrahydro-2H-pyran-2-yl)oxy]methyl groups linked with the aromatic rings. Coexistence of the polymers is a result of reaction in which part of the [tetrahydro-2H-pyran-2-yl)oxy]methyl group is severed and detached.

These materials, polymerization reaction, and structures are described next.

First, the materials are described.

Among the triaryl amine compounds, a phenyl group having no substitution group that links with a nitrogen atom serves as a good polymerizable functional group in the reaction in which part of [tetrahydro-2H-pyran-2-yl)oxy]methyl group is severed and detached. This is described in detail in the polymerization reaction described below. Therefore, the compound A is a particular known charge transport compound, which is a triaryl amine compound represented by the Chemical structure 1 illustrated above having two or more phenyl groups having no substitution group and polymerizable with the compound B having three or more [tetrahydro-2H-pyran-2-yl)oxy]methyl group to the aromatic rings.

Charge Transport Compound A

The charge transport compound A represented by the Chemical Structure 1 is described.

Chemical Structure 1

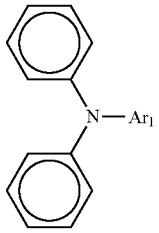

$Ar_1$ represents an aromatic hydrocarbon group having 6 to 20 carbon atoms that may have an alkyl group having one to four carbon atoms as a substitution group. Among the aromatic hydrocarbon groups having 6 to 20 carbon atoms, benzene is preferable because it can have a high cross-linking density and biphenyl, terphenyl, fluorene, styryl benzene, and α phenyl styryl benzene are preferable in terms of the charge transport property. The compounds represented by the following Chemical Structures 2 to 8 are more preferably used.

Chemical Structure 2

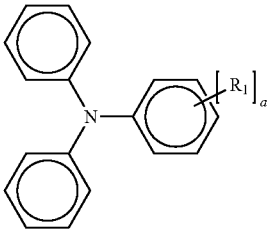

In the Chemical Structure 2, $R_1$ represents a methyl group and a symbol "a" represents 0 or an integer of from 1 to 5.

Chemical Structure 3

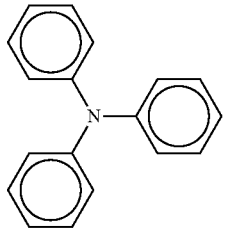

Chemical Structure 4

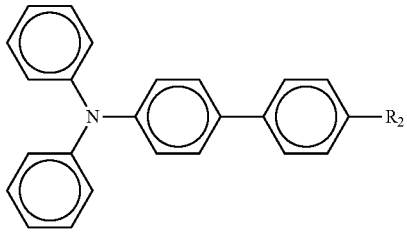

In the Chemical Structure 4, $R_2$ represents a hydrogen atom, a methyl group, an ethyl group, and a tertial butyl group.

Chemical Structure 5

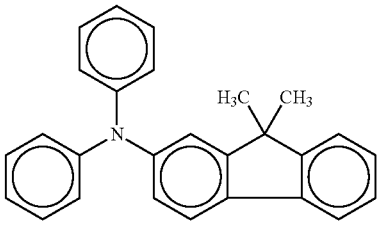

Chemical Structure 6

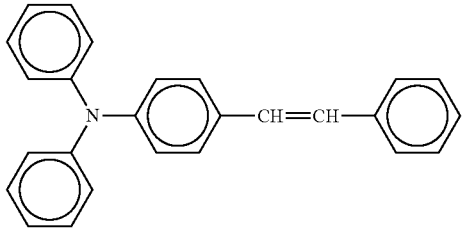

Chemical Structure 7

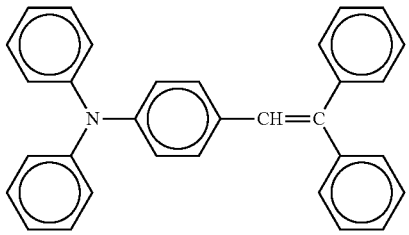

-continued

Chemical Structure 8

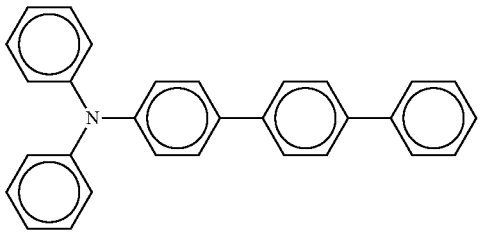

Next, specific examples that include these are described below but the present invention is not limited thereto. Specific examples of the compound A represented by the Chemical Structure 1 include, but are not limited to, the following.

| Chemical Compound A No. | Chemical Structures |
|---|---|
| A1 | 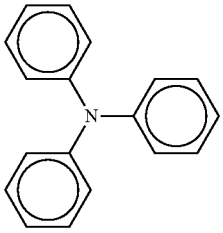 |
| A2 | 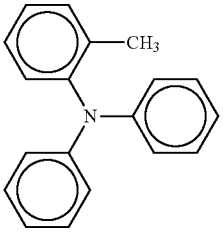 |
| A3 | 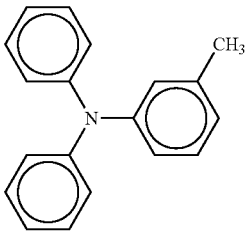 |
| A4 | 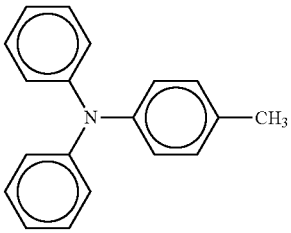 |

-continued

| Chemical Compound A No. | Chemical Structures |
|---|---|
| A5 | 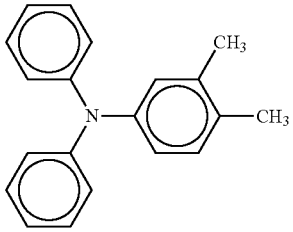 |
| A6 | 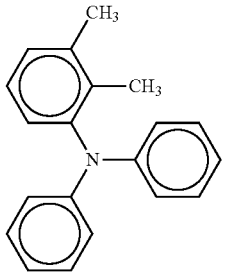 |
| A7 | 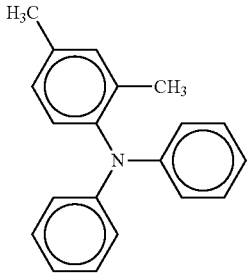 |
| A8 | 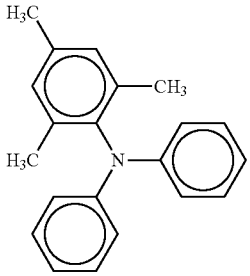 |
| A9 | 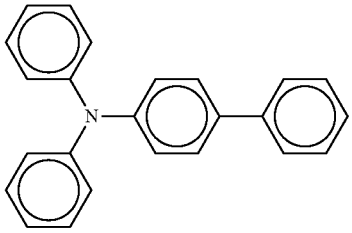 |

-continued

| Chemical Compound A No. | Chemical Structures |
|---|---|
| A10 | 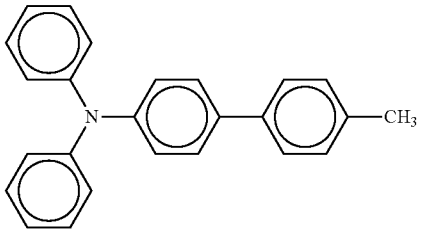 |
| A11 | 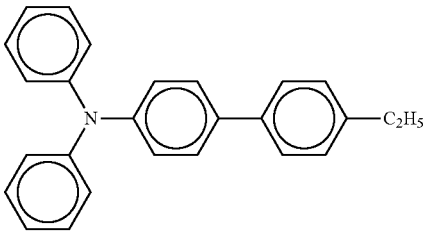 |
| A12 | 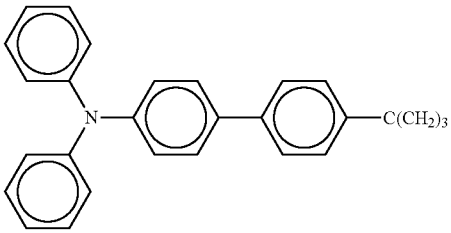 |
| A13 | 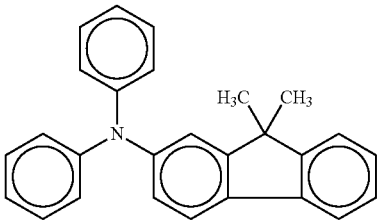 |
| A14 | 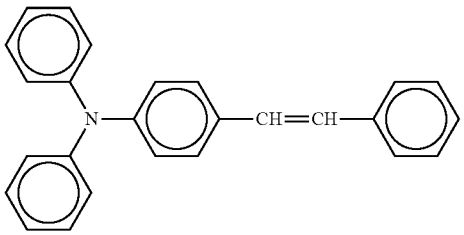 |
| A15 | 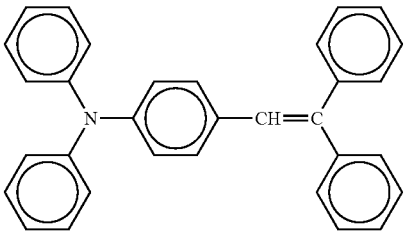 |

-continued

| Chemical Compound A No. | Chemical Structures |
|---|---|
| A16 | 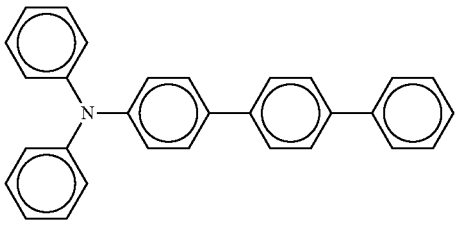 |

The compound A (the charge transport compound represented by the Chemical Stricture 1) is a known compound and can be obtained from a diphenyl amine compound and a halogen compound by using a known synthesis method.

When the halogen compound is an iodine body, coupling can be made by Ullmann reaction. In addition, when the halogen compound is a bromine body or chlorine body, coupling can be conducted by Suzuki-Miyaura coupling using a palladium catalyst, etc.

Charge Transport Compound B

The compound B (the charge transport compound having three or more [tetrahydro-2H-pyran-2-yl)oxy]methyl groups linked with the aromatic rings) is described next.

A number of materials are known as charge transport compounds. These compounds contain an aromatic ring in most cases.

For example, any of the triaryl amine structure, the amino biphenyl structure, the benzidine structure, the aminostilbene structure, the naphthalene tetracarboxylic diimide structure, and the benzhydrazine structure contains an aromatic ring.

Among these, any compound B (the charge transport compound having three or more [tetrahydro-2H-pyran-2-yl)oxy]methyl groups linked with the aromatic ring) can be used and in particular the compounds represented by the following Chemical Structures 9 to 14 can be preferably used.

Chemical Structure 9

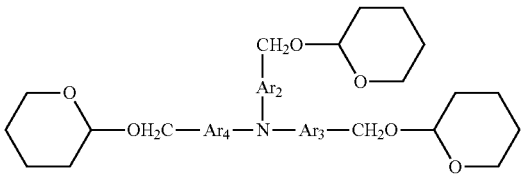

Chemical Structure 10

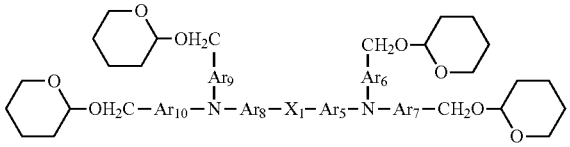

Chemical Structure 11

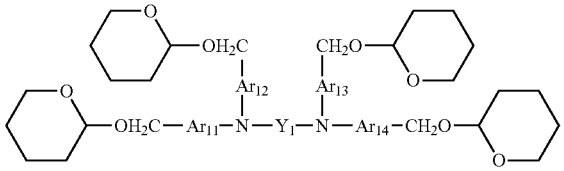

-continued

Chemical Structure 12

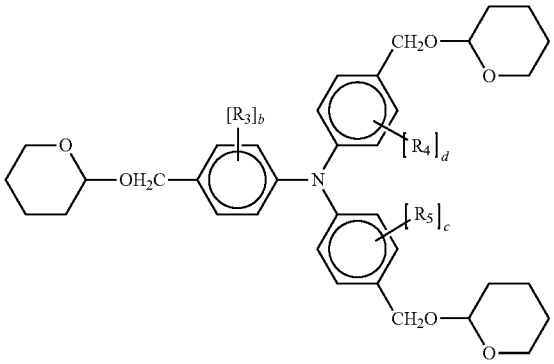

Chemical Structure 13

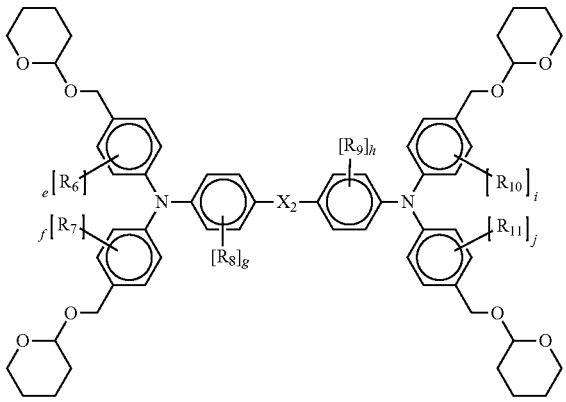

Chemical Structure 14

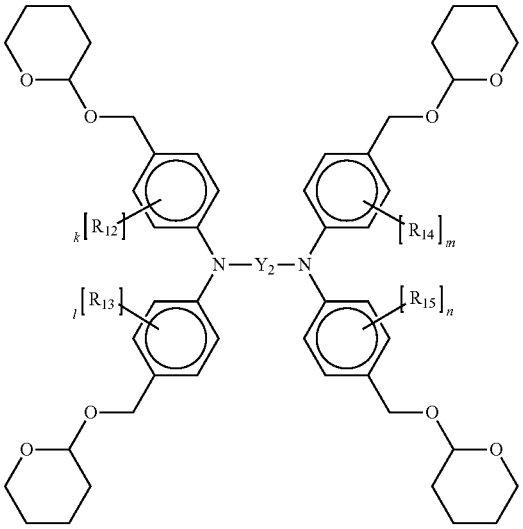

In the Chemical Structure 9, $Ar_2$, $Ar_3$, and $Ar_4$ represent divalent groups of an aromatic hydrocarbon having 6 to 18 carbon atoms that may have an alkyl group as a substitution group. Specific examples of the aromatic hydrocarbon having 6 to 18 carbon atoms include, but are not limited to, benzene, naphthalene, fluorene, phenanthrene, anthracene, pyrene, and biphenyl.

Specific examples of the alkyl group as a substitution group include, but are not limited to, straight-chain or branch-chained aliphatic alkyl groups such as a methyl group, an ethyl group, a propyl group, a butyl group, a pentyl group, a hexyl group, a heptyl group, and an octyl group.

$Ar_5$, $Ar_6$, $Ar_7$, $Ar_8$, $Ar_9$, and $Ar_{10}$ in the Chemical Structure 10 are the same as those for $Ar_2$, $Ar_3$, and $Ar_4$ in the Chemical Structure 9. $X_1$ represents an alkylene group having one to four carbon atoms, an alkylidene group having two to six carbon atoms, a divalent group in which two alkylidene groups having two to six carbon atoms are bonded via a phenylnene group, and an oxygen atom.

Specific examples of the alkylene group having one to four carbon atoms include, but are not limited to, straight chain and branch chained alkylene groups such as a methylene group, an ethylene group, a propylene group, and a butylene group. Specific examples of the alkylydene group having two to six carbon atoms include, but are not limited to, 1,1,-ethylidene group, 1,1,-propylidene group, 2,2-propylidene group, 1,1-butylidene group, 2,2-butylidene group, 3,3-pentanylidene, and 3,3-hexanylidene. Specific examples of the divalent group in which two alkylidene groups having two to six carbon atoms are bonded via a phenylnene group include, but are not limited to, the following:

Chemical Structures 15

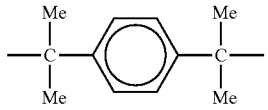

Chemical Structures 16

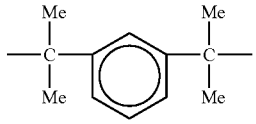

$Ar_{11}$, $Ar_{12}$, $Ar_{13}$, and $Ar_{14}$ in the Chemical Structure 11 are the same as those for $Ar_2$, $Ar_3$, and $Ar_4$ in the Chemical Structure 9. $Y_1$ represents a divalent group of benzene, biphenyl, terphenyl, stilbene, distilbene, and a condensed polycyclic aromatic hydrocarbon.

Specific examples of the condensed polycyclic aromatic hydrocarbon include, but are not limited to, naphthalene, phenanthrene, anthracene, and pyrene.

In the Chemical Structure 12, $R_3$, $R_4$, and $R_5$ independently represent hydrogen atoms, methyl groups, and ethyl groups. Symbols "b", "c", and "d" independently represent integers of from 1 to 4.

In addition, in the Chemical Structure 13, $X_2$ represents —$CH_2$—, —$CH_2CH_2$—, —$C(CH_3)_2$—Ph—$C(CH_3)_2$—, —$C(CH_2)_5$—, and —O—. $R_6$, $R_7$, $R_8$, $R_9$, $R_{10}$, and $R_{11}$ independently represent hydrogen atoms, methyl groups, and ethyl groups. Symbols "e", "f", "g", "h", "i", and "j" independently represent integers of from 1 to 4.

In addition, in the Chemical Structure 14, $Y_2$ represents a divalent group of benzene, biphenyl, terphenyl, stilbene, and naphthalene. $R_{12}$, $R_{13}$, $R_{14}$, and $R_{15}$ independently represent hydrogen atoms, methyl groups, and ethyl groups. Symbols "k", "l", "m", and "n" independently represent integers of from 1 to 4.

Next, specific examples of the compound B are illustrated below but the present invention is not limited thereto. Specific examples of the compound represented by the Chemical Structure 9 include, but are not limited to, the following.

| Chemical Compound B No. | Chemical Structure |
|---|---|
| B17 | 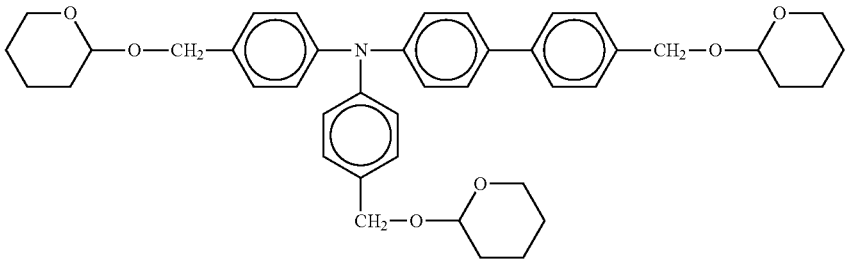 |
| B18 | 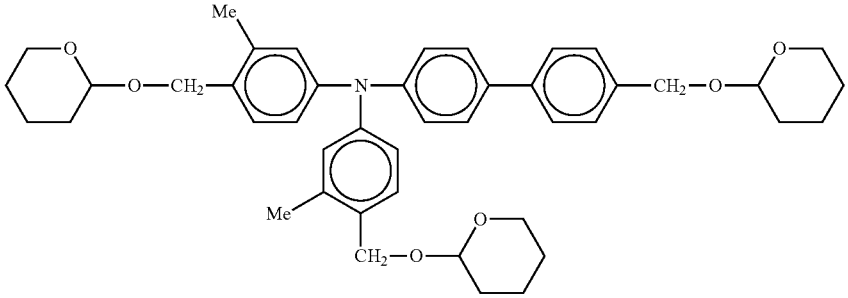 |
| B19 | 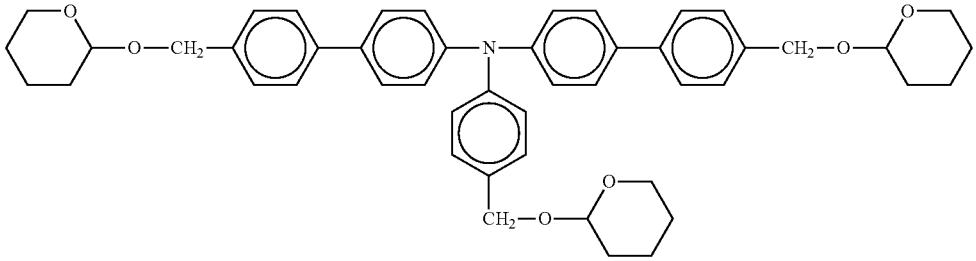 |
| B20 | 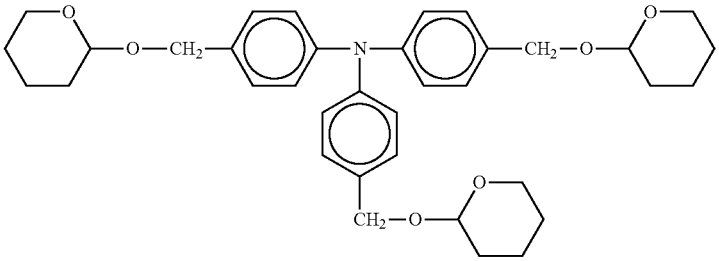 |
| B21 | 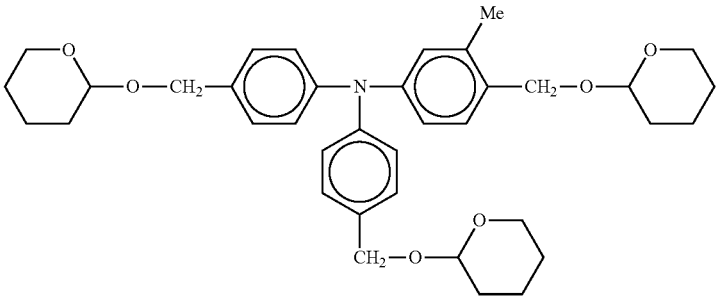 |

-continued
| Chemical Compound B No. | Chemical Structure |
|---|---|
| B22 | 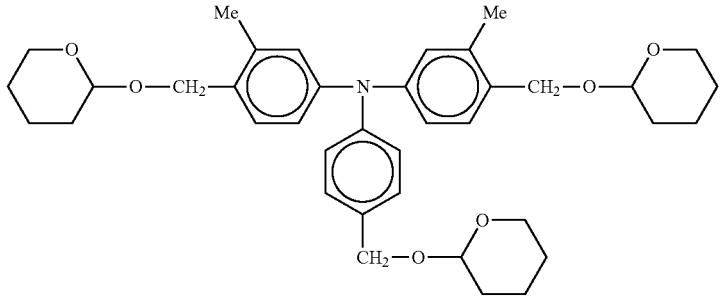 |
| B23 | 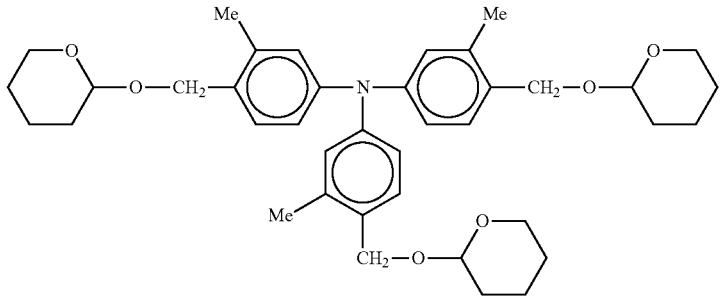 |
| B24 | 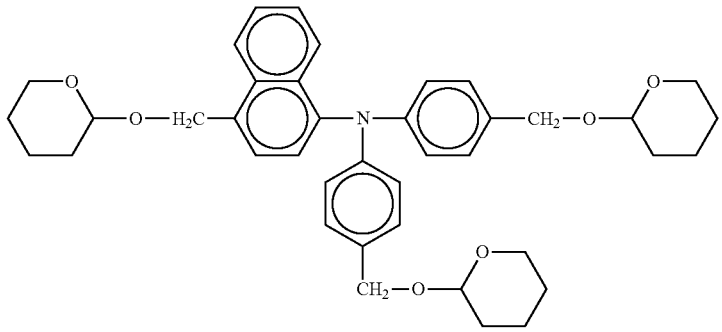 |
| B25 | 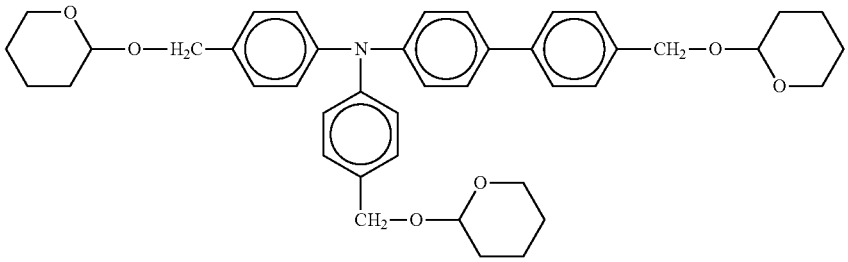 |
Among the compound represented by the Chemical Structure 9, No. B17 to B22 are specific examples of the compound represented by the Chemical Structure 12.
Specific examples of the compound represented by the Chemical Structure 10 include, but are not limited to, the following.

| Chemical Compound B No. | Chemical Structure |
|---|---|
| B26 | 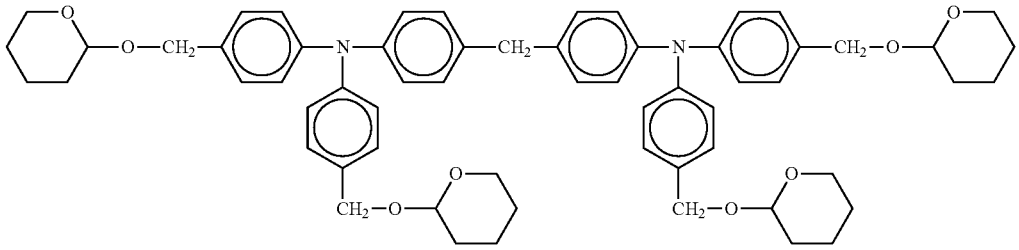 |
| B27 | 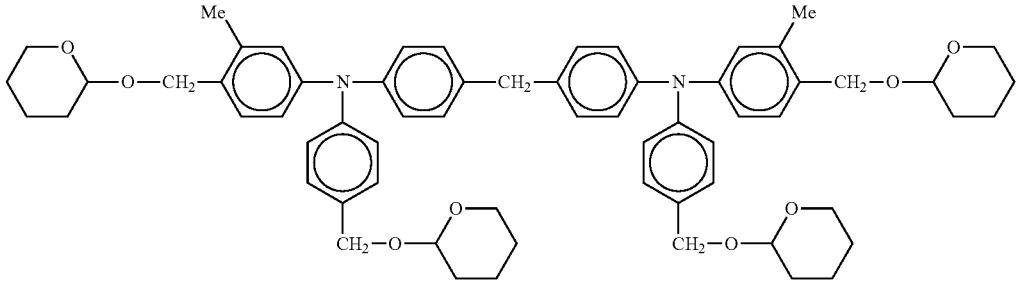 |
| B28 | 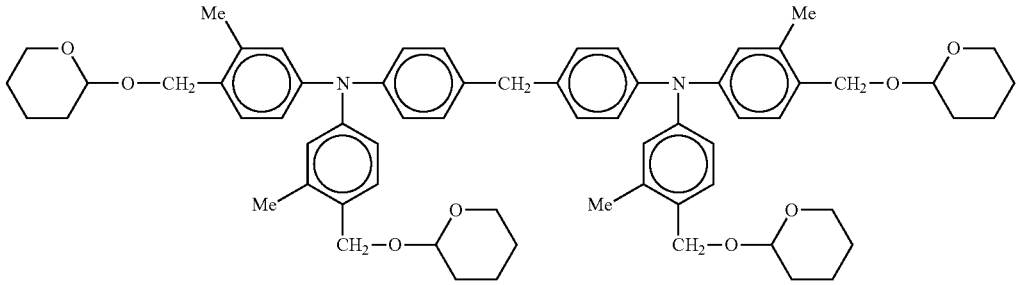 |
| B29 | 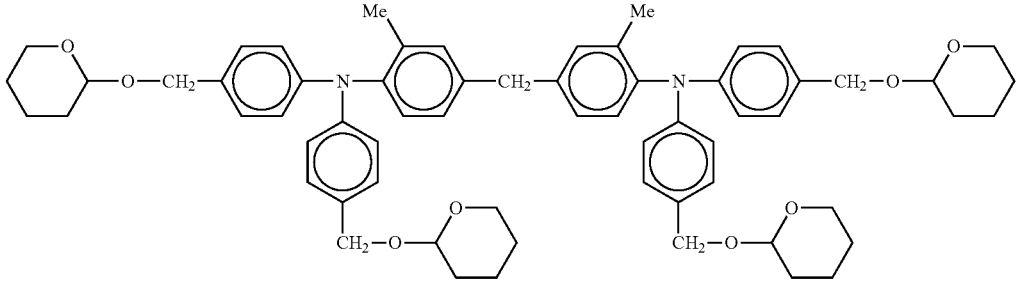 |
| B30 | 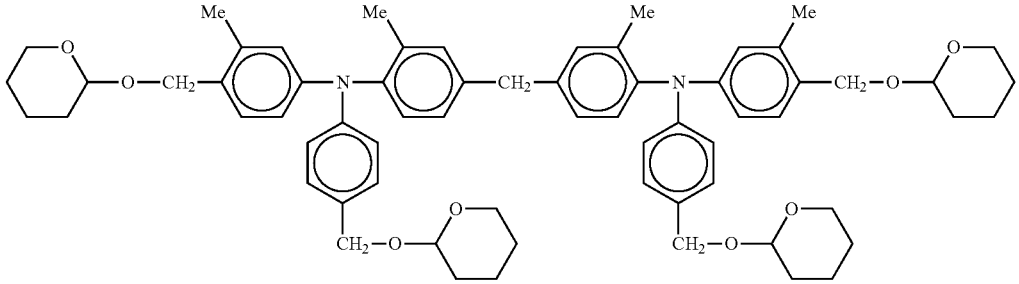 |

-continued
| Chemical Compound B No. | Chemical Structure |
|---|---|
| B31 | 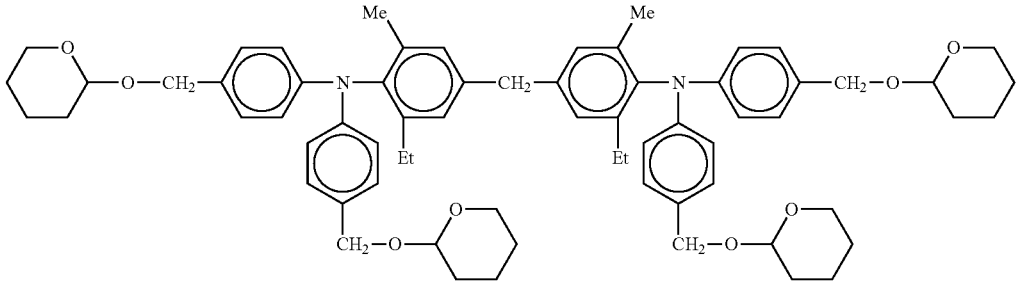 |
| B32 | 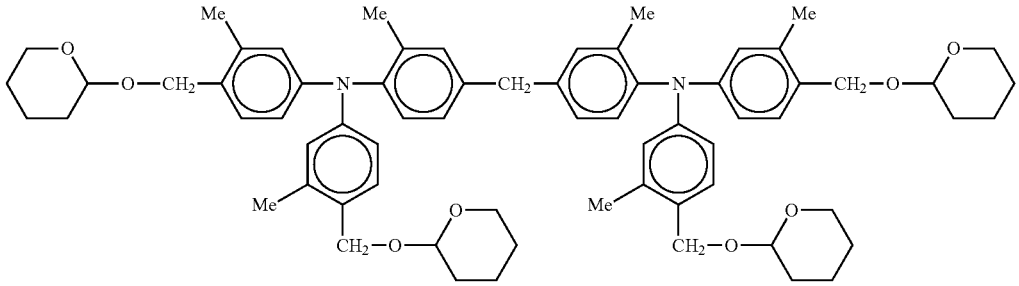 |
| B33 | 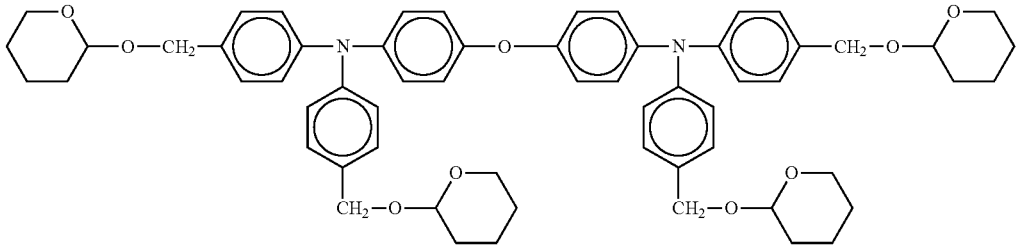 |
| B34 | 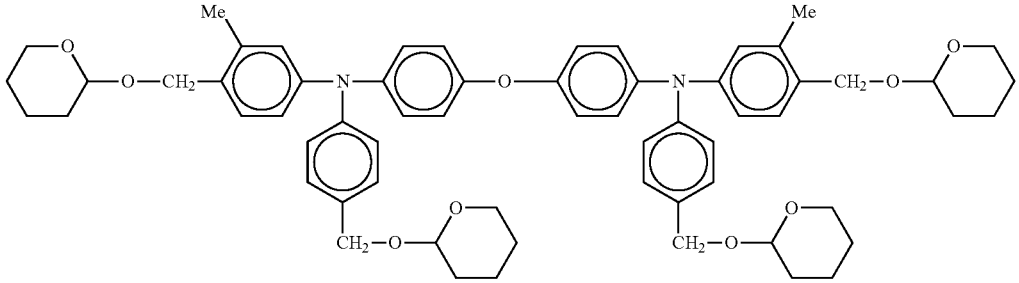 |
| B35 | 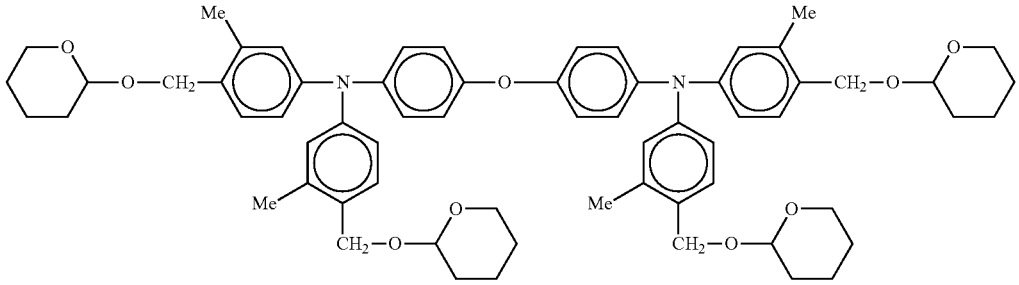 |

-continued
| Chemical Compound B No. | Chemical Structure |
|---|---|
| B36 | 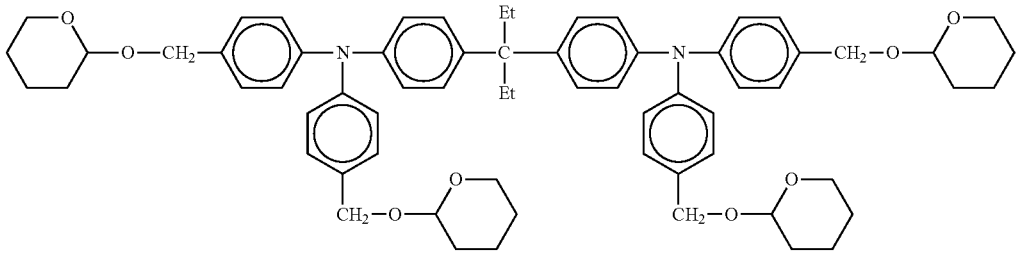 |
| B37 | 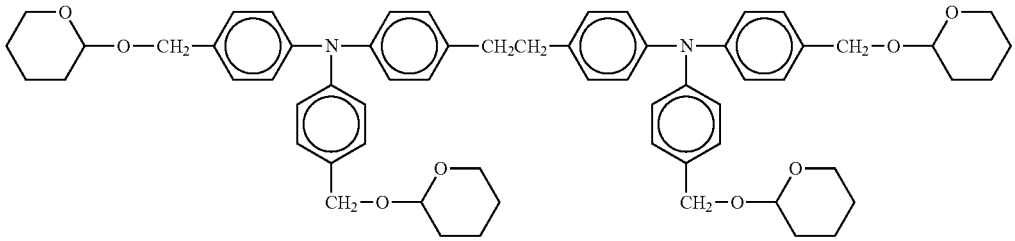 |
| B38 | 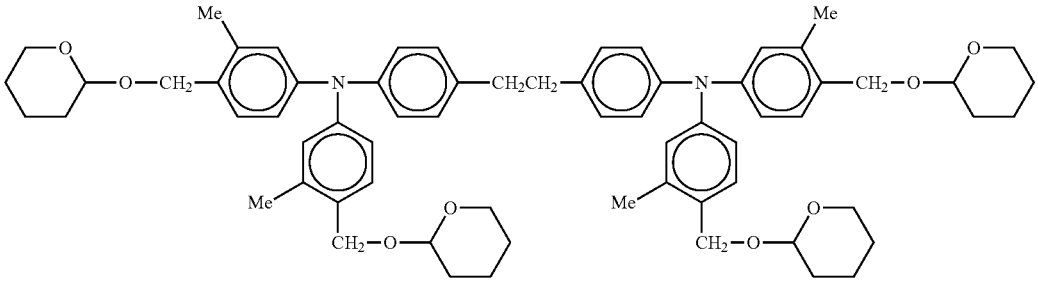 |
| B39 | 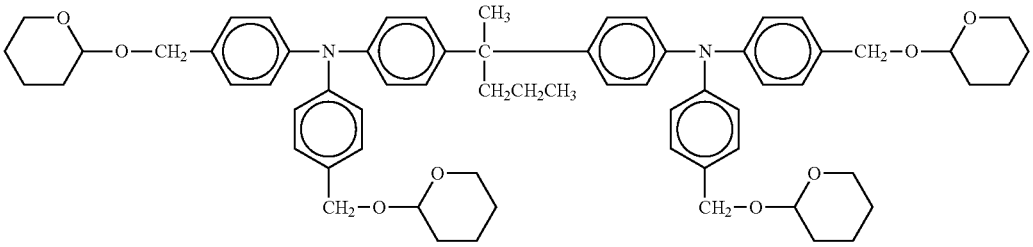 |
| B40 | 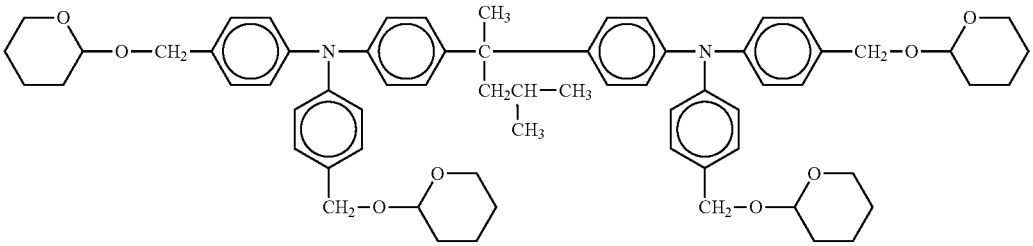 |
| B41 | 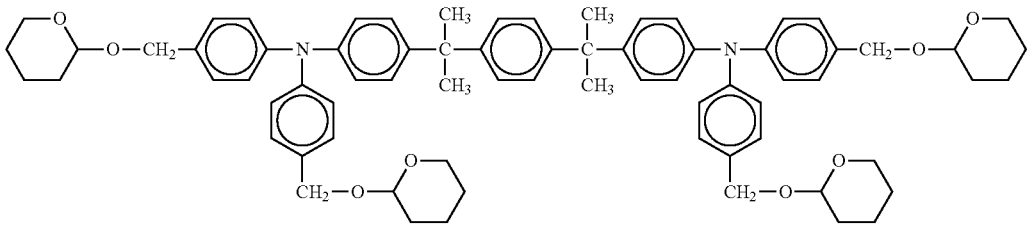 |

-continued
| Chemical Compound B No. | Chemical Structure |
|---|---|
| B42 | 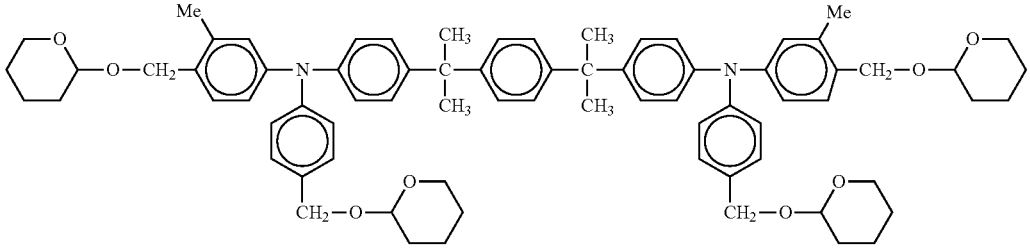 |
| B43 | 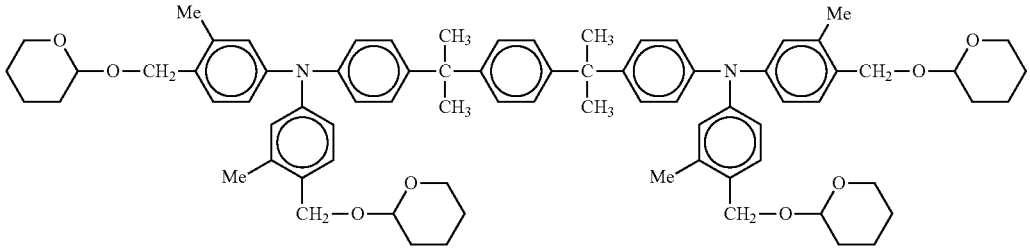 |
| B44 | 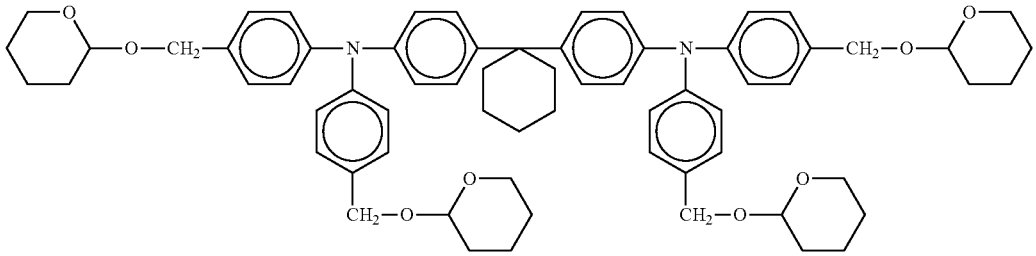 |
| B45 | 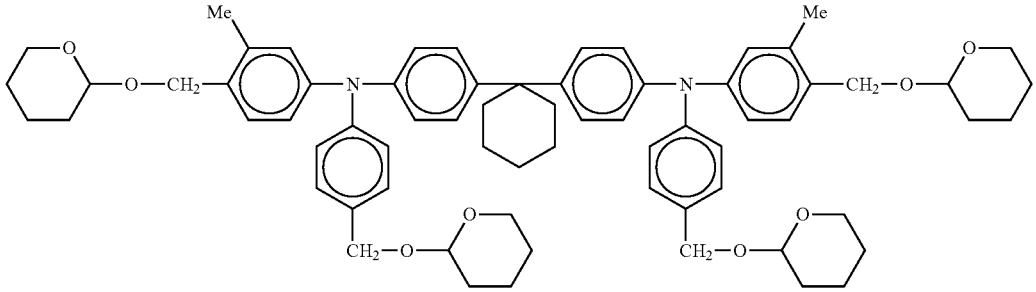 |
| B46 | 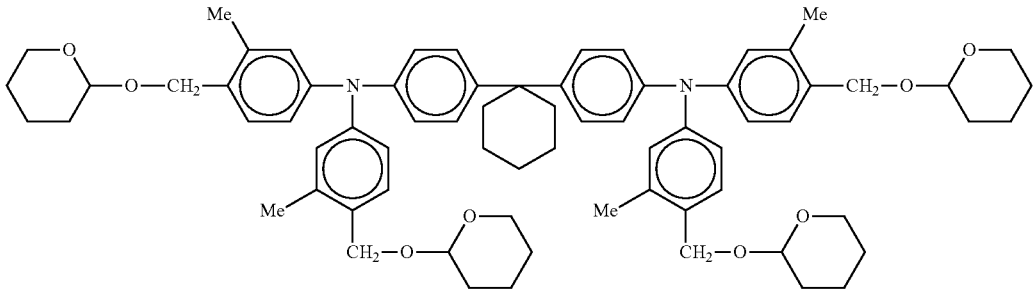 |

-continued

| Chemical Compound B No. | Chemical Structure |
|---|---|
| B47 | 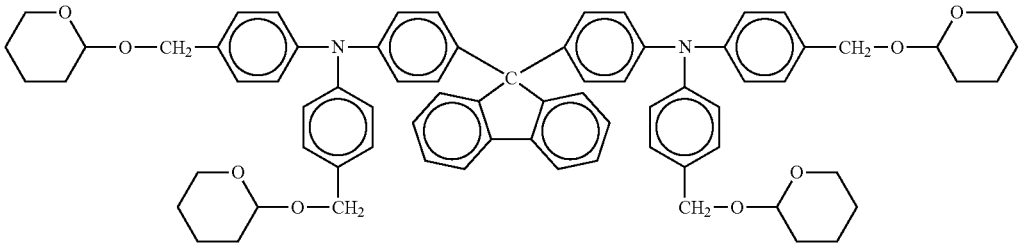 |
| B48 | 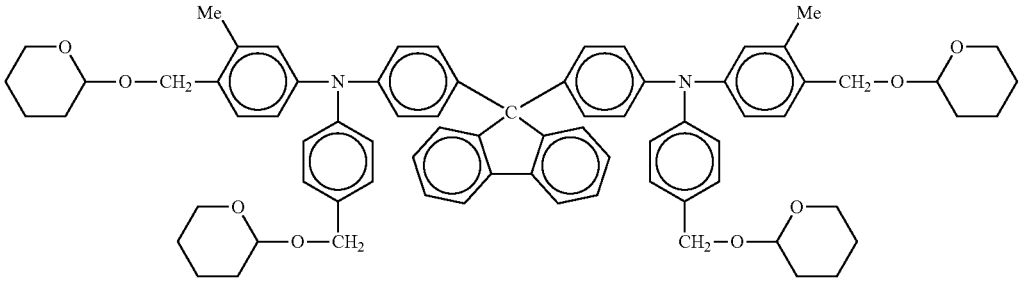 |
| B49 | 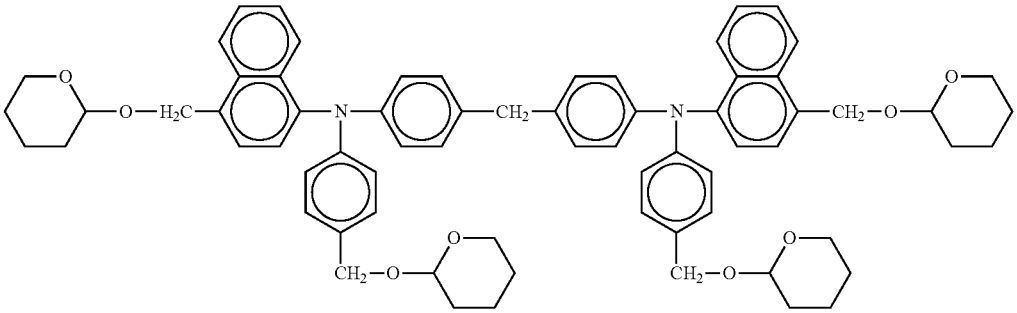 |
| B50 | 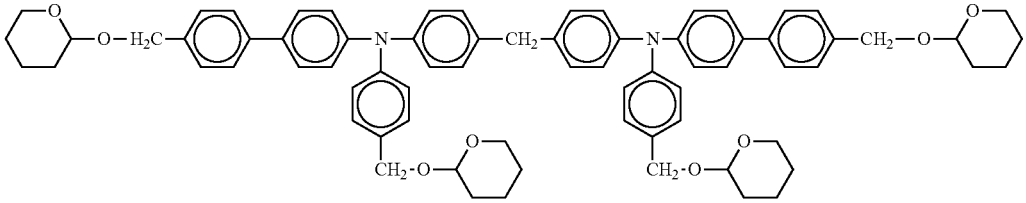 |

Among the compound represented by the Chemical Structure 10, B24 to B48 are specific examples of the compound represented by the Chemical Structure 13.

Specific examples of the compound represented by the Chemical Structure 11 include, but are not limited to, the following.

| Chemical Compound B No. | Chemical Structure |
|---|---|
| B51 | 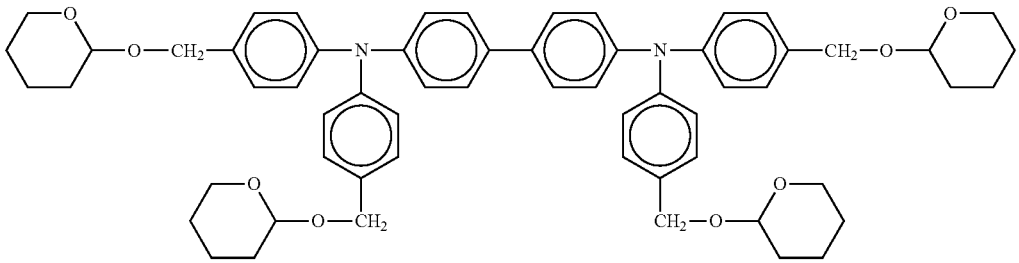 |

-continued
| Chemical Compound B No. | Chemical Structure |
|---|---|
| B52 | 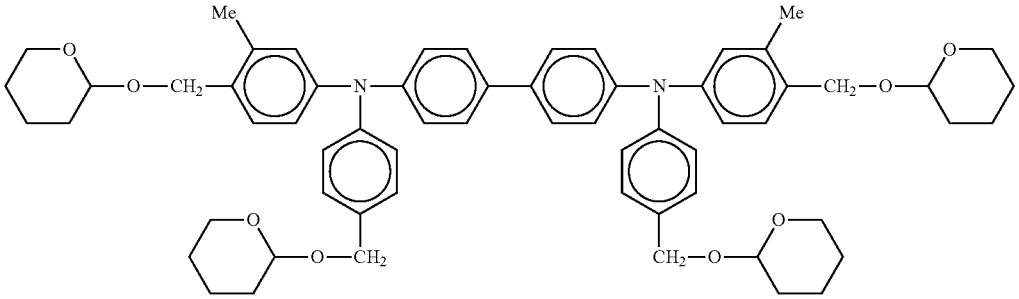 |
| B53 | 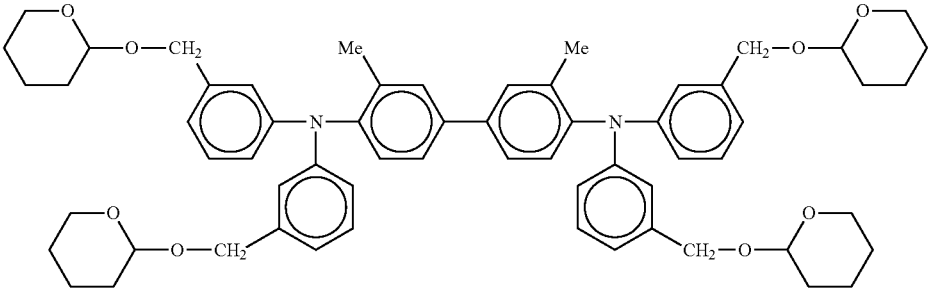 |
| B54 | 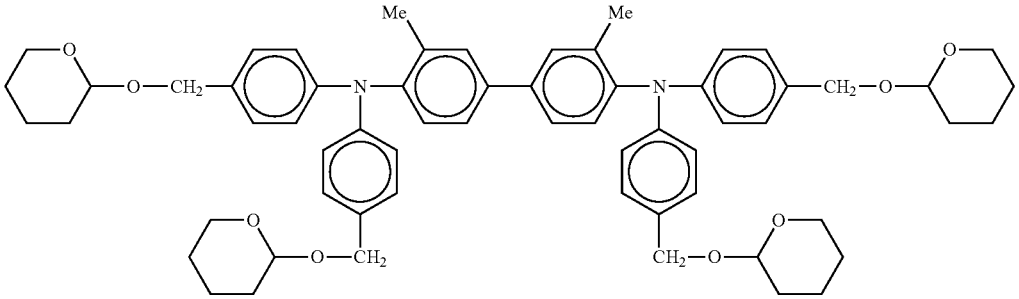 |
| B55 | 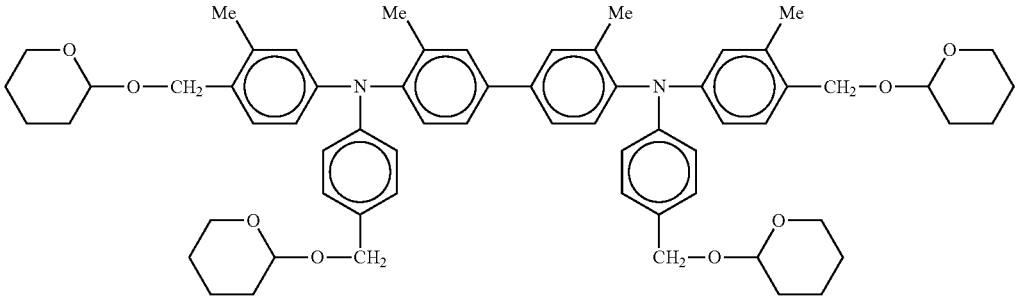 |
| B56 | 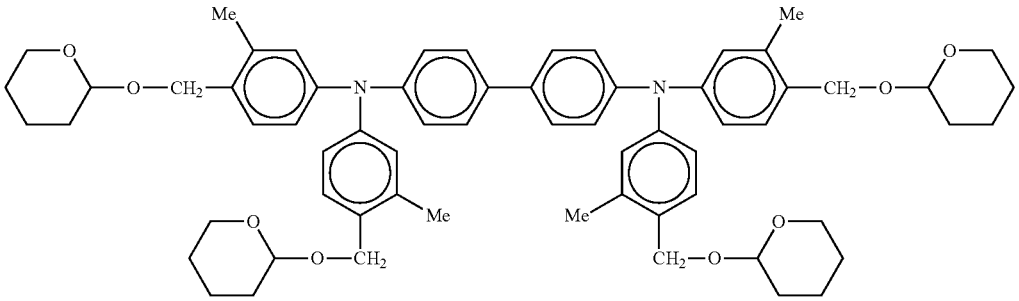 |

-continued
| Chemical Compound B No. | Chemical Structure |
|---|---|
| B57 | 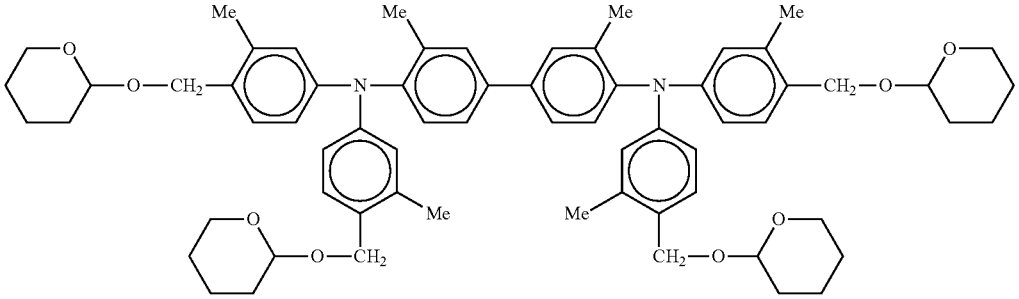 |
| B58 | 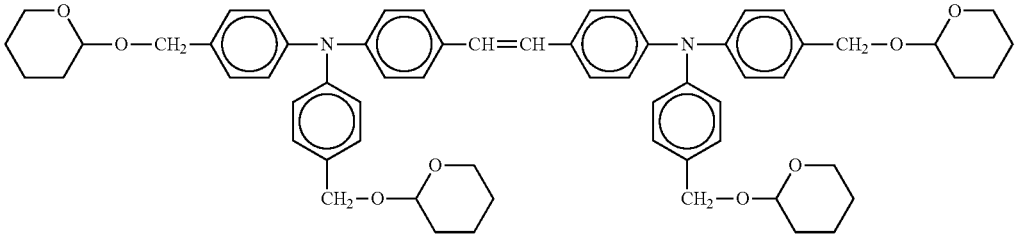 |
| B59 | 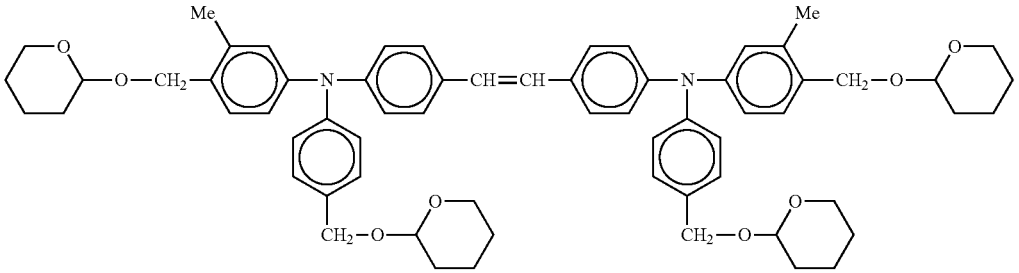 |
| B60 | 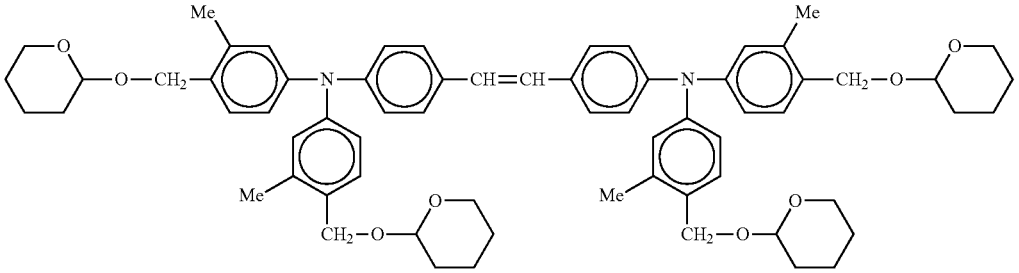 |
| B61 | 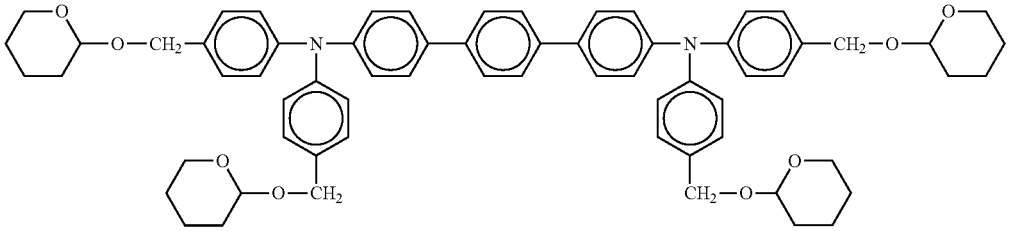 |

-continued
| Chemical Compound B No. | Chemical Structure |
|---|---|
| B62 | 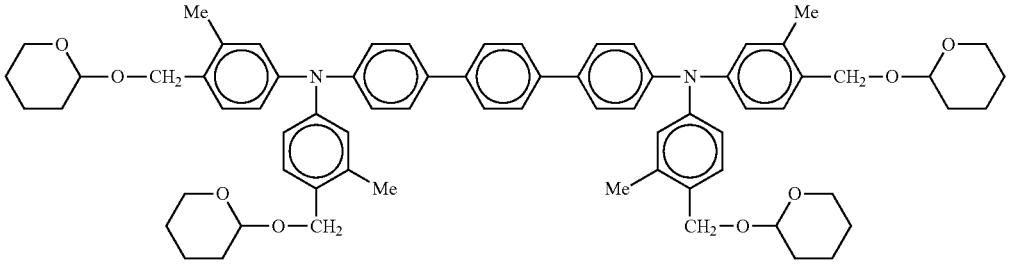 |
| B63 | 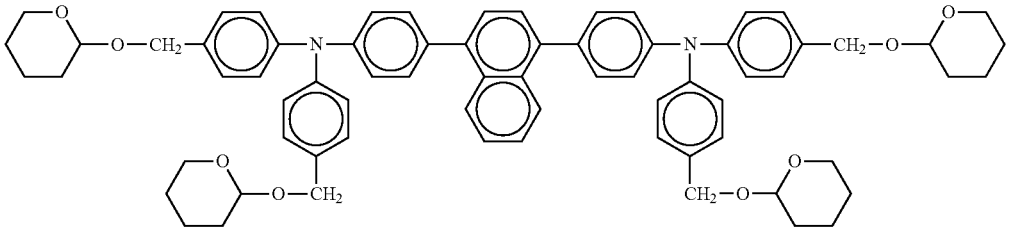 |
| B64 | 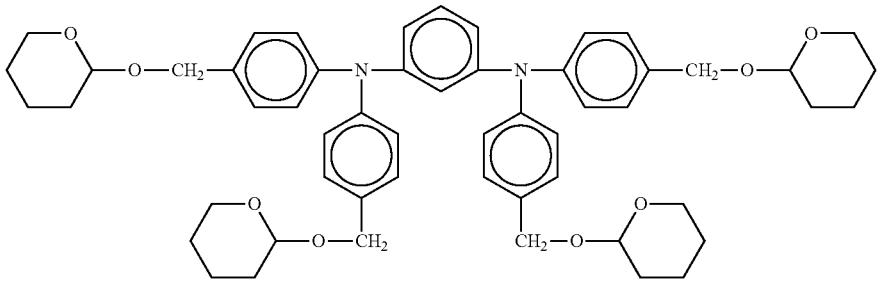 |
| B65 | 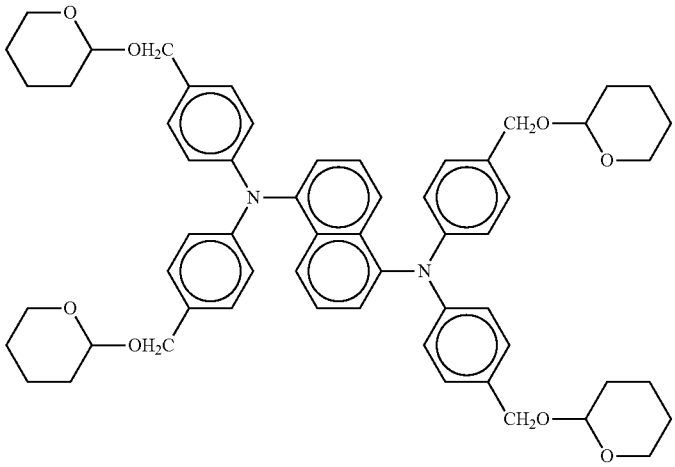 |
| B66 | 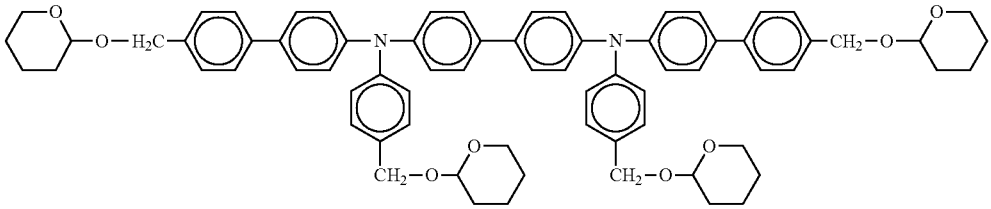 |

-continued

| Chemical Compound B No. | Chemical Structure |
|---|---|
| B67 | 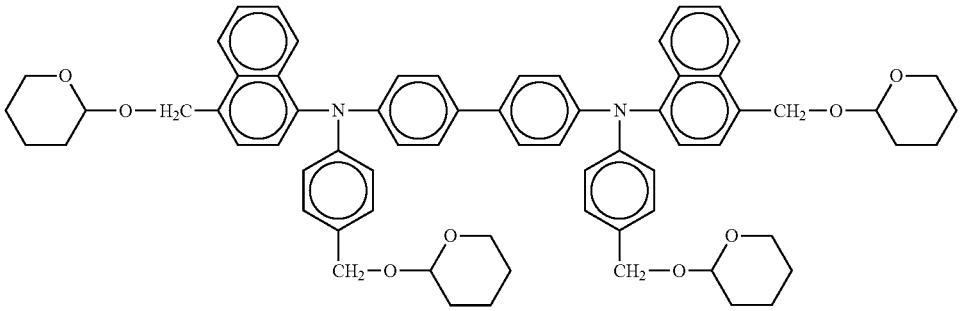 |

Among the compound represented by the Chemical Structure 11, No. B51 to B65 are specific examples of the compound represented by the Chemical Structure 14.

Any compound B, i.e., the charge transport compound having three or more [tetrahydro-2H-pyran-2-yl)oxy]methyl groups linked with the aromatic ring, can form a three dimensional cross-linked layer by polymerization reaction. The compound B represented by the Chemical Structure 9 has a high ratio of [tetrahydro-2H-pyran-2-yl)oxy]methyl group per molecular weight.

Therefore, a three dimensional cross-linked layer having a higher cross-linking density is formed so that a durable photoreceptor having a high hardness can be provided.

The compound represented by the Chemical Structure 10 has four [tetrahydro-2H-pyran-2-yl)oxy]methyl groups linked with the aromatic ring and has a moderate molecular mobility because of the non-conjugated connection group of $X_1$. Therefore, a three dimensional cross-linked layer tends to be formed in the polymerization reaction in which a part of [tetrahydro-2H-pyran-2-yl)oxy]methyl groups remains so that the combination of the hardness characteristics and the elasticity of the obtained three dimensional cross-liked layer is good in balance.

Therefore, a strong surface protective layer having an excellent combination of abrasion resistance and durability can be formed. Furthermore, due to the structure of $X_1$, the oxidation potential of the molecule is relatively large so that the compound is relatively stable and not easily oxidized by exposure to an oxidized gas such as ozone gas and an $NO_x$ gas. That is, it is possible to provide a photoreceptor having a good gas resistance.

The compound represented by the Chemical Structure 11 has four [tetrahydro-2H-pyran-2-yl)oxy]methyl groups linked with the aromatic ring and therefore, a three dimensional cross-linked layer in which a part of [tetrahydro-2H-pyran-2-yl)oxy]methyl groups remains tends to be formed in the polymerization reaction.

In addition, the compound has a diamine structure via a particular aromatic hydrocarbon structure represented by $Y_1$ and the charges are mobile in a molecule so that a cross-linked protective layer having a high hole mobility can be formed. Therefore, quality images can be stably printed even when the time to be taken from optical writing to development is shortened according to high speed printing or usage of a photoreceptor drum having a small diameter.

In addition, the compound represented by the Chemical Structure 12 is particularly excellent among the compound B represented by the Chemical Structure 9 and the mutual polymerization reactivity is particularly good.

Although the polymerization reaction between [tetrahydro-2H-pyran-2-yl)oxy]methyl groups is not all clear, the reaction proceeds fastest when the aromatic ring to which [tetrahydro-2H-pyran-2-yl)oxy]methyl group is bonded is a benzene ring having a tertiary amino group, thereby forming a cross-linked protective layer having a higher cross-linking density.

In addition, the compound represented by the Chemical Structure 13 is particularly excellent among the compound B represented by the Chemical Structure 10 and has the same feature as the compound represented by the Chemical Structure 9, thereby forming a three dimensional cross-linked layer (cross-linked protective layer) having a higher cross-linking density.

In addition, the compound represented by the Chemical Structure 14 is particularly excellent among the compound B represented by the Chemical Structure 11 and has excellent mutual polymerization reactivity and the same feature as the compound represented by the Chemical Structure 9, thereby forming a three dimensional cross-linked layer (cross-linked protective layer) having a higher cross-linking density.

The charge transport compound having three or more [tetrahydro-2H-pyran-2-yl)oxy]methyl groups linked with the aromatic ring, i.e., the compound B, is a new compound and can be manufactured by, for example, the following method.

The first method is: formylize three or more portions of an aromatic ring; reduce the formyl group to form a methylol group; and react 3,4-dihydro-2H-pyrane with the methylol group to attach a [tetrahydro-2H-pyran-2-yl)oxy]methyl group to the charge transport compound.

For example, the charge transport compound having [tetrahydro-2H-pyran-2-yl)oxy]methyl groups linked with the aromatic ring is obtained by: synthesizing an aldehyde compound by the procedure described below; react the thus-obtained aldehyde compound with a reducing agent such as hydrogeneated sodium borate to synthesize a methylol compound; and react the thus-obtained methylol compound with dihydro-2H-pyrane.

To be specific, the compound B can be easily synthesized by the following manufacturing method.

Synthesis of Aldehyde Compound of Charge Transport Compound

As represented in the following Chemical Reaction 1, a charge transport compound (raw material) is formylized by a known method (for example, Vilsmeier reaction) to synthesize an aldehyde compound. JP-3943522-B describes this formylization.

Chemical Reaction 1

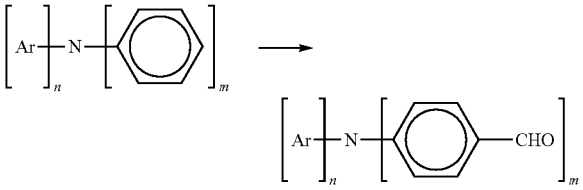

In the Chemical Reaction 1, Ar represents an aromatic group and symbols "n" and "m" independently represent integers.

That is, in the specific formylization method described above, zinc chloride/oxyphosphoprine chloride/dimethyl formaldehyde are suitably used but the synthesis method to obtain an aldehyde compound serving as the intermediate for use in the present disclosure is not limited thereto.

Specific synthesis examples thereof are deferred in Synthesis Examples.

Synthesis of Methylol Compound of Charge Transport Compound

As represented in the Chemical Reaction 2, the methylol compound can be synthesized by a known reduction method using an aldehyde compound as an manufacturing intermediate Chemical Reaction 2

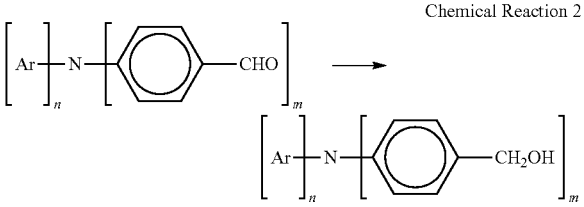

In the Chemical Reaction 2, Ar and symbols "n" and "m" represent the same as above.

That is, in the specific reduction method described above, sodium boron hydride is suitably used but the synthesis method to obtain the methylol compound for use in the present disclosure is not limited thereto. Specific synthesis examples thereof are deferred in Synthesis Examples.

Synthesis 1 of Charge Transport Compound (Compound B) Having [tetrahydro-2H-pyran-2-yl)oxy]methyl Groups Linked with Aromatic Ring)

As illustrated in the following Chemical Reaction 3, a charge transport compound having [tetrahydro-2H-pyran-2-yl)oxy]methyl group linked with the aromatic ring is synthesized by addition reaction of 3,4-dihydro-2-pyran to a methylol compound serving as a manufacturing intermediate under the presence of a catalyst.

Chemical Reaction 3

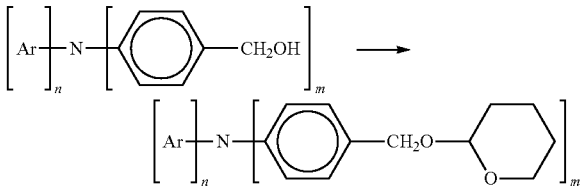

In the Chemical Reaction 2, Ar and symbols "n" and "m" represent the same as above.

That is, in the specific reduction method described above, dihydro-2-pyran is suitably used but the synthesis method to obtain the charge transport compound having [tetrahydro-2H-pyran-2-yl)oxy]methyl groups linked with the aromatic ring for use in the present disclosure is not limited thereto. Specific synthesis examples thereof are deferred in Examples.

The second method is: synthesizing an aromatic compound having a halogen and a [tetrahydro-2H-pyran-2-yl)oxy]methyl group by reaction between the methylol group in a compound having a halogen and a methylol group linked with the aromatic ring serving as a raw material and 3,4-dihydro-2H-pyran under the presence of an acid catalyst; and conduct coupling reaction between the aromatic compound and an amine compound to synthesize the charge transport compound.

Depending on the number of the amines and the number of H's attached to the amines, a number of [tetrahydro-2H-pyran-2-yl)oxy]methyl groups can be introduced once.

When the halogen is an iodine body, an amine compound and a halogen compound having a [tetrahydro-2H-pyran-2-yl)oxy]methyl group can be coupled by Ullmann reaction. In addition, when the halogen compound is a bromine body or chlorine body, coupling can be made by Suzuki-Miyaura coupling using a palladium catalyst, etc.

Synthesis of Intermediate Compound Having [tetrahydro-2H-pyran-2-yl)oxy]methyl Group Chemical Reaction 4

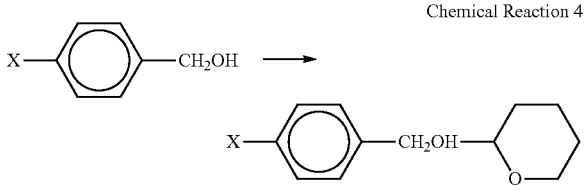

In the Chemical Reaction 4, X represents a halogen.

Synthesis 2 of Compound Having [tetrahydro-2H-pyran-2-yl)oxy]methyl Groups Linked with Aromatic Ring of Charge Transport Compound)

As illustrated in the following Chemical Reaction 5, a compound having a [tetrahydro-2H-pyran-2-yl)oxy]methyl group in the aromatic ring of a charge transport compound is synthesized by a known synthesis method using an amine compound and a halogen compound having a tetrahydropyranyl group.

Chemical Reaction 5

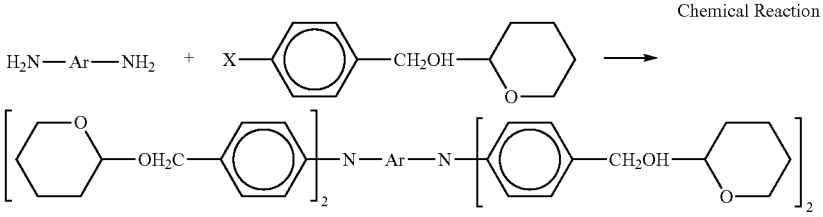

That is, in the specific synthesis method described above, although a method using Ullmann reaction, etc. is suitable, the synthesis method to obtain the charge transport compound having a [tetrahydro-2H-pyran-2-yl)oxy]methyl group linked with the aromatic ring is not limited thereto.

Specific synthesis examples thereof are deferred in Synthesis Examples.

Synthesis Example of Compound B

Synthesis Example 1

Synthesis of Halogen Intermediate of 4-[tetrahydro-2H-pyran-2-yl)oxy]methyl Bromobenzene Chemical Reaction 6

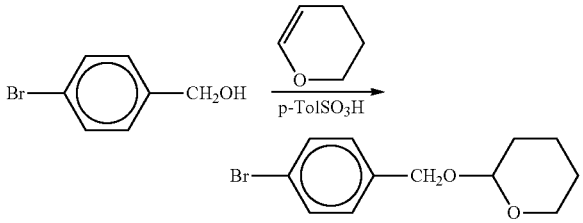

Place 50.43 g of 4-bromobenzyl alcohol, 45.35 g of 3,4-dihydro-2H-pyran, and 150 ml of tetrahydrofuran in a flask.

Stir the mixture at 5° C. and place 0.512 g of paratoluene sulfonate in the flask. Continue stirring for two hours at room temperature. Conduct extraction with ethyl acetate and dehydrate by magnesium sulfate to conduct absorption treatment by activated white earth and silica gel.

Subsequent to filtration, washing, and condensation, the target product is obtained (yield: 72.50 g colorless oily material).

Figure 9:
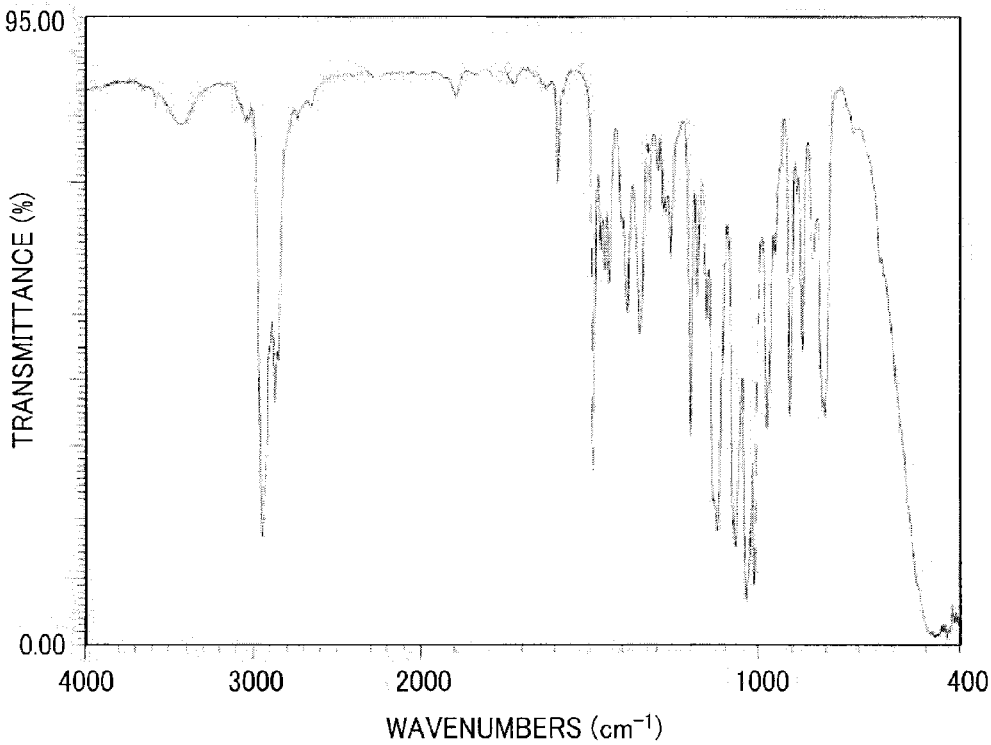
FIG. 9 is a graph illustrating an infrared absorption spectrum (KBr tablet method) of a compound obtained in Synthesis Example 1 described later with an X axis of wavenumber ($cm^{-1}$) and a Y axis of transparency (%)

FIG. 9 is a graph illustrating an infrared absorption spectrum (KBr tablet method) of the compound obtained in Synthesis Example 1.

Synthesis Example 2

Synthesis of Methylol Intermediate of 4,4'-bis[di(4-hydroxymethylphenyl)amino]diphenyl Methane Chemical Reaction 7

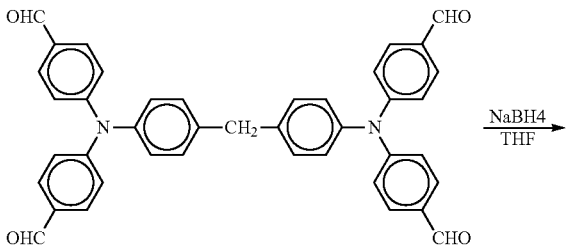

-continued

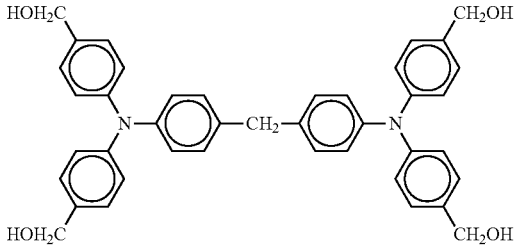

Place 12.30 g of an intermediate aldehyde compound and 150 ml of ethanol in a flask. Stir the mixture at room temperature and place 3.63 g of sodium boron hydride in the flask. Continue stirring for four hours. Conduct extraction with ethyl acetate and dehydrate by magnesium sulfate followed by absorption treatment by activated white earth and silica gel. Subsequent to filtration, washing, and condensation, an amorphous material is obtained. Disperse by n-hexane, and obtain the target product by filtration, washing, and drying (yield: 12.0 g, light yellow white amorphous).

Figure 10:
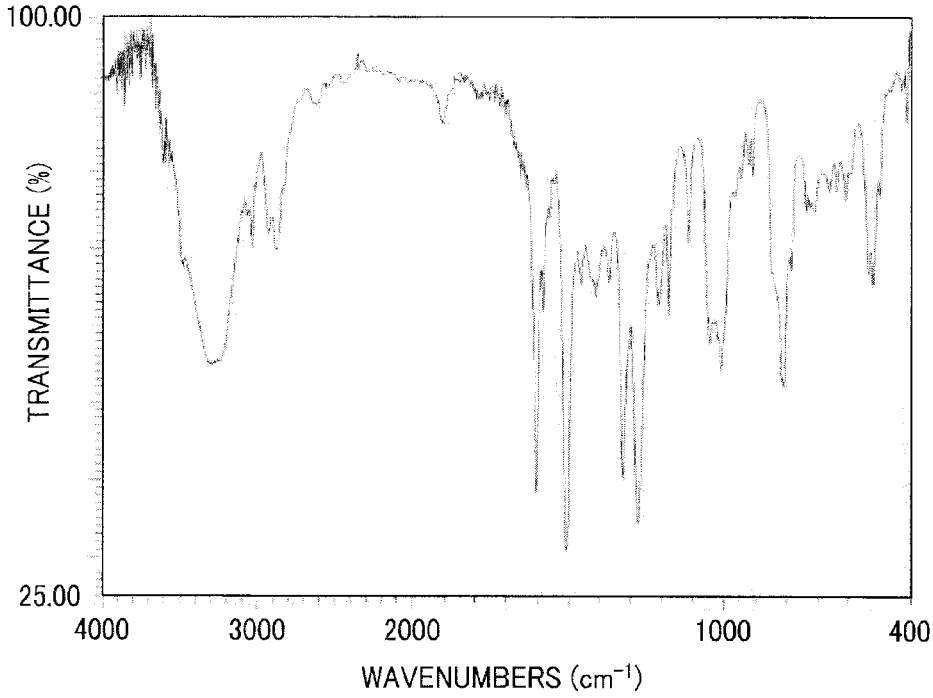
FIG. 10 is a graph illustrating an infrared absorption spectrum (KBr tablet method) of a compound obtained in Synthesis Example 2 described later with an X axis of wavenumber ($cm^{-1}$) and a Y axis of transparency (%)

FIG. 10 is a graph illustrating an infrared absorption spectrum (KBr tablet method) of the compound obtained in Synthesis Example 2.

Synthesis Example 3

Synthesis of No. B20 of Charge Transport Compound B Containing [tetrahydro-2H-pyran-2-yl)oxy]methyl Group Chemical Reaction 8

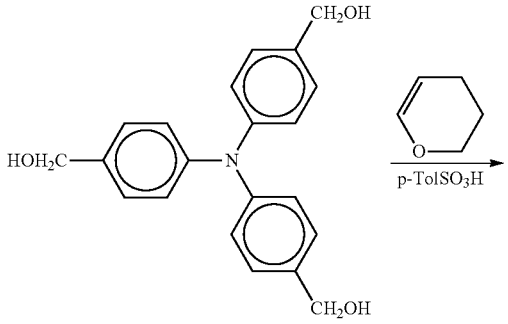

-continued

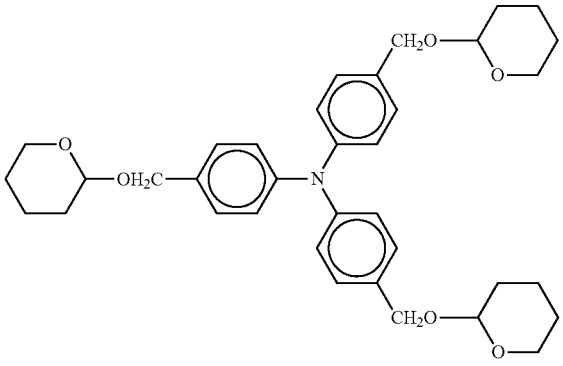

Place 3.4 g of an intermediate methylol compound, 4.65 g of 3,4-dihydro-2H-pyran, and 100 ml of tetrahydrofuran in a flask.

Stir the mixture at 5° C. and place 58 mg of paratoluene sulfonate in the flask. Continue stirring for five hours at room temperature.

Conduct extraction with ethyl acetate and dehydrate magnesium sulfate followed by absorption treatment by activated white earth and silica gel. Subsequent to filtration, washing, and condensation, a yellow oily material is obtained.

Conduct silica gel column refinement (toluene/ethyl acetate=10/1) to separate and obtain a target product (yield: 2.7 g, colorless oily material).

Figure 11:
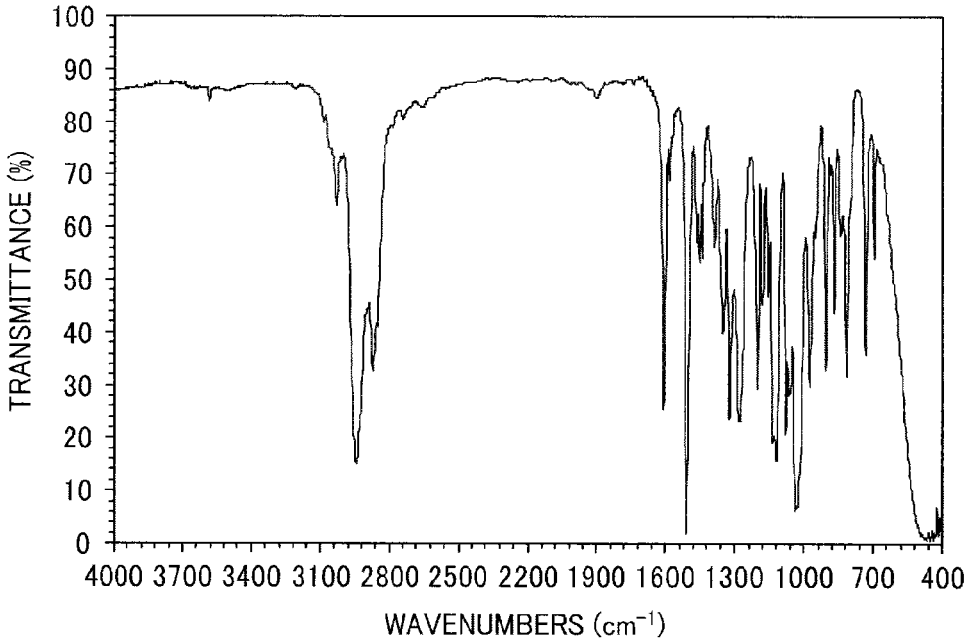
FIG. 11 is a graph illustrating an infrared absorption spectrum (KBr tablet method) of a compound obtained in Synthesis Example 3 described later with an X axis of wavenumber ($cm^{-1}$) and a Y axis of transparency (%)

FIG. 11 is a graph illustrating an infrared absorption spectrum (KBr tablet method) of the compound obtained in Synthesis Example 3.

Synthesis Example 4

Synthesis of No. B26 of Charge Transport Compound B Containing [tetrahydro-2H-pyran-2-yl)oxy]methyl Group Chemical Reaction 9

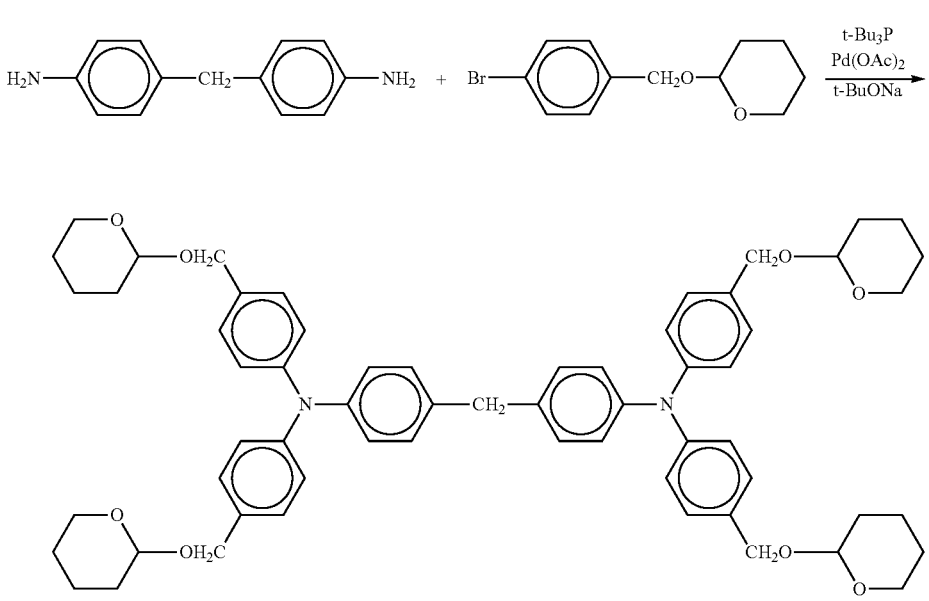

Place 2.99 g of 4,4'-diaminodiphenyl methane, 17.896 g of the compound of Synthesis Example 1, 0.336 g of paradium acetate, 13.83 g of tertial buthoxysodium, and 100 ml of o-xylene in a flask. Stir the mixture in an argon gas atmosphere at room temperature.

Drip 1.214 g of tritertial butyl phosphine to the flask. Stir the mixture for one hour at 80° C. and continue stirring by reflux for one hour. Dilute the mixture with toluene and place magnesium sulfate, activated white earth, and silica gel followed by stirring. Subsequent to filtration, washing, and condensation, a yellow oily material is obtained. Conduct silica gel column refinement (toluene/ethyl acetate=20/1) to separate and obtain a target product (yield: 5.7 g, light yellow amorphous material).

Figure 12:
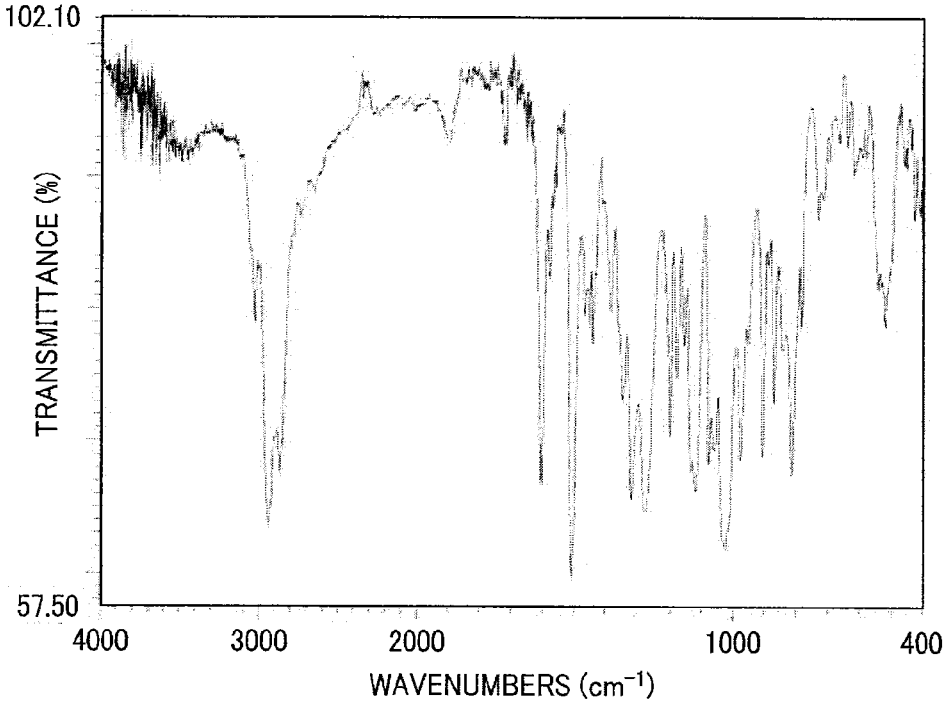
FIG. 12 is a graph illustrating an infrared absorption spectrum (KBr tablet method) of a compound obtained in Synthesis Example 4 described later with an X axis of wavenumber ($cm^{-1}$) and a Y axis of transparency (%)

FIG. 12 is a graph illustrating an infrared absorption spectrum (KBr tablet method) of the compound obtained in Synthesis Example 4.

Synthesis Example 5

Synthesis of No. B33 of Charge Transport Compound B Containing [tetrahydro-2H-pyran-2-yl)oxy]methyl Group Chemical Reaction 10

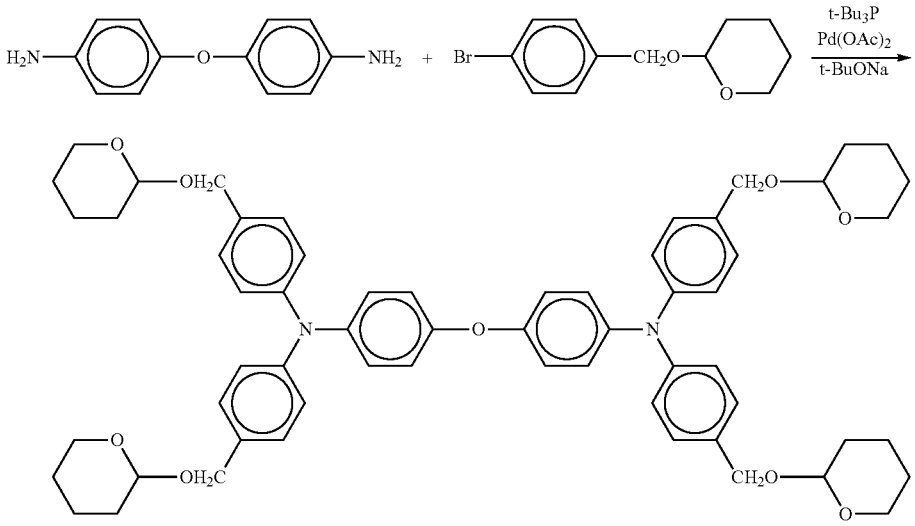

Place 3.0 g of 4,4'-diaminodiphenyl ether, 17.896 g of the compound of Synthesis Example 1, 0.336 g of paradium acetate, 13.83 g of tertial buthoxysodium, and 100 ml of o-xylene in a flask. Stir the mixture in an argon gas atmosphere at room temperature.

Drip 1.214 g of tritertial butyl phosphine to the flask. Stir the mixture for one hour at 80° C. and continue stirring by reflux for one hour. Dilute the mixture with toluene and place magnesium sulfate, activated white earth, and silica gel followed by stirring. Subsequent to filtration, washing, and condensation, a yellow oily material is obtained. Conduct silica gel column refinement (toluene/ethyl acetate=10/1) to separate and obtain a target product (yield: 5.7 g, light yellow oily material).

Figure 13:
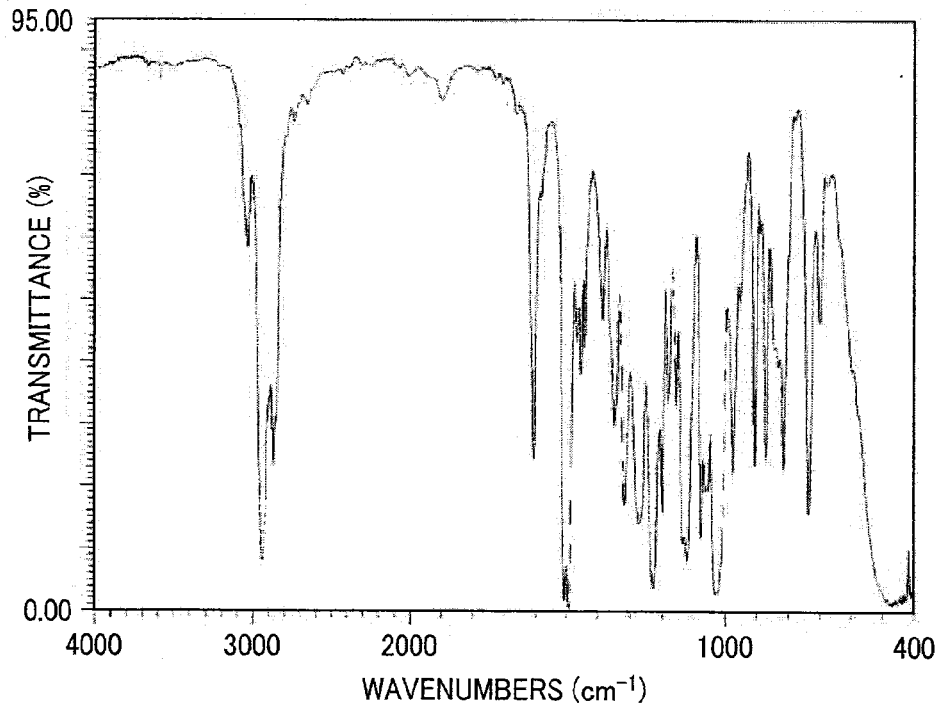
FIG. 13 is a graph illustrating an infrared absorption spectrum (KBr tablet method) of a compound obtained in Synthesis Example 5 described later with an X axis of wavenumber ($cm^{-1}$) and a Y axis of transparency (%)

FIG. 13 is a graph illustrating an infrared absorption spectrum (KBr tablet method) of the compound obtained in Synthesis Example 5.

Synthesis Example 6

Synthesis of No. B37 of Charge Transport Compound B Containing [tetrahydro-2H-pyran-2-yl)oxy]methyl Group Chemical Reaction 11

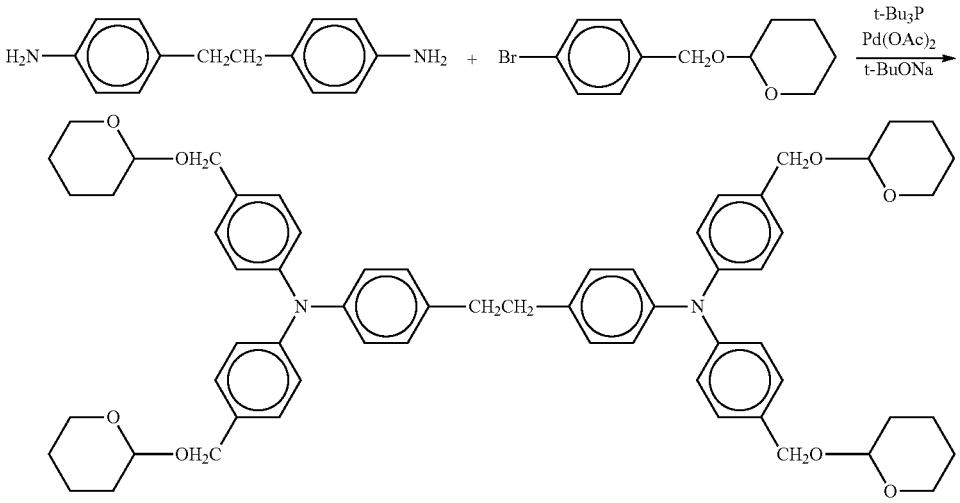

Place 3.18 g of 4,4'-ethylene dianiline, 17.896 g of the compound of Synthesis Example 1, 0.336 g of paradium acetate, 13.83 g of tertial buthoxysodium, and 100 ml of o-xylene in a flask. Stir the mixture in an argon gas atmosphere at room temperature. Drip 1.214 g of tritertial butyl phosphine to the flask. Stir the mixture for one hour at 80° C. and continue stirring by reflux for one hour. Dilute the mixture with toluene and place magnesium sulfate, activated white earth, and silica gel followed by stirring.

Subsequent to filtration, washing, and condensation, a yellow oily material is obtained. Conduct silica gel column refinement (toluene/ethyl acetate=20/1) to separate and obtain a target product (yield: 5.7 g, light yellow oily material).

Figure 14:
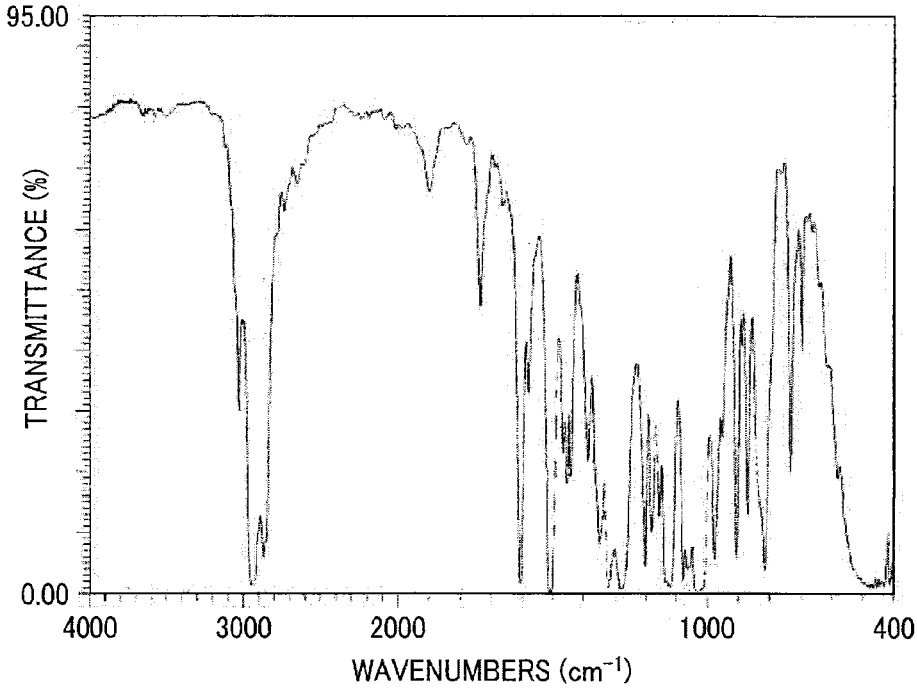
FIG. 14 is a graph illustrating an infrared absorption spectrum (KBr tablet method) of a compound obtained in Synthesis Example 6 described later with an X axis of wavenumber ($cm^{-1}$) and a Y axis of transparency (%)

FIG. 14 is a graph illustrating an infrared absorption spectrum (KBr tablet method) of the compound obtained in Synthesis Example 6.

Synthesis Example 7

Synthesis of No. B41 of Charge Transport Compound B Containing [tetrahydro-2H-pyran-2-yl)oxy]methyl Group Chemical Reaction 12

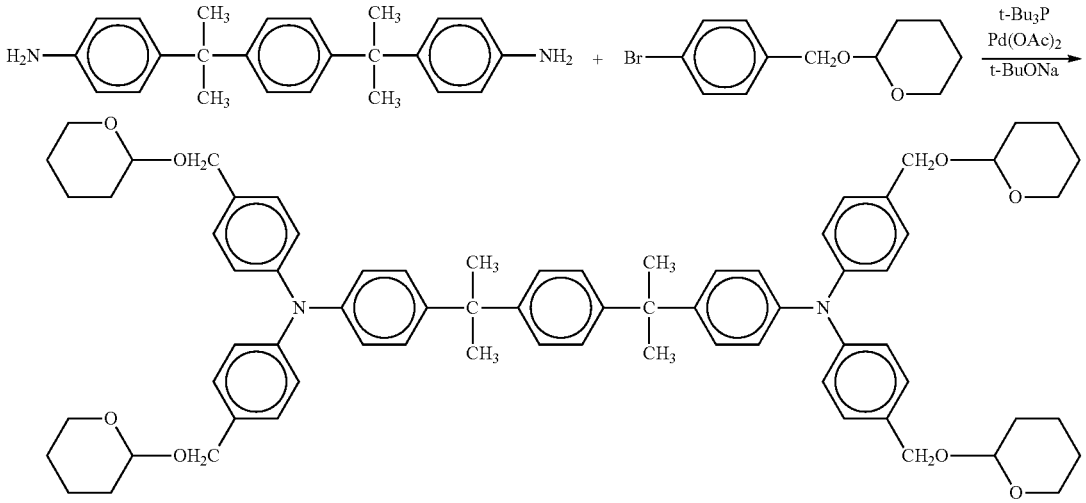

Place 10.335 g of α,α'-bis(4-aminophenyl)-1,4-diisopropyl benzene, 39.05 g of the compound of Synthesis Example 1, 0.673 g of paradium acetate, 27.677 g of tertial buthoxysodium, and 200 ml of o-xylene in a flask. Stir the mixture in an argon gas atmosphere at room temperature. Drip 2.43 g of tritertial butyl phosphine to the flask. Stir the mixture for one hour at 80° C. and continue stirring by reflux for two hours. Dilute the mixture with toluene and place magnesium sulfate, activated white earth, and silica gel followed by stirring. Subsequent to filtration, washing, and condensation, a yellow oily material is obtained. Conduct silica gel column refinement (toluene/ethyl acetate=10/1) to separate and obtain a target product (yield: 23.5 g, light yellow amorphous material).

Figure 15:
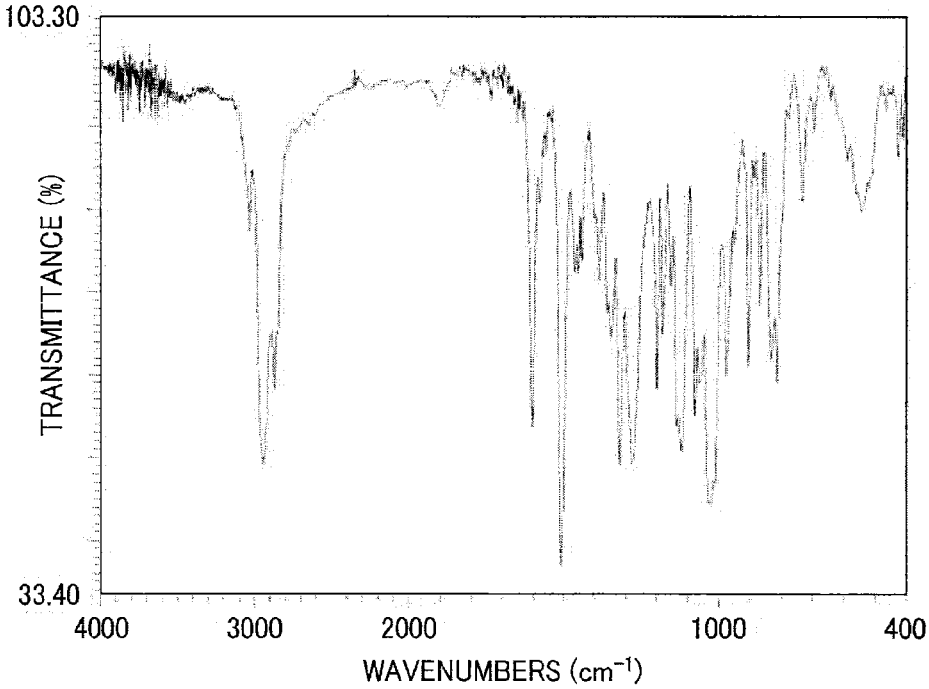
FIG. 15 is a graph illustrating an infrared absorption spectrum (KBr tablet method) of a compound obtained in Synthesis Example 7 described later with an X axis of wavenumber ($cm^{-1}$) and a Y axis of transparency (%)

FIG. 15 is a graph illustrating an infrared absorption spectrum (KBr tablet method) of the compound obtained in Synthesis Example 7.

Synthesis Example 8

Synthesis of No. B44 of Charge Transport Compound B Containing [tetrahydro-2H-pyran-2-yl)oxy]methyl Group Chemical Reaction 13

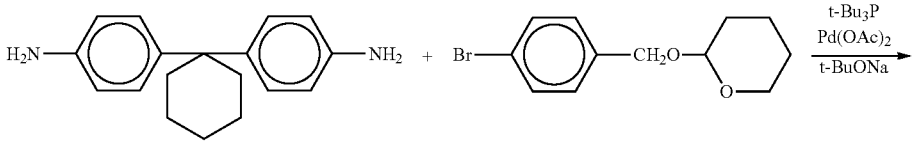

-continued

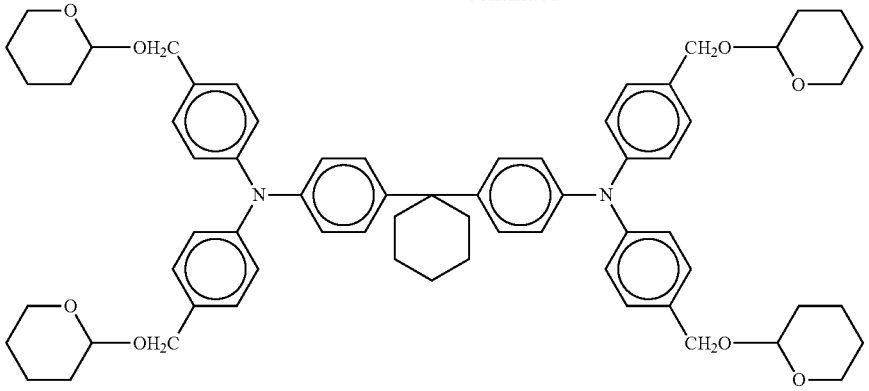

Place 9.32 g of 1,1-bis(4-aminophenyl)cyclohexene, 45.55 g of the compound of Synthesis Example 1, 0.785 g of paradium acetate, 32.289 g of tertial buthoxysodium, and 300 ml of o-xylene in a flask. Stir the mixture in an argon gas atmosphere at room temperature. Drip 2.43 g of tritertial butyl phosphine to the flask. Stir the mixture for one hour at 80° C. and continue stirring by reflux for two hours. Dilute the mixture with toluene and place magnesium sulfate, activated white earth, and silica gel followed by stirring. Subsequent to filtration, washing, and condensation, a yellow oily material is obtained. Conduct silica gel column refinement (toluene/ethyl acetate=10/1) to separate and obtain a target product (yield: 11.42 g, yellow amorphous material)

Figure 16:
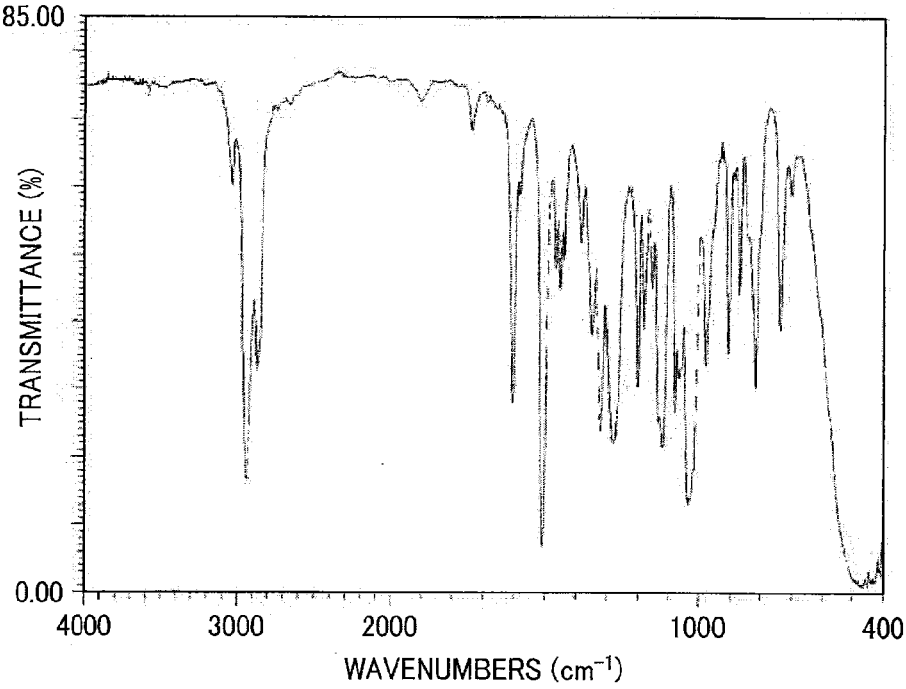
FIG. 16 is a graph illustrating an infrared absorption spectrum (KBr tablet method) of a compound obtained in Synthesis Example 8 described later with an X axis of wavenumber ($cm^{-1}$) and a Y axis of transparency (%)

FIG. 16 is a graph illustrating an infrared absorption spectrum (KBr tablet method) of the compound obtained in Synthesis Example 8.

Synthesis Example 9

Synthesis of No. B52 of Charge Transport Compound B Containing [tetrahydro-2H-pyran-2-yl)oxy]methyl Group Chemical Reaction 14

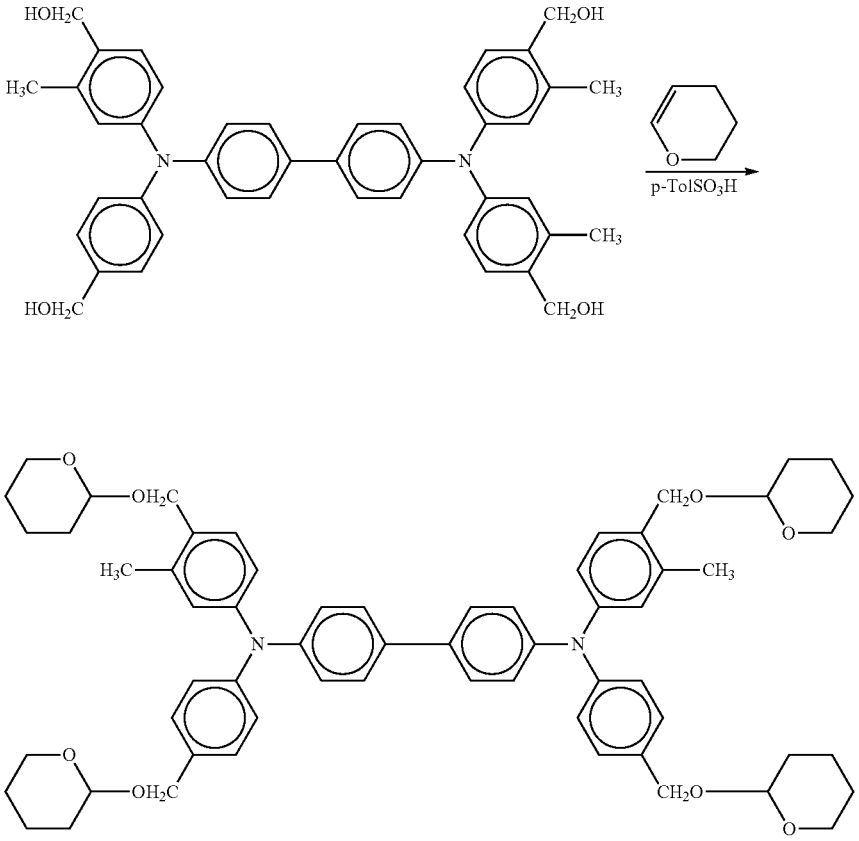

Place 1.274 g of an intermediate methylol compound, 1.346 g of 3,4-dihydro-2H-pyran, and 20 ml of tetrahydrofuran in a flask. Stir the mixture at 5° C. and place 14 mg of paratoluene sulfonate in the flask. Continue stirring for four hours at room temperature. Conduct extraction with ethyl acetate and dehydrate magnesium sulfate followed by absorption treatment by activated white earth and silica gel. Subsequent to filtration, washing, and condensation, a yellow oily material is obtained. Conduct silica gel column refinement (toluene/ethyl acetate=20/1) to separate and obtain a target product (yield: 1.48 g, light yellow oily material).

Figure 17:
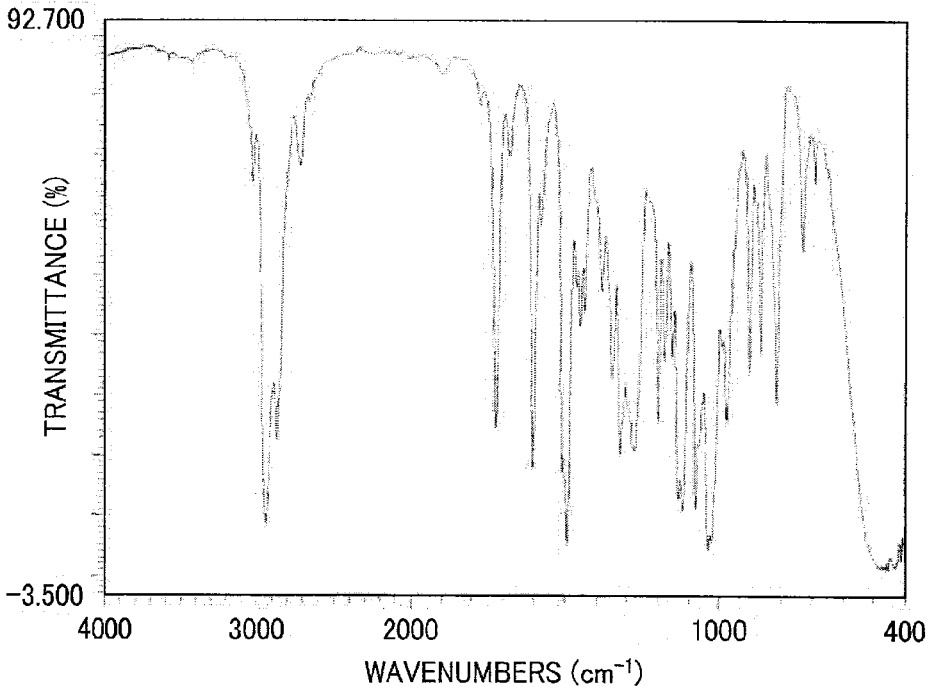
FIG. 17 is a graph illustrating an infrared absorption spectrum (KBr tablet method) of a compound obtained in Synthesis Example 9 described later with an X axis of wavenumber ($cm^{-1}$) and a Y axis of transparency (%)

FIG. 17 is a graph illustrating an infrared absorption spectrum (KBr tablet method) of the compound obtained in Synthesis Example 9.

Synthesis Example 10

Synthesis of No. B58 of Charge Transport Compound B Containing [tetrahydro-2H-pyran-2-yl)oxy]methyl Group Chemical Reaction 15

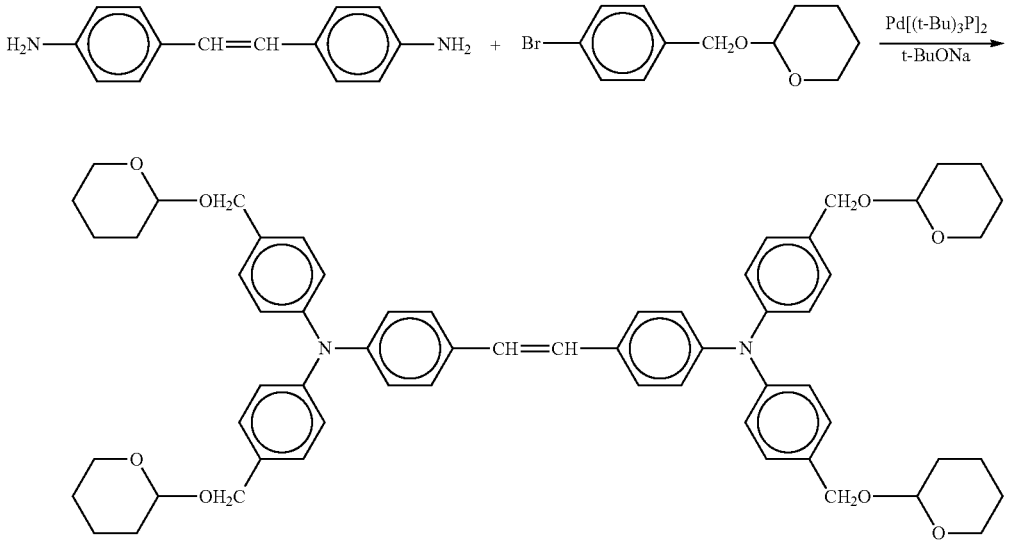

Place 1.42 g of 4,4'-diamino stilbene.dihydrochloride, 6.51 g of the compound of Synthesis Example 1, 9.61 g of tertial buthoxysodium, 52 mg of bis(tri-t-buthoxyphosphine) paradium, and 50 ml of o-xylene in a flask. Stir the mixture in an argon gas atmosphere at room temperature. Continue stirring for one hour by reflux. Dilute the mixture with toluene and place magnesium sulfate, activated white earth, and silica gel followed by stirring. Subsequent to filtration, washing, and condensation, a yellow oily material is obtained. Conduct silica gel column refinement (toluene/ethyl acetate=10/1) to separate and obtain a target product (yield: 1.6 g, light yellow amorphous material).

Figure 18:
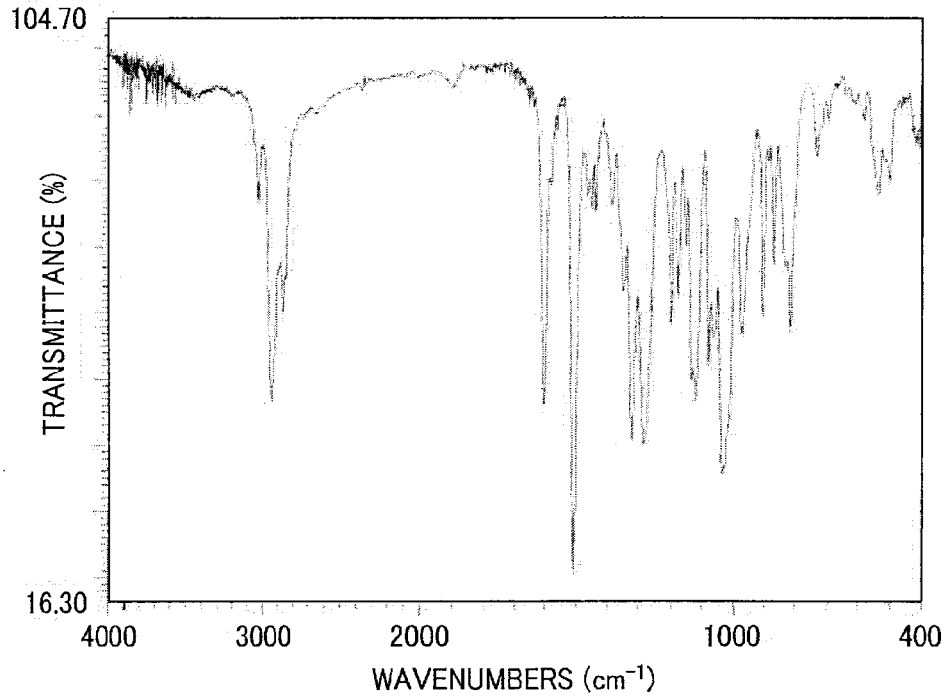
FIG. 18 is a graph illustrating an infrared absorption spectrum (KBr tablet method) of a compound obtained in Synthesis Example 10 described later with an X axis of wavenumber ($cm^{-1}$) and a Y axis of transparency (%)

FIG. 18 is a graph illustrating an infrared absorption spectrum (KBr tablet method) of the compound obtained in Synthesis Example 10.

Synthesis Example 11

Synthesis of No. B61 of Charge Transport Compound B Containing [tetrahydro-2H-pyran-2-yl)oxy]methyl Group Chemical Reaction 16

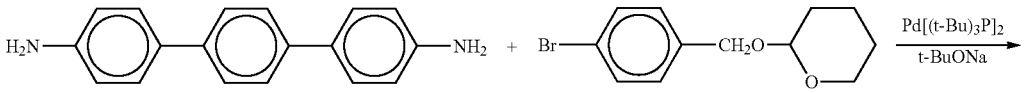

-continued

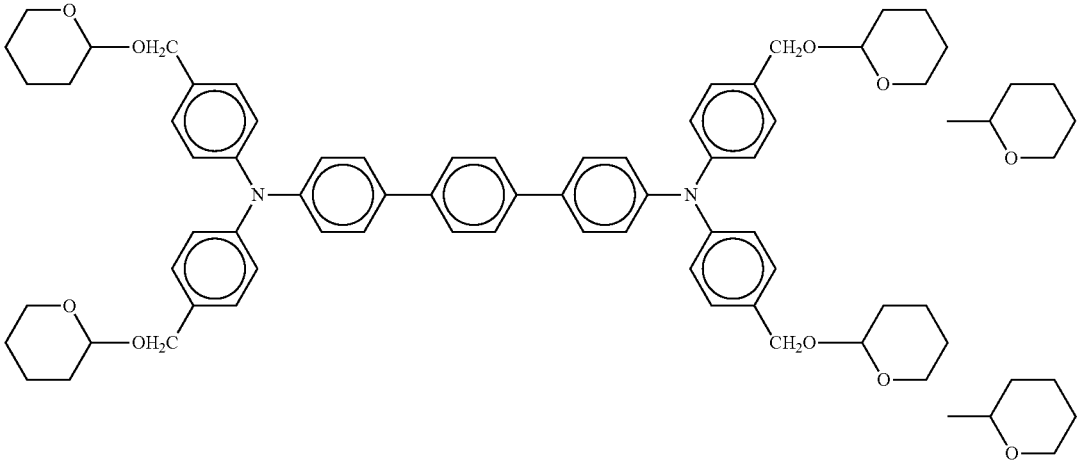

Place 1.30 g of 4,4'-diamino-p-terphenyl, 6.508 g of the compound of Synthesis Example 1, 3.844 g of tertial buthoxysodium, 52 mg of bis(tri-t-buthoxyphosphine) paradium, and 50 ml of o-xylene in a flask. Stir the mixture in an argon gas atmosphere at room temperature. Continue stirring for one hour by reflux. Dilute the mixture with toluene and place magnesium sulfate, activated white earth, and silica gel followed by stirring. Subsequent to filtration, washing, and condensation, a yellow oily material is obtained. Conduct silica gel column refinement (toluene/ethyl acetate=20/1) to separate and obtain a target product (yield: 1.95 g, light yellow amorphous material).

Figure 19:
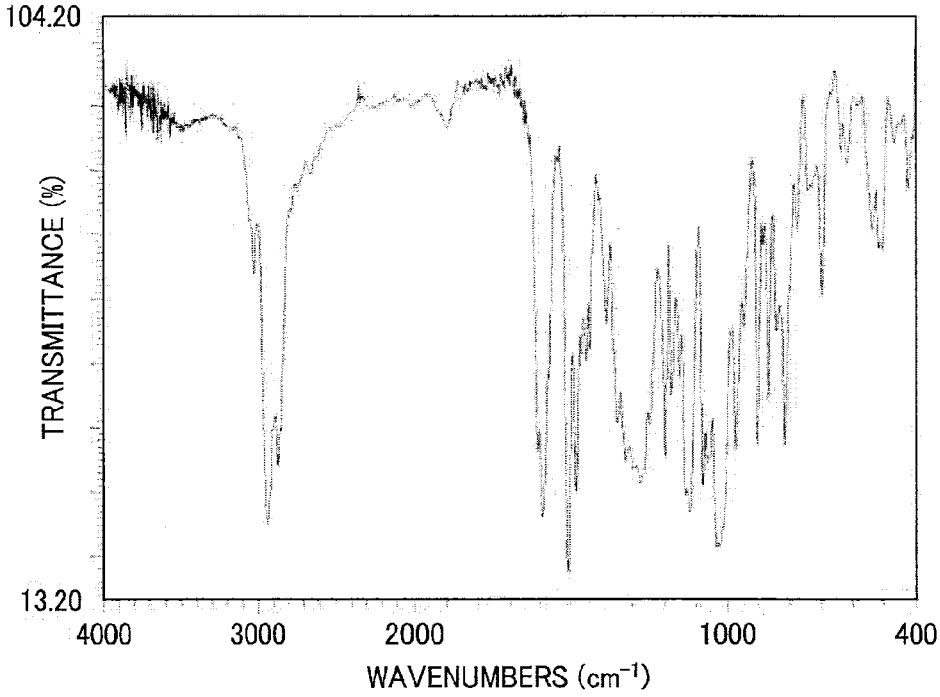
FIG. 19 is a graph illustrating an infrared absorption spectrum (KBr tablet method) of a compound obtained in Synthesis Example 11 described later with an X axis of wavenumber ($cm^{-1}$) and a Y axis of transparency (%)

FIG. 19 is a graph illustrating an infrared absorption spectrum (KBr tablet method) of the compound obtained in Synthesis Example 11.

Synthesis Example 12

Synthesis of No. B64 of Charge Transport Compound B Containing [tetrahydro-2H-pyran-2-yl)oxy]methyl Group Chemical Reaction 17

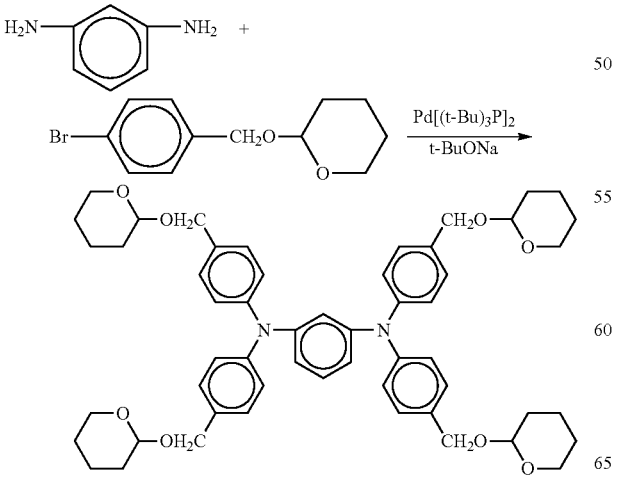

Place 0.541 g of 1,3-phenylene diamine, 6.508 g of the compound of Synthesis Example 1, 3.844 g of tertial buthoxysodium, 52 mg of bis(tri-t-buthoxyphosphine) paradium, and 20 ml of o-xylene in a flask. Stir the mixture in an argon gas atmosphere at room temperature. Continue stirring for one hour by reflux. Dilute the mixture with toluene and place magnesium sulfate, activated white earth, and silica gel followed by stirring. Subsequent to filtration, washing, and condensation, a yellow oily material is obtained. Conduct silica gel column refinement (toluene/ethyl acetate=10/1) to separate and obtain a target product (yield: 3.02 g, light yellow amorphous material).

Figure 20:
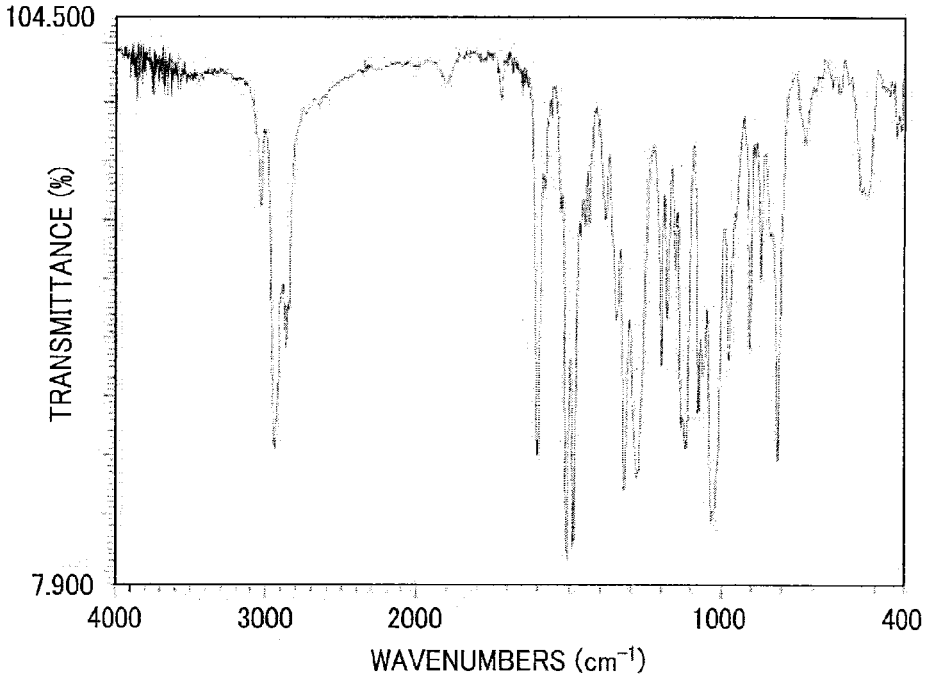
FIG. 20 is a graph illustrating an infrared absorption spectrum (KBr tablet method) of a compound obtained in Synthesis Example 12 described later with an X axis of wavenumber ($cm^{-1}$) and a Y axis of transparency (%)

FIG. 20 is a graph illustrating an infrared absorption spectrum (KBr tablet method) of the compound obtained in Synthesis Example 12.

Synthesis Example 13

Synthesis of No. B65 of Charge Transport Compound B Containing [tetrahydro-2H-pyran-2-yl)oxy]methyl Group Chemical Reaction 18

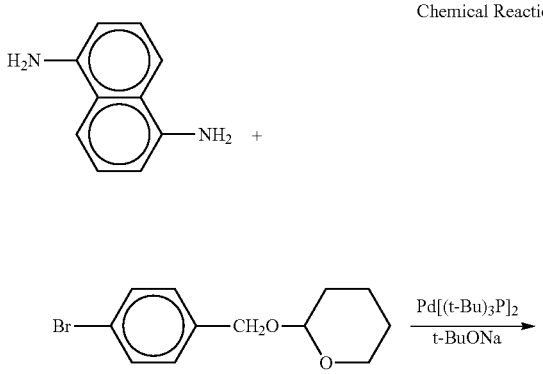

-continued

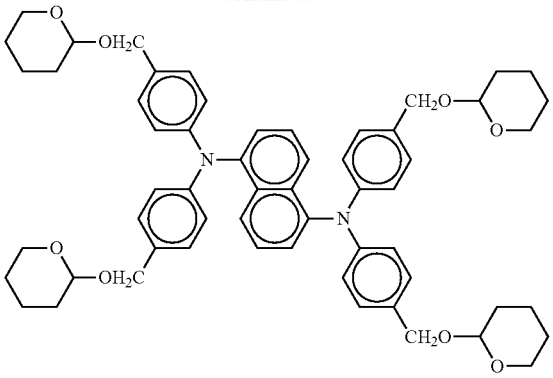

Place 0.791 g of 1,5-diamino naphthalene, 6.508 g of the compound of Synthesis Example 1, 3.844 g of tertial buthoxysodium, 52 mg of bis(tri-t-buthoxyphosphine) paradium, and 20 ml of o-xylene in a flask. Stir the mixture in an argon gas atmosphere at room temperature. Continue stirring for one hour by reflux. Dilute the mixture with toluene and place magnesium sulfate, activated white earth, and silica gel followed by stirring. Subsequent to filtration, washing, and condensation, a yellow oily material is obtained. Conduct silica gel column refinement (toluene/ethyl acetate=9/1) to separate and obtain a target product (yield: 2.56 g, light yellow amorphous material).

Figure 21:
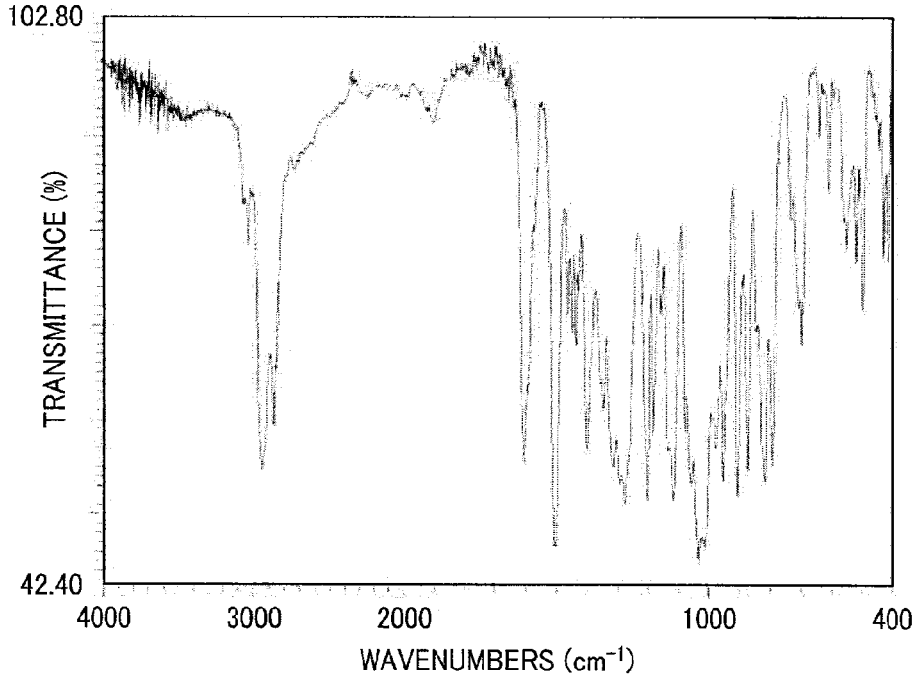
FIG. 21 is a graph illustrating an infrared absorption spectrum (KBr tablet method) of a compound obtained in Synthesis Example 13 described later with an X axis of wavenumber ($cm^{-1}$) and a Y axis of transparency (%)

FIG. 21 is a graph illustrating an infrared absorption spectrum (KBr tablet method) of the compound obtained in Synthesis Example 13.

As described above, various kinds of the compounds B having three or more [tetrahydro-2H-pyran-2-yl)oxy]methyl groups can be synthesized by a combination or selection of the method of directly formylizing the charge transport compound and the coupling reaction of the halogenated aromatic intermediate formed by adding [tetrahydro-2H-pyran-2-yl) oxy]methylation and the amine compound.

Next, the polymerization reaction is described.

The charge transport compound (compound B) having three or more [tetrahydro-2H-pyran-2-yl)oxy]methyl groups linked with the aromatic rings for use in the present disclosure forms a gigantic molecule having a three dimensional network structure by polymerization reaction between the following compounds in which part of [tetrahydro-2H-pyran-2-yl)oxy]methyl groups is severed and detached by adding an acid to a curing catalyst followed by heating.

One is the polymerization reaction between the compounds B having three or more [tetrahydro-2H-pyran-2-yl) oxy]methyl groups. The other one is the polymerization reaction between the compound B having three or more [tetrahydro-2H-pyran-2-yl)oxy]methyl groups and the charge transport compound (i.e., the compound A) represented by the Chemical Structure 1.

As a result of the study by the present inventors, among the triaryl amine compounds, a phenyl group having no substitution group that links with a nitrogen atom is found to serve as a good polymerizable functional group in the reaction in which part of [tetrahydro-2H-pyran-2-yl)oxy]methyl groups is severed and detached. The phenyl group having a substitution group and other aromatic hydrocarbon groups do not serve as polymerizable functional groups. Some of [tetrahydro-2H-pyran-2-yl)oxy]methyl groups do not react but still remain as they are.

Although the reaction in which part of [tetrahydro-2H-pyran-2-yl)oxy]methyl groups is severed and detached is not completely clear, the reaction is not a single reaction but is a linking reaction in which multiple reactions competitively proceeds as described below.

The reaction patterns are described below.

Reaction Pattern 1

Chemical Reaction 19

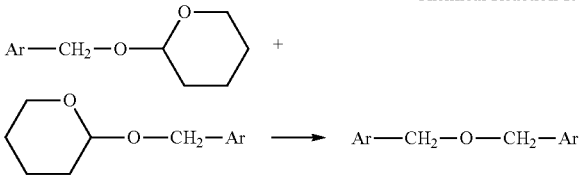

A symbol "Ar" represents any aromatic ring of the charge transport compound having a [tetrahydro-2H-pyran-2-yl) oxy]methyl group for use in the present disclosure.

In this reaction, the portion of tetrahydro-2H-pyran-2-yl group of one of the [tetrahydro-2H-pyran-2-yl)oxy]methyl groups is severed and detached and the portion of (tetrahydro-2H-pyran-2-yl)oxy group of the other [tetrahydro-2H-pyran-2-yl)oxy]methyl group is severed and detached to form a dimethylene ether bonding.

Reaction Pattern 2

Chemical Reaction 20

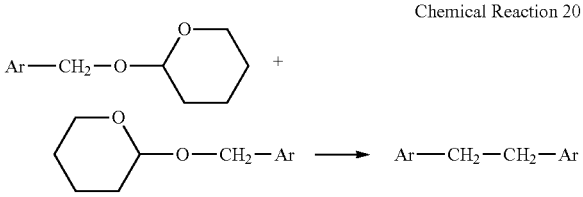

A symbol "Ar" represents any aromatic ring of the charge transport compound having a [tetrahydro-2H-pyran-2-yl) oxy]methyl group for use in the present disclosure.

In this reaction, the portions of (tetrahydro-2H-pyran-2-yl) oxy group of both [tetrahydro-2H-pyran-2-yl)oxy]methyl groups are severed and detached to form an ethylene bonding.

Reaction Pattern 3

Chemical Reaction 21

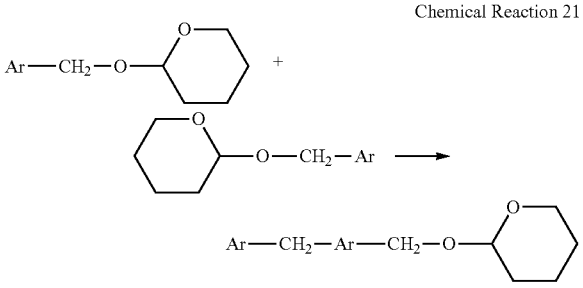

A symbol "Ar" represents any aromatic ring of the charge transport compound having a [tetrahydro-2H-pyran-2-yl) oxy]methyl group for use in the present disclosure.

In this reaction, the portion of (tetrahydro-2H-pyran-2-yl) oxy group of one of the [tetrahydro-2H-pyran-2-yl)oxy]methyl groups is severed, detached, and linked with the other aromatic ring to form a methylene bonding.

Reaction Pattern 4

Chemical Reaction 22

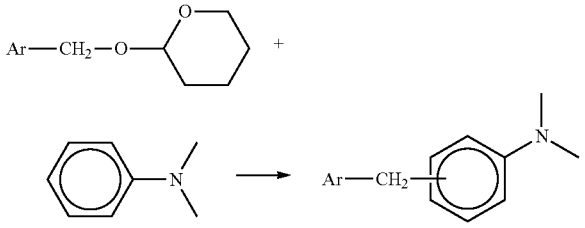

A symbol "Ar" represents any aromatic ring of the charge transport compound having a [tetrahydro-2H-pyran-2-yl)oxy]methyl group for use in the present disclosure.

In this reaction, the portion of (tetrahydro-2H-pyran-2-yl)oxy group of one of the [tetrahydro-2H-pyran-2-yl)oxy]methyl groups is severed, detached, and linked with the phenyl group which has no substitution group and is linked with the nitrogen atom in the compound represented by the Chemical Structure 1 to form a methylene group.

In the present disclosure, if the compound A is present in addition to the compound B, the molecule becomes gigantic while forming a three dimensional network structure by polymerization through complicated combinations of these reaction patterns.

In these reaction patterns, part of (tetrahydro-2H-pyran-2-yl)oxy group of the compound B is severed and detached with a mass decrease. Therefore, this mass decrease is observed by heating these compositions with an acid catalyst by using a thermogravimetric-differential thermal analysis (TG-DTA) heat analyzer.

In addition, by analyzing the gas component produced during the heating reaction by a gas chromatograph mass spectrometer (GC-MS), detached products such as 3,4-dihydro-2H-pyran and 5-hydroxypentanal that indicate that part of (tetrahydro-2H-pyran-2-yl)oxy group is severed are detected.

The method of forming, for example, a cross-linked layer containing a three-dimensional cross-linked product is described next.

The three-dimensional cross-linked layer is formed by adjusting a liquid application containing the charge transport compound (compound B) having three or more [tetrahydro-2H-pyran-2-yl)oxy]methyl groups linked with aromatic rings and the charge transport compound (compound A) represented by the Chemical Structure 1 by dilution and applying the liquid application to the surface of a photoreceptor followed by heating and drying for polymerization. It is possible to form such a three-dimensional cross-linked layer by mixing two or more kinds of the charge transport compounds (compounds B) having three or more [tetrahydro-2H-pyran-2-yl)oxy]methyl groups linked with aromatic rings. Similarly, it is also possible to form such a three-dimensional cross-linked layer by mixing two or more kinds of the charge transport compounds (compounds A) represented by the Chemical Structure 1.

The mixing ratio of the charge transport compound represented by the Chemical Structure 1 can be arbitrarily determined. However, if the mixing ratio is too high, the cross-linking reaction portions tend to decrease, thereby causing deterioration of the mechanical characteristics of the layer and crystallization, which arises problems of clouding of the surface of the photoreceptor. In addition, to the contrary, when the ratio is too low, the photoreceptor tends not to be stable for environment conditions and gases. Typically, the three-dimensional cross-linked layer is formed such that the mixing ratio ranges from 5% by weight to 60% by weight. It is preferable to mix them in a mixing ratio of from 20% by weight to 50% by weight to improve the stability.

The heating temperature is preferably from 80° C. to 180° C. and more preferably from 100° C. to 160° C. Since the reaction speed changes depending on the kinds and the amount of catalysts, the kinds and the amount can be selected depending on the prescription conditions. Typically, the three-dimensional cross-linked layer is formed by heating and drying at 125° C. to 150° C. for 20 minutes to 30 minutes. The reaction speed is in proportion to the heating temperature.

However, when the cross-linking density becomes too high, the charge transport property tends to deteriorate, which arises problems such as a rise in the voltage at irradiated portions of the photoreceptor and deterioration of the sensitivity thereof.

In addition, the heating tend to affect other layer forming components of the photoreceptor significantly, thereby degrading the characteristics of the photoreceptor.

When the heating temperature is too low, the reaction speed tends to be slow accordingly, which arises a problem that a sufficient cross-linking density is not obtained regardless of the reaction time.

As the curing catalyst, an acid compound is preferable and an organic sulphonic acid and derivatives thereof are more preferable.

Specific examples thereof include, but are not limited to, vinyl sulphonic acid, paratoluene sulphonic acid, naphthalene sulphonic acid, and dodecyl benzene sulphonic acid. In addition, organic sulphonic acid salts are also included therein. Moreover, another example is a so-called heat latent compound that demonstrates acidity at a predetermined temperature or higher.

Specific examples thereof include, but are not limited to, heat latent protonic acid catalysts which are blocked by an amine such as NACURE 2500, NACURE 5225, NACURE 5543, and NACURE 5925 (manufactured by King Industries Inc.), SI-60 (manufactured by SANSHIN Co., Ltd.), and Adekaoptomer CP-66 and CP-77 (manufactured by Adeka Corporation).

These catalysts are added to the liquid application in a solid portion concentration of from about 0.02% by weight to about 5% by weight. When an acid such as paratoluene sulphonic acid is solely used, about 0.02% by weight to about 0.4% by weight is sufficient. When such an acid is excessively used, the acidity of the liquid application tends to increase, which may cause corrosion of the application facility, etc. In the case of the heat latent compound, no corrosion problem occurs during application. Therefore, it is possible to increase the addition amount thereof. However, the amine compound as the blocking agent remaining in the liquid application has an adverse impact on the photoreceptor characteristics such as the residual voltage. Therefore, it is not preferable to add the heat latent compound excessively.

Since the content of the acid is less than in the case in which an acid is solely used, a suitable range of the addition amount of the catalyst is from 0.2% by weight to 2% by weight.

Specific examples of such solvents include, but are not limited to, alcohols such as methanol, ethanol, propanol and butanol; ketones such as acetone, methyl ethyl ketone, methyl isobutyl ketone, and cycle hexanone; esters such as ethyl acetate and butyl acetate; ethers such as tetrahydrofuran, methyltetrahydrofuran, dioxane, propyl ether, diethylene glycol dimethyl ether, propylene glycol 1-monomethyl ether 2-acetate; halogen based solvents such as dichloromethane, dichloroethane, trichloroethane, and chlorobenzene; aromatic series based solvents such as benzene, toluene, and xylene; and cellosolve based solvents such as methyl cellosolve, ethyl cellosove, and cellosolve acetate. These solvents can be used alone or in combination.

The dilution ratio by using such a solvent is arbitrary and varies depending on the solubility of the composition, the coating method, and the target layer thickness. The liquid application can be conducted by using a dip coating method, a spray coating method, a bead coating method, a ring coating method, etc.

Furthermore, the liquid application can optionally contain an additive such as a leveling agent and an anti-oxidizing agent. Specific examples of the leveling agent include, but are not limited to, silicone oils, for example, dimethyl silicone oil and methyl phenyl silicone oil, and polymers or oligomers having perfluoroalkyl groups in its side chain. The addition amount of the leveling agent is preferably 1% by weight or less based on the total amount of the solid portion.

In addition, using an anti-oxidizing agent is suitable. Specific examples of the anti-oxidizing agents include, but are not limited to, known materials such as phenol based compounds, paraphenylene diamines, hydroquinones, organic sulfur compounds, organic phosphorous compounds, and hindered amines. These are suitable to stabilize the electrostatic characteristics over repetitive use.

The addition amount is preferably 1% by weight or less based on the total amount of the solid portion.

Furthermore, fillers can be added to the liquid application to further improve the abrasion resistance of the photoreceptor. Filler materials are classified into organic fillers and inorganic fillers.

Specific examples of the organic fillers include, but are not limited to, powders of fluorine-containing resins such as polytetrafluoroethylene, silicone resin powders, and a-carbon powders. Specific examples of the inorganic fillers include, but are not limited to, powders of metals such as copper, tin, aluminum, and indium, metal oxides such as silica, tin oxide, zinc oxide, titanium oxide, alumina, zirconium oxide, indium oxide, antimony oxide, bismuth oxide, calcium oxide, tin oxide doped with antimony, indium oxide doped with tin, fluorinated metals such as fluorinated tin, fluorinated calcium, and fluorinated aluminum, potassium titanate, and arsenic nitride.

Among these fillers, using inorganic materials is advantageous in terms of the hardness to improve the abrasion resistance. In addition, among these fillers, a type alumina is particularly preferable among these filers because it has a hexagonal close-packed structure, which has a high abrasion resistance in addition to its excellent insulation property and excellent thermal stability.

Furthermore, these filler particulates can be subject to surface treatment with at least one surface treatment agent, which is preferable in terms of the dispersion property of the fillers. When the filler is poorly dispersed in the liquid application, the following problems may occur: (1) the residual potential of the photoreceptor rises; (2) the transparency of a resultant coated layer decreases; (3) coating defects occur in the resultant coated layer; and, (4) the abrasion resistance of the resultant coated layer deteriorates.

These possibly develop into greater problems with regard to the durability of the photoreceptor and the quality of the images produced thereby. Suitable surface treatment agents include known surface treatment agents. Among these, surface treatment agents which do not degrade the insulation property of the filler are preferable.

Specific examples thereof include, but are not limited to, titanate based coupling agents, aluminum based coupling agents, zircoaluminate based coupling agents, higher aliphatic acids and mixtures of these and silane coupling agents.

Also, for example, $Al_3O_3$, $TiO_2$, $ZrO_2$, silicon, aluminum stearate, and mixtures thereof are suitable. These are preferable in terms of dispersability of the filler and prevention of image blurring. Treatment on the filler particulates by the silane coupling agent has an adverse impact with regard to production of blurred images. However, a combinational use of the surface treatment agent specified above and a silane coupling agent may lessen this adverse impact.

The content of the surface treatment agent depends on the average primary particle diameter of the filler, but is preferably from 3% by weight to 30% by weight and more preferably from 5% by weight to 20% by weight.

A content of the surface treatment agent that is too small tends not to improve the dispersion property of the filler. In contrast, a content of the surface treatment agent that is too large tends to significantly increase the residual potential of the photoreceptor.

In addition, the average primary particle diameter of the filler particulates is preferably from 0.01 μm to 0.5 μm in terms of optical transmittance and abrasion resistance.

Filler particulates that have an excessively small average primary particle diameter tend to degrade abrasion resistance and dispersion property. Filler particulates that have an excessively large average primary particle diameter tend to accelerate sedimentation of the filler in the liquid dispersion or cause filming of toner. In addition, the addition amount of the filler is preferably from 5% by weight to 50% by weight and more preferably from 10% by weight to 40% by weight.

When the content is too small, the abrasion resistance tends to be unsatisfactory. When the content is too large, the transparency tends to deteriorate.

The structure of the photoreceptor of the present disclosure is described in detail with reference to the FIGS. 1 to 5. FIGS. 1 to 5 are cross sections illustrating a photoreceptor.

FIG. 1 is a most basic structure of a laminate photoreceptor in which a charge generating layer 2 and a charge transport layer 3 are laminated sequentially on an electroconductive substrate 1.

When the photoreceptor is negatively charged, hole transport charge transport materials are used in the charge transport layer. When the photoreceptor is positively charged, electron transportive charge transport materials are used in the charge transport layer.

In this case, the uppermost surface layer is the charge transport layer 3. Therefore, the three-dimensional cross-linked layer formed by the polymerization reaction of the compound (compound B) having three or more [tetrahydro-2H-pyran-2-yl)oxy]methyl groups linked with the aromatic rings and the charge transport compound (compound A) represented by the Chemical Structure 1 is applied to this charge transport layer.

Figure 2:
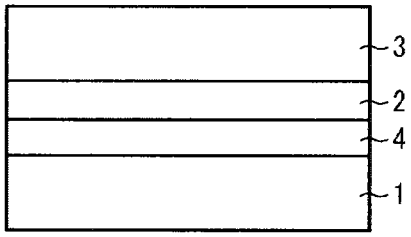
FIG. 2 is a schematic diagram illustrating another example of a layer structure of a photoreceptor of the present disclosure.

FIG. 2 is the most practically-used structure in which an undercoating layer 4 is added to the basic structure of the laminate photoreceptor. In this case, also the uppermost surface layer is the charge transport layer 3. Therefore, the three-dimensional cross-linked layer formed by the polymerization reaction of the compound (compound B) having three or more [tetrahydro-2H-pyran-2-yl)oxy]methyl groups linked with aromatic rings and the charge transport compound (compound A) represented by the Chemical Structure 1 is applied to the charge transport layer.

Figure 3:
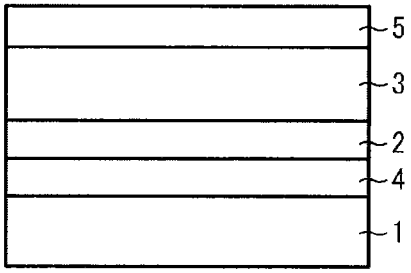
FIG. 3 is a schematic diagram illustrating another example of a layer structure of a photoreceptor of the present disclosure.

FIG. 3 is a diagram illustrating a structure in which a cross-linked charge transport layer 5 as a protective layer is furthermore provided on the uppermost portion. Therefore, the three-dimensional cross-linked layer formed by the polymerization reaction of the compound (compound B) having three or more [tetrahydro-2H-pyran-2-yl)oxy]methyl groups linked with aromatic rings and the charge transport compound (compound A) represented by the Chemical Structure 1 is applied to this cross-linked charge transport layer.

Although the undercoating layer is not indispensable, it has a feature of preventing the leaking of charges so that the undercoating layer is used in most cases.

In this structure of the photoreceptor, the two layers of the charge transport layer 3 and the cross-linked charge transport layer 5 share the feature of moving the charges from the charge generating layer to the surface of the photoreceptor so that the main feature can be separated. For example, it is possible to provide a photoreceptor having both excellent charge transport property and mechanical strength by a combination of the charge transport layer having an excellent charge transport property and the cross linked charge transport layer having an excellent mechanical strength.

The layer that contains the three-dimensional cross-linked material formed by the polymerization reaction of the compound (compound B) having three or more [tetrahydro-2H-pyran-2-yl)oxy]methyl groups linked with the aromatic rings and the charge transport compound (compound A) represented by the Chemical Structure 1 has an excellent charge transport property among the cross-linked layers and the applicability as the charge transport layer 3 is high. However, the charge transport property is inferior in comparison with a typical molecule dispersion type charge transport layer.

Therefore, it is preferable to make the layer relatively thin. A photoreceptor having such a structure demonstrates the most excellent characteristics.

Figure 4:
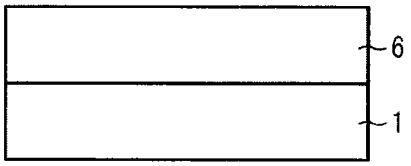
FIG. 4 is a schematic diagram illustrating another example of a layer structure of a photoreceptor of the present disclosure.

In FIG. 4, a (single-layered) photosensitive layer 6 mainly made of a charge generating material and a charge transport material is provided on the electroconductive substrate 1. The layer that contains the three-dimensional cross-linked material formed by the polymerization reaction of the compound (compound B) having three or more [tetrahydro-2H-pyran-2-yl)oxy]methyl groups linked with aromatic rings and the charge transport compound (compound A) represented by the Chemical Structure 1 can be used as the photosensitive layer 6. In this case, it is suitable that the cross-linked layer contains the charge generating material. Therefore, a liquid dispersion in which the charge generating material is mixed and dispersed in the liquid application described above is prepared and applied to the electroconductive substrate followed by heating and drying to form a layer that contains the three dimensional cross-linked material by the condensation reaction.

Figure 5:
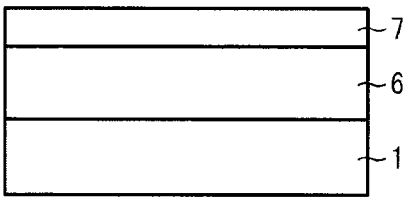
FIG. 5 is a schematic diagram illustrating another example of a layer structure of a photoreceptor of the present disclosure.

FIG. 5 is a structure in which a protective layer 7 is formed on the photosensitive layer 6 and the layer that contains the three-dimensional cross-linked material formed by the polymerization reaction of the compound (compound B) having three or more [tetrahydro-2H-pyran-2-yl)oxy]methyl groups linked with aromatic rings and the charge transport compound (compound A) represented by the Chemical Structure 1 can be used as the protective layer 7.

Known elements can be used as the elements of each layer except for the portions where the layer that contains the three dimensional cross-linked material is applied. The other elements are described in detail below.

Electroconductive Substrate

There is no specific limit to the selection of materials for use in the electroconductive substrate as long as the material has a volume resistance of not greater than $10\times10^{10}$ Ω·cm. For example, there can be used plastic or paper having a film form or cylindrical form covered with a metal such as aluminum, nickel, chrome, nichrome, copper, gold, silver, and platinum, or a metal oxide such as tin oxide and indium oxide by depositing or sputtering.

Also a board formed of aluminum, an aluminum alloy, nickel, and a stainless metal can be used. Further, a tube which is manufactured from the board mentioned above by a crafting technique such as extruding and extracting and surface-treatment such as cutting, super finishing, and grinding is also usable. In addition, an endless nickel belt and an endless stainless belt described in JP-S52-36016-A can be used as the electroconductive substrate.

An electroconductive substrate formed by applying to the substrate mentioned above a liquid application in which electroconductive powder is dispersed in a suitable binder resin is suitable as the electroconductive substrate for use in the present disclosure.

Specific examples of such electroconductive powder include, but are not limited to, carbon black, acetylene black, metal powder, such as powder of aluminum, nickel, iron, nichrome, copper, zinc and silver, and metal oxide powder, such as electroconductive tin oxide powder and ITO powder. Specific examples of the binder resins which are used together with the electroconductive powder include, but are not limited to, thermoplastic resins, thermosetting resins, and optical curing resins, such as a polystyrene resin, a styrene-acrylonitrile copolymer, a styrene-butadiene copolymer, a styrene-anhydride maleic acid copolymer, a polyester resin, a polyvinyl chloride resin, a vinyl chloride-vinyl acetate copolymer, a polyvinyl acetate, a polyvinylidene chloride, a polyarylate (PAR) resin, a phenoxy resin, a polycarbonate resin, a cellulose acetate resin, an ethyl cellulose resin, a polyvinyl butyral resin, a polyvinyl formal resin, a polyvinyl toluene resin, a poly-N-vinyl carbazole, an acrylic resin, a silicone resin, an epoxy resin, a melamine resin, a urethane resin, a phenolic resin, and an alkyd resin.

Such an electroconductive layer can be formed by dispersing the electroconductive powder and the binder resins mentioned above in a suitable solvent, for example, tetrahydrofuran (THF), dichloromethane (MDC), methyl ethyl ketone (MEK), and toluene and applying the resultant to an electroconductive substrate.

In addition, an electroconductive substrate formed by providing a heat contraction tube as an electroconductive layer on a suitable cylindrical substrate can be used as the electroconductive substrate in the present disclosure.

The heat contraction tube is formed of material such as polyvinyl chloride, polypropylene, polyester, polystyrene, polyvinylidene chloride, polyethylene, chloride rubber, and TEFLON®, which includes the electroconductive powder mentioned above.

In the photoreceptor of the present disclosure, it is possible to provide an intermediate layer between the charge transport layer and the cross-linked charge transport layer to reduce mingling of the charge transport layer component to the cross-linked charge transport layer and improve the attachment between both layers.

Therefore, an intermediate layer which is insoluble or slightly soluble in the liquid application of the cross-linked charge transport layer is suitable and mainly formed of a binder resin in general.

Specific examples of the binder resins include, but are not limited to, polyamide, alcohol soluble nylon, water soluble polyvinyl butyral, polyvinyl butyral, and polyvinyl alcohol. The application methods described above are employed to form the intermediate layer.

There is no specific limit to the thickness of the intermediate layer. The layer thickness thereof can arbitrarily be determined and preferably ranges from 0.05 μm to 2 μm.

Undercoating Layer

In the photoreceptor of the present disclosure, an undercoating layer can be provided between the electroconductive substrate and the photosensitive layer. Typically, such an undercoating layer is mainly made of a resin. Considering that the liquid application of a photosensitive layer is applied to such an undercoating layer (i.e., resin), the resin is preferably insoluble or little soluble in a known organic solvent.

Specific examples of such resins include, but are not limited to, water soluble resins, such as polyvinyl alcohol, casein, and sodium polyacrylate, alcohol soluble resins, such as copolymerized nylon and methoxymethylated nylon, and curable resins which form a three dimensional network structure, such as polyurethane, melamine resins, phenolic resins, alkyd-melamine resins, and epoxy resins. In addition, fine powder pigments of a metal oxide such as titanium oxides, silica, alumina, zirconium oxides, tin oxides, and indium oxides can be added to the undercoating layer to prevent moiré and reduce the residual voltage.

Furthermore, the undercoating layer can be formed by anodizing $Al_2O_3$ or a vacuum thin-film forming method using an organic compound such as polyparaxylylene (parylene) or an inorganic compound such as $SiO_2$, $SnO_2$, $TiO_2$, ITO, and $CeO_2$. Any other known methods can be also available.

The undercoating layer described above can be formed by using a suitable solvent and a suitable coating method as described above for the photosensitive layer. Silane coupling agents, titanium coupling agents, and chromium coupling agents can be used in the undercoating layer.

There is no specific limit to the thickness of the undercoating layer. The layer thickness thereof can be arbitrary determined and preferably ranges from 0 μm to 5 μm.

Charge Generating Layer

The charge generating layer contains at least a charge generating material, a binder resin, and other optional materials.

Inorganic material and organic material can be used as the charge generating material.

Specific examples of the inorganic materials include, but are not limited to, crystal selenium, amorphous-selenium, selenium-tellurium-halogen, selenium-arsenic compounds, and amorphous-silicon. With regard to the amorphous-silicon, those in which a dangling-bond is terminated with a hydrogen atom or a halogen atom, and those in which boron atoms or phosphorous atoms are doped are preferably used.

There is no specific limit to the selection of the organic materials and known materials can be used.

Specific examples thereof include, but are not limited to, phthalocyanine pigments, for example, metal phthalocyanine and metal-free phthalocyanine; azulenium salt pigments; squaric acid methine pigments; azo pigments having a carbazole skeleton; azo pigments having a triphenylamine skeleton; azo pigments having a diphenylamine skeleton; azo pigments having a dibenzothiophene skeleton; azo pigments having a fluorenone skeleton; azo pigments having an oxadiazole skeleton; azo pigments having a bis-stilbene skeleton; azo pigments having a distilyloxadiazole skeleton; azo pigments having a distylylcarbazole skeleton; perylene pigments, anthraquinone or polycyclic quinone pigments; quinoneimine pigments; diphenylmethane and triphenylmethane pigments; benzoquinone and naphthoquinone pigments; cyanine and azomethine pigments, indigoid pigments, and bis-benzimidazole pigments. These can be used alone or in combination.

There is no specific limit to the selection of the binder resin. Specific examples of the binder resin include, but are not limited to, polyamide resins, polyurethane resins, epoxy resins, polyketone resins, polycarbonate resins, silicone resins, acrylic resins, polyvinylbutyral resins, polyvinylformal resins, polyvinylketone resins, polystyrene resins, poly-N-vinylcarbazole resins, and polyacrylamide resins. These can be used alone or in combination.

In addition to the binder resins specified above for the charge generating layer, a charge transport polymer having a charge transport feature, for example, (1) polymer materials such as a polycarbonate resin, a polyester resin, a polyurethane resin, a polyether resin, a polysiloxane resin, or an acrylic resin, which has an arylamine skeleton, a benzidine skeleton, a hydrazone skeleton, a carbazole skeleton, a stilbene skeleton, or a pyrazoline skeleton; and (2) a polymer material having a polysilane skeleton, can also be used.

Specific examples of the former charge transport polymers (1) include, but are not limited to, compounds described in JP-H01-001728-A, JP-H01-009964-A, JP-H01-013061-A, JP-H01-019049-A, JP-H01-241559-A, JP-H04-011627-A, JP-H04-175337-A, JP-H04-183719-A, JP-H04-225014-A, JP-H04-230767-A, JP-H04-320420-A, JP-H05-232727-A, JP-H05-310904-A, JP-H06-234836-A, JP-H06-234837-A, JP-H06-234838-A, JP-H06-234839-A, JP-H06-234840-A, JP-H06-234840-A, JP-H06-234841-A, JP-H06-239049-A, JP-H06-236050-A, JP-H06-236051-A, JP-H06-295077-A, JP-H07-056374-A, JP-H08-176293-A, JP-H08-208820-A, JP-H08-211640-A, JP-H08-253568-A, JP-H08-269183-A, JP-H09-062019-A, JP-H09-043883-A, JP-H09-71642-A, JP-H09-87376-A, JP-H09-104746-A, JP-H09-110974-A, JP-H09-110974-A, JP-H09-110976-A, JP-H09-157378-A, JP-H09-221544-A, JP-H09-227669-A, JP-H09-221544-A, JP-H09-227669-A, JP-H09-235367-A, JP-H09-241369-A, JP-H09-268226-A, JP-H09-272735-A, JP-H09-272735-A, JP-H09-302084-A, JP-H09-302085-A, and JP-H09-328539-A.

Specific examples of the latter charge transport polymers (2) include, but are not limited to, polysiylene polymers described in JP-S63-285552-A, JP-H05-19497-A, JP-H05-70595-A, and JP-H10-73944-A.

The charge generating layer optionally contains a charge transport material having a low molecular weight.

The charge transport material having a low molecular weight is classified into a positive hole transport material and an electron transport material.

Specific examples of such electron transport materials include, but are not limited to, chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothhiophene-5,5-dioxide, and diphenoquinone derivatives. These can be used alone or in combination.

Specific examples of such positive hole transport materials include, but are not limited to, oxazole derivatives, oxadiazole derivatives, imidazole derivatives, monoaryl amine derivatives, diaryl amine derivatives, triaryl amine derivatives, stilbene derivatives, α-phenyl stilbene derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bisstilbene derivatives, enamine derivatives, and other known materials. These can be used alone or in combination.

Specific examples of the methods of forming the charge generating layer include, but are not limited to, vacuum thin layer forming methods and casting methods from a solution dispersion system.

Specific examples of the vacuum thin layer forming methods include, but are not limited to, a vacuum deposition method, a glow discharge decomposition method, an ion plating method, a sputtering method, a reactive sputtering method, and a chemical vapor deposition (CVD) method.

In the casting method, the above-mentioned inorganic or organic charge generating material is dispersed with an optional binder resin in a solvent, for example, tetrahydrofuran, dioxane, dioxsolan, toluene, dichloromethane, monochlorobenzene, dichloroethane, cyclohexanone, cyclopentanone, anisole, xylene, methylethylketone, acetone, ethylacetate, butylacetate using, for example, a ball mill, an attritor, a sand mill, or a bead mill. Thereafter, the thus-obtained liquid dispersion is suitably diluted and applied to the surface of the electroconductive substrate to form the charge generating layer. Leveling agents such as dimethyl silicone oil and methylphenyl silicone oil can be optionally added. The liquid application can be applied by using a dip coating method, a spray coating method, a bead coating method, a ring coating method, etc.

There is no specific limit to the thickness of the undercoating layer. The undercoating layer preferably has a thickness of from 0.01 μm to 5 μm and more preferably from 0.05 μm to 2 μm.

Charge Transport Layer

The charge transport layer holds charges and the held charges are combined with held charges moved from the charge generating layer which are generated and separated in the charge generating layer upon irradiation on the charge transport layer.

In addition, to achieve the objective of holding the charges, the electric resistance of the charge transport layer is required to be high. Furthermore, to achieve the objective of obtaining a high surface voltage by the held charges, a small dielectric constant and good charge mobility are required for the charge transport layer.

The charge transport layer contains at least a charge transport material, a binder resin, and other optional materials.

The charge transport materials are classified into positive hole transport materials, electron transport materials, and charge transport polymers.

Specific examples of such electron transport material (electron accepting materials) include, but are not limited to, chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno [1,2-b]thiophene-4-one, and 1,3,7-trinitro dibenzo thiophene-5,5-dioxide. These can be used alone or in combination.

Specific examples of the positive hole carrier transport materials (electron donating materials) include oxazole derivatives, oxadiazole derivatives, imidazole derivatives, triphenyl amine derivatives, 9-(p-diethylaminostyryl anthracene), 1,1-bis-(4-dibenzyl aminophenyl)propane, styrylanthracene, styrylpyrazoline, phenylhydrazones, α-phenylstilbene derivatives, thiazole derivatives, triazole derivatives, phenazine derivatives, acridine derivatives, benzfuran derivatives, benzimidazole derivatives and thiophen derivatives. These can be used alone or in combination.

Specific examples of the charge transport polymers include, but are not limited to, compounds having the following structure.

(a) Specific examples of the polymers having a carbazole skeleton include, but are not limited to, poly-N-vinylcarbazole, and the compounds described in JP-S50-82056-A, JP-S54-9632-A, S54-11737-A, JP-H04-175337-A, JP-H04-183719-A, and H06-234841-A.

(b) Specific examples of the polymers having a hydrozone skeleton include, but are not limited to, the polymers described in JP-S57-78402-A, JP-S61-20953-A, JP-S61-296358-A, JP-H01-134456-A, JP-H01-179164-A, JP-H03-180851-A, JP-H03-180852-A, JP-H03-50555-A, JP-H05-310904-A, and JP-H06-234840-A.

(c) Specific examples of the polysilylenes include, but are not limited to, polymers described in JP-S63-285552-A, JP-H01-88461-A, JP-H04-264130-A, JP-H04-264131-A, JP-H04-264132-A, JP-H04-264133-A, and JP-H04-289867-A.

(d) Specific examples of the polymers having a triaryl amine structure include, but are not limited to, N,N,bis(4-methylphenyl)-4-aminopolystyrene, polymers described in JP-H01-134457-A, JP-H02-282264-A, JP-H02-304456-A, JP-H04-133065-A, JP-H04-133066-A, JP-H05-40350-A, and JP-H05-202135-A.

(e) Specific examples of the other polymers include, but are not limited to, a condensation polymerized formaldehyde compound of nitropropylene, and polymers described in JP-S51-73888, JP-S56-150749-A, JP-H06-234836-A, and JP-H06-234837-A.

In addition, there are other examples of the charge transport polymers, which are, for example, polycarbonate resins having a triaryl amine structure, polyurethane resins having a triaryl amine structure, polyester resins having a triaryl amine structure and polyether resins having a triaryl amine structure. Specific examples thereof include, but are not limited to, polymers described in JP-S64-1728-A, JP-S64-13061-A, JP-S64-19049-A, JP-H04-11627-A, JP-H04-225014-A, JP-H04-230767-A, JP-H04-320420-A, JP-H05-232727-A, JP-H07-56374-A, JP-H09-127713-A, JP-H09-222740-A, JP-H09-265197-A, JP-H09-211877-A, and JP-H09-304956-A.

Other than the polymers specified above, copolymers, block polymers, graft polymers, and star polymers with a known monomer, and cross-linked polymers having the electron donating groups described in JP-H03-109406-A can be used as the polymers having an electron donating group.

Specific examples of the binder resins for use in the charge transport layer include, but are not limited to, polycarbonate resins, polyester resins, methacryl resins, acrylic resins, polyethylene resins, polyvinyl chloride resins, polyvinyl acetate resins, polystyrene resins, phenol resins, epoxy resins, polyurethane resins, polyvinylidene chloride resins, alkyd resins, silicone resins, polyvinyl carbazole resins, polyvinyl butyral resins, polyvinyl formal resins, polyacrylate resins, polyacryl amide resins, and phenoxy resins. These can be used alone or in combination.

The charge transport layer can also contain a copolymer of a cross-linkable binder resin and a cross-linkable charge transport material.

The charge transport layer can be formed by dissolving or dispersing these charge transport materials and the binder resins in a suitable solvent followed by coating and drying. In addition to the charge transport material and the cinder resin, the charge transport layer can optionally contain additives such as a plasticizing agent, an anti-oxidizing agent, and a leveling agent in a suitable amount if desired.

The same solvent as specified for the charge generating layer can be used as the solvent for use in application of the charge transport layer. Solvents that dissolve the charge transport material and the binder resin well are suitable. These solvents can be used alone or in combination. In addition, the same method as in the case of the charge generating layer can be used to form the charge transport layer.

In addition, a plasticizing agent and/or a leveling agent can be added, if desired.

Known plasticizers, for example, dibutyl phthalate and dioctyl phthalate, can be used as the plasticizers. Its content is suitably from 0 parts by weight to about 30 parts by weight based on 100 parts by weight of the binder resin.

Silicone oil such as dimethyl silicone oil and methyl phenyl silicone oil and a polymer or an oligomer having a perfluoroalkyl group in its side chain can be used as the leveling agent. The content thereof is suitably from 0 parts by weight to about 1 part by weight based on 100 parts by weight of the binder resins.

There is no specific limit to the thickness of the charge transport layer. The thickness thereof can be suitably determined and preferably ranges from 5 μm to 40 μm and more preferably from 10 μm to 30 μm.

In the photoreceptor of the present disclosure, it is possible to provide an intermediate layer between the charge transport layer and the cross-linked charge transport layer to reduce mingling of the charge transport layer component to the cross-linked charge transport layer and improve the attachment between both layers.

Therefore, an intermediate layer which is insoluble or slightly soluble in the liquid application of the cross-linked charge transport layer is suitable and mainly formed of a binder resin in general. Specific examples of the binder resins include, but are not limited to, polyamide, alcohol soluble nylon, water soluble polyvinylbutyral, polyvinyl butyral, and polyvinyl alcohol.

The application methods described above are employed to form the intermediate layer. There is no specific limit to the thickness of the intermediate layer. The layer thickness thereof can be arbitrarily determined and preferably ranges from 0.05 μm to 2 μm.

Addition of Anti-Oxidizing Agent to Each Layer

Furthermore, in the present disclosure, an anti-oxidizing agent can be added to each layer, i.e., the cross linked charge transport layer, the charge transport layer, the charge generating layer, the undercoating layer, the intermediate layer, etc. to improve the environmental resistance, in particular, to prevent the degradation of the sensitivity and the rise in the residual potential.

Specific examples of the anti-oxidizing agents include, but are not limited to, phenolic compounds, paraphenylene diamines, hydroquinones, organic sulfur compounds, and organic phosphorus compounds. These can be used alone or in combination.

Specific examples of the phenolic compounds include, but are not limited to, 2,6-di-t-butyl-p-cresol, butylated hydroxyanisol, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl) propionate]methane, bis[3,3'-bis(4'-hydroxy-3'-t-butylphenyl)butyric acid]glycol ester, and tocopherols.

Specific examples of paraphenylene diamines include, but are not limited to, N-phenyl-N'-isopropyl-p-phenylene diamine, N,N□'-di-sec-butyl-p-phenylene diamine, N-phenyl-N-sec-butyl-p-phenylene diamine, N,N'-di-isopropyl-p-phenylene diamine, and N,N'-dimethyl-N,N'-di-t-butyl-p-phenylene diamine.

Specific examples of hydroquinones include, but are not limited to, 2,5-di-t-octyl hydroquinone, 2,6-didodecyl hydroquinone, 2-dodecyl hydroquinone, 2-dodecyl-5-chloro hydroquinone, 2-t-octyl-5-methyl hydroquinone, and 2-(2-octadecenyl)-5-methyl hydroquinone.

Specific examples of the organic sulfur compounds include, but are not limited to, dilauryl-3,3'-thiodipropionate, distearyl-3,3'-thiodipropionate, and ditetradecyl-3,3'-thiodipropionate.

Specific examples of the organic phosphorous compounds include, but are not limited to, triphenyl phosphine, tri(nonylphenyl)phosphine, tri(dinonylphenyl)phosphine, tricresyl phosphine, and tri(2,4-dibutylphenoxy) phosphine.

These compounds are known as anti-oxidizing agents for rubber, plastic, and oils and marketed products thereof can easily be obtained.

There is no specific limit to the content of the anti-oxidizing agent. Therefore, the content can be suitably determined and preferably ranges from 0.01% by weight to 10% by weight.

Image Forming Apparatus

The electrophotography and the image forming apparatus of the present disclosure are described next with reference to accompanying drawings.

Figure 6:
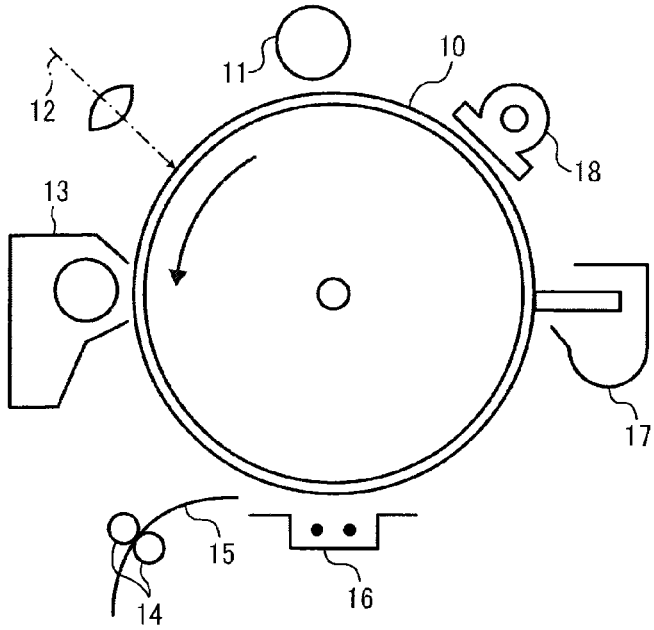
FIG. 6 is a schematic diagram illustrating an example of an image forming apparatus and electrophotographic processes of the present disclosure.

FIG. 6 is a schematic diagram illustrating the elecrophotographic process and the image forming apparatus and the following examples are within the scope of the present disclosure.

A photoreceptor 10 rotates in the direction indicated by an arrow in FIG. 6. Around the photoreceptor 10, there are provided a charger 11, an image irradiator 12, a development device 13, a transfer member 16, a cleaner 17, and a discharger 18. The cleaner 17 and the discharger 18 are optional.

The image forming apparatus basically operates as follows: The charger 11 charges the surface of the photoreceptor (image bearing member) 10. The image irradiator 12 irradiates the charged surface of the photoreceptor 10 with light according to input signals to form a latent electrostatic image thereon. Next, the development member 13 develops the latent electrostatic image to form a toner image on the surface of the photoreceptor 10. The transfer device 16 transfers the formed toner image to a transfer sheet (recording medium) 15 which has been transferred to the transfer position by a transfer roller 14. The toner image is fixed on the transfer sheet by a fixing device. Some of the toner has not been transferred to the transfer sheet 15 and is removed by the cleaner 17. The discharger 18 discharges the charges remaining on the photoreceptor 10 so that the system is ready for the next image forming cycle.

Although the photoreceptor 10 may have a drum form as illustrated in FIG. 6, it may also employ a sheet or endless belt form. As the charger 11 and the transfer device 16, known devices can be used which has a roller form charging member or a brush form charging member other than a corotron, a scorotron, and a solid state charger.

Typical illumination devices, for example, a fluorescent lamp, a tungsten lamp, a halogen lamp, a mercury lamp, a sodium lamp, a light emitting diode (LED), a semiconductor laser (LD), and electroluminescence (EL) can be used as the light source of the irradiator 12 and the discharger 18.

Among these, light emitting diodes (LED) and semiconductor lasers (LD) are commonly used.

Various kinds of optical filters, for example, a sharp cut filter, a band-pass filter, a near infrared filter, a dichroic filter, a coherent filter and a color conversion filter, can be used to irradiate a photoreceptor with light having entirely a particular wavelength.

The light source, etc. irradiates the photoreceptor 10 by providing processes such as the transfer process, the discharging process, the cleaning process, or a pre-irradiation process in combination with irradiation of light.

However, irradiation of the photoreceptor 10 in the discharging process significantly fatigues the photoreceptor 10, which easily leads to reduction of charging and an increase in the residual voltage.

Therefore, it is suitable in some cases to discharge the photoreceptor 10 by another method such as applying a reversed bias in the charging process or the cleaning process instead of discharging by irradiation in terms of improving the durability of the photoreceptor.

When the photoreceptor 10 is positively (or negatively) charged and irradiated according to image data, a positive (or negative) latent electrostatic image is formed on the photoreceptor 10. When the latent electrostatic image is developed with a negatively (or positively) charged toner (volt-detecting fine particles), a positive image is formed. When the latent electrostatic image is developed using a positively (or negatively) charged toner, a negative image is formed. Any known method can be applied to such a development device and also a discharging device.

Among the contamination materials attached to the surface of the photoreceptor 10, discharging product produced by charging and external additives contained in the toner are easily affected by humidity condition, which causes production of defective images.

In addition, paper dust tends to degrade the durability of the photoreceptor 10 and cause non-uniform abrasion in addition to such production of defective images. Therefore, a structure in which the photoreceptor 10 does not directly contact with paper is preferable in terms of improvement of the quality of image.

Toner that is used to develop the latent image on the photoreceptor 10 by the development unit 13 is transferred to the transfer sheet 15.

However, not all of the toner is transferred but some of it remains on the photoreceptor 10. Such residual toner is removed from the photoreceptor 10 by the cleaner 17.

This cleaner 17 is a known cleaner such as a cleaning blade or a cleaning brush. Both can be used in combination.

The photoreceptor of the present disclosure is applicable to a photoreceptor having a small diameter because the photoreceptor has an excellent photosensitivity and an excellent stability.

Therefore, an image forming apparatus or a system in which the photoreceptor described above is preferably used has multiple photoreceptors corresponding to development units arranged for multiple color toners to conduct processing in parallel, which is an image forming apparatus employing so-called "a tandem system.

The image forming apparatus employing the tandem system includes at least four color toners of yellow (Y), magenta (M), cyan (C), and black (K) required for full color printing, development units that accommodate the toners, and at least respective four photoreceptors.

Therefore, this image forming apparatus enables full color printing at an extremely high speed in comparison with a typical image forming apparatus for full color printing.

Figure 7:
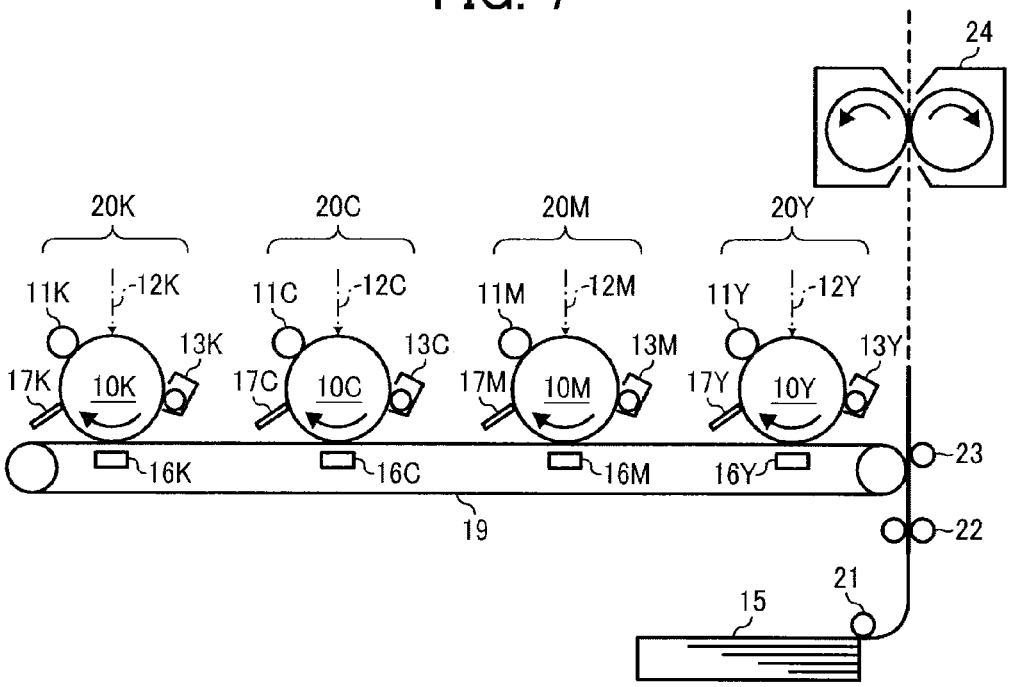
FIG. 7 is a schematic diagram illustrating an example of a tandem type full color image forming apparatus of the present disclosure.
Figure 8:
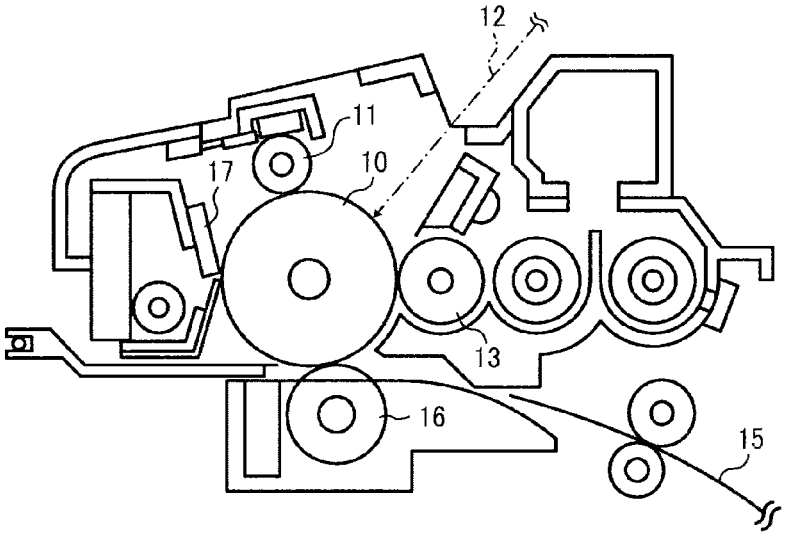
FIG. 8 is a schematic diagram illustrating an example of a process cartridge of the present disclosure.

FIG. 7 is a schematic diagram illustrating an example of the full color image forming apparatus employing the tandem system and the following variations are within the scope of the present disclosure.

In FIG. 7, the photoreceptors 10C, 10M, 10Y, and 10K are the photoreceptors having a drum form and rotate in the direction indicated by arrows. There are arranged at least chargers 11C, 11M, 11Y, and 11K, development devices 13C, 13M, 13Y, and 13K, and cleaners 17C, 17M, 17Y, and 17K in that order around the photoreceptors 10C, 10M, 10Y, and 10K relative to the rotation direction of the photoreceptors.

An irradiator emits laser beams 12C, 12M, 12Y, and 12K to irradiate the photoreceptors 10C, 10M, 10Y, and 10K from outside of the gap provided between the charger 11C, 11M, 11Y, and 11K and the development devices 13C, 13M, 13Y, and 13K to form latent electrostatic images on the photoreceptors 10C, 10M, 10Y, and 10K.

Four image formation units 20C, 20M, 20Y, and 20K including the photoreceptors 10C, 10M, 10Y, and 10K are arranged along a transfer belt 19 serving as a transfer medium conveyor device.

The transfer belt 19 is in contact with the photoreceptors 10C, 10M, 10Y, and 10K between the development devices 13C, 13M, 13Y, and 13K and the corresponding cleaners 17C, 17M, 17Y, and 17K of each image formation unit 20C, 20M, 20Y, and 20K.

Transfer brushes 16C, 16M, 16Y, and 16K that apply transfer biases are provided on the side of the transfer belt 19 which is reverse to the side on which the photoreceptors 10C, 10M, 10Y, and 10K are in contact. Each image formation unit 20C, 20M, 20Y, and 20K is of the same structure except that toners contained in the development devices 13C, 13M, 13Y, and 13K have different colors from each other.

The color image forming apparatus having the structure illustrated as in FIG. 7 produces images as follows. In the image formation units 20C, 20M, 20Y, and 20K, the photoreceptors 10C, 10M, 10Y, and 10K are charged by the chargers 11C, 11M, 11Y, and 11K that are driven to rotate in the direction indicated by arrows (the same direction as the rotation direction of the photoreceptors 10C, 10M, 10Y, and 10K) and irradiated with the laser beams 12C, 12M, 12Y, and 12K emitted from the irradiator situated outside the photoreceptors 10C, 10M, 10Y, and 10K to produce latent electrostatic images corresponding to an image of each color.

Then, the latent electrostatic images are developed by the development devices 13C, 13M, 13Y, and 13K to form toner images. The development devices 13C, 13M, 13Y, and 13K develop the latent electrostatic images with toner of C (cyan), M (magenta), Y (yellow), and K (black), respectively. Respective toner images formed on the four photoreceptors 10C, 10M, 10Y, and 10K are superimposed on the transfer belt 19.

The transfer sheet 15 is sent out from a tray by a feeding roller 21, temporarily held at a pair of registration rollers 22, and thereafter fed to a transfer member 23 in synchronization with image formation on the photoreceptors 10C, 10M, 10Y, and 10K.

The toner images on the photoreceptors 10C, 10M, 10Y, and 10K are transferred to the transfer medium 15 by an electric field formed by a potential difference between the transfer bias applied to the transfer member 23 and the voltage at the transfer belt 19.

The toner image transferred onto the transfer sheet 15 is conveyed to a fixing member 24 to fix the toner image on the transfer sheet 15 and discharged to a discharging portion. In addition, toner which has not been transferred to the photoreceptors 10C, 10M, 10Y, and 10K and remains thereon are collected by the cleaners 17C, 17M, 17Y, and 17K.

In addition, the intermediate transfer system as illustrated in FIG. 7 is particularly suitable for an image forming apparatus that can produce full color images. That is, in such a system, multiple toner images are temporarily transferred to and superimposed on the intermediate transfer body, which is advantageous in terms of controlling prevention of color misalignment and improvement of the quality of image.

The intermediate transfer body is made of various kinds of materials and can have various kinds of forms such as a drum and a belt. Any known intermediate transfer body can be applied in the present disclosure, which is also preferable in terms of improvement of the durability of the image bearing member and the quality of image.

In FIG. 7, the image formation elements are arranged in the sequence of Y (yellow), M (magenta), C (cyan), and K (black) from the upstream to the downstream relative to the transfer direction of the transfer sheet, but the sequence is not limited thereto. The sequence of the color is arbitrarily determined. In addition, when a document of only black color is output, providing a mechanism that suspends the image formation units 20C, 20M, and 20Y) other than the black color is particularly suitable for the present disclosure.

Although the image formation device as described above can be assembled into a photocopier, a facsimile machine, or a printer in a fixed manner, each image formation element may form a process cartridge, which is mounted onto such an apparatus.

The process cartridge is a part that includes the photoreceptor 10 and other members such as the image irradiator 12, the development device 13, the transfer device 16, the cleaner 17, and the discharger 18.

Since the image forming apparatus employing a tandem system is able to transfer multiple toner images once, a high speed full color printing is possible.

However, such a system requires at least four photoreceptors. Therefore, the size of the apparatus inevitably increases.

In addition, depending on the amount of toner, abrasion among the photoreceptors is non-uniform, thereby causing problems such as degrading the reproducibility of color or producing defective images.

On the other hand, the photoreceptor of the present disclosure can be applied to the one having a small particle diameter because it has an excellent photosensitivity and stability.

In addition, a rise in the residual voltage is reduced and impact caused by deterioration of the photosensitivity is limited with regard to the image bearing member of the present disclosure.

Therefore, the difference among the photoreceptors with regard to the residual voltage and the photosensitivity over repetitive use is so small that full color images can be produced with excellent color reproducibility for an extended period of time.

Having generally described (preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, the present disclosure is described in detail with reference to Examples and Comparative Examples but not limited thereto.

Example 1

A liquid application of cross-linked charge transport layer having the following composition is dip-coated on quartz glass (10 mm×40 mm×1 mm) followed by drying at 135° C. for 30 minutes to form a cross-linked charge transport layer having a thickness of about 0.5 μm.

The thus-obtained sample is subjected to transmission and absorption spectra measuring by using a visible-ultraviolet spectrophotometer (manufactured by Shimadzu Corporation). Thereafter, the sample is dipped in tetrahydrofuran for liquid chromatography for about two days. The sample is pulled out followed by removing residual tetrahydrofuran by vacuum drying at 30° C. and is subjected to the transmission and absorption spectra measuring again.

Figure 22:
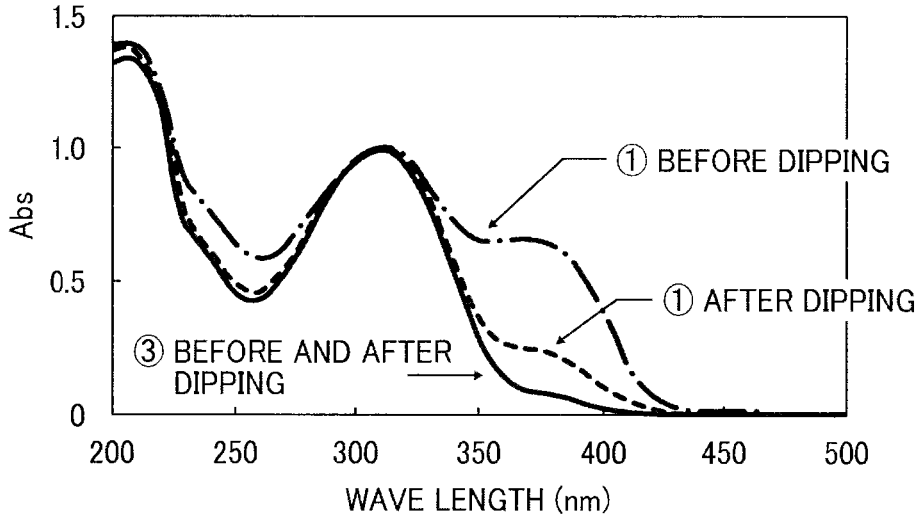
FIG. 22 is a chart illustrating a visible light and ultraviolet spectral transmission absorption spectrum of the cross-linked charge transport layer of Example 1 and Comparative Example 2 described later.

FIG. 22 is a graph illustrating the obtained absorption spectra.

| Composition of Liquid Application of Cross-Linked Charge Transport Layer | |
|---|---|
| Compound B (having four oxymethyl groups): specific example (Compound No. B26)) | 7 parts |
| Compound A represented by the following Chemical Structure 17: specific example (Compound No. A15) | 3 parts |

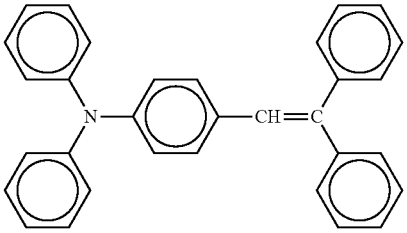

Chemical Structure 17

| | |
|---|---|
| Acid catalyst: paratoluene sulphonic acid monohydrate (manufactured by Tokyo Chemical Industry Co., Ltd.) | 0.02 parts |
| Solvent: Tetrahydrofuran | 40 parts |

Comparative Example 1

Figure 23:
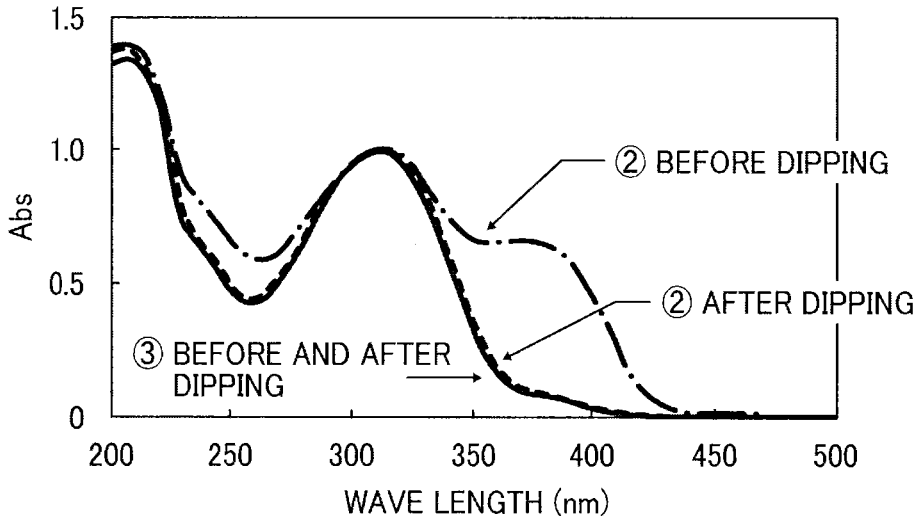
FIG. 23 is a chart illustrating a visible light and ultraviolet spectral transmission absorption spectrum of the cross-linked charge transport layer of Comparative Example 1 and Comparative Example 2 described later.

The cross-linked charge transport layer of Comparative Example 1 is manufactured in the same manner as in Example 1 except that the composition of the liquid application of cross-linked charge transport layer is changed to the following:

FIG. 23 is a graph illustrating the obtained absorption spectra.

| Composition of Liquid Application of Cross-Linked Charge Transport Layer | |
|---|---|
| Charge transport compound (Compound B): specific example (Compound No. B26) | 7 parts |
| Charge transport material having a low molecular weight represented by the following Chemical Structure 18: specific example (Compound No. A'1) | 3 parts |

-continued

| Composition of Liquid Application of Cross-Linked Charge Transport Layer | |
|---|---|
| 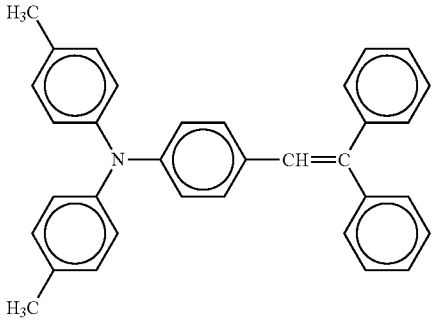 | |
| Chemical Structure 18 | |
| Acid catalyst: paratoluene sulphonic acid monohydrate (manufactured by Tokyo Chemical Industry Co., Ltd.) | 0.02 parts |
| Solvent: Tetrahydrofuran | 40 parts |

Comparative Example 2

The cross-linked charge transport layer of Comparative Example 2 is manufactured in the same manner as in Example 1 except that the composition of the liquid application of cross-linked charge transport layer is changed to the following: FIGS. 22 and 23 are graphs illustrating the obtained absorption spectra.

In these graphs, the graphs of 1 show the results of Example 1, the graphs of 2 show the results of Comparative Example, and the graphs of 3 show the results of Comparative Example 2.

| Composition of Liquid Application of Cross-Linked Charge Transport Layer | |
|---|---|
| Charge transport compound (Compound B): specific example (Compound No. B 26) | 10 parts |
| Acid catalyst: paratoluene sulphonic acid monohydrate (manufactured by Tokyo Chemical Industry Co., Ltd.) | 0.02 parts |
| Solvent: Tetrahydrofuran | 40 parts |

As seen in FIG. 22, it is found that the specific example of No. A15 of the charge transport compound A represented by the Chemical Structure 1 is polymerized with the specific example compound No. B26 of the compound B having aromatic rings having four [tetrahydro-2H-pyran-2-yl)oxy]methyl groups and the specific example compound No. A15 is fixed in the layer by comparison with the polymerized layer of the single specific example compound No. B26.

As seen in FIG. 23, it is found that the specific example of No. A'1 is not polymerized with the specific example compound No. B26 of the compound B having aromatic rings having four [tetrahydro-2H-pyran-2-yl)oxy]methyl groups and the spectra thereof is the same as that of the polymerized layer of single specific example compound No. B26.

When the absorption spectra of the charge transport compound (compound A) represented by the Chemical Structure 1 and that of the compound B having three or more [tetrahydro-2H-pyran-2-yl)oxy]methyl groups linked with aromatic rings are not overlapped, as seen in the results, it is observed that the charge transport compound A represented by the Chemical Structure 1 is fixed in the three-dimensional cross-linked layer.

In addition, by comparing a liquid in which a non-heated or dried sample is dissolved with a liquid in which a heated and dried sample is dissolved, the same polymerization property can be seen.

Furthermore, it is possible to calculate an elaborate polymerization reaction ratio by high performance liquid chromatography (HPLC). That is, by comparing the peak area deriving from the charge transport compound A represented by the Chemical Structure detected in the non-heated or dried sample with the peak area deriving from the charge transport compound A represented by the Chemical Structure 1 extracted by the tetrahydrofuran solvent in the heated or dried sample, the amount of the charge transport compound (compound A) represented by the Chemical Structure 1 which is fixed in the three-dimensional cross-linked layer can be analyzed.

For example, suppose the peak area deriving from the charge transport compound A represented by the Chemical Structure in the non-heated or dried sample is 100, if the peak area deriving from the charge transport compound A represented by the Chemical Structure 1 in the heated or dried sample is 100, it is found that the charge transport compound (Compound A) is not polymerized. The polymerization reaction ratio is set to be 0% in this case.

On the other hand, when the peak area extracted from the heated and dried sample is 10, most of the charge transport compound (Compound A) is found to be polymerized and fixed in the three-dimensional cross-linked layer. The polymerization reaction ratio is set to be 90% in this case.

The compound B (the charge transport compound having three or more [tetrahydro-2H-pyran-2-yl)oxy]methyl groups linked with the aromatic ring) is not detected at all in the liquid extraction after heating and drying.

Example 2

A PET film having a thickness of 100 μm is wound round an aluminum cylinder having a diameter of 30 mm. A liquid application of the cross-linked charge transport layer having the following recipe is spray-coated thereon followed by drying at 150° C. for 30 minutes to form a cross-linked charge transport layer having a thickness of 5.0 μm.

The PET film obtained by cutting out to have a circle having a diameter of 20 mm and 2 ml of tetrahydrofuran for liquid chromatography are placed in 10 ml bin and dipped for about two days.

Thereafter, the filtrate obtained by filtering the liquid in the bin is subjected to peak separation by using an HPLC device (HPLC 2010 AHT, Shimadzu Corporation) under the following conditions. Similarly, a liquid solution of the non-heated or dried sample is prepared and the peak area thereof is compared with that of the heated and dried sample obtained from the liquid extraction. The polymerization reaction ratio is shown in Table 1.

| Composition of Liquid Application of Cross-Linked Charge Transport Layer | |
|---|---|
| Charge transport compound (Compound B): specific example (Compound No. B20) | 5 parts |
| Charge transport compound (compound A): specific example (Compound No. A 1) | 5 parts |

-continued

| Composition of Liquid Application of Cross-Linked Charge Transport Layer | |
|---|---|
| Acid catalyst: paratoluene sulphonic acid monohydrate (manufactured by Tokyo Chemical Industry Co., Ltd.) | 0.02 parts |
| Solvent: Tetrahydrofuran | 90 parts |

HPLC Analysis Condition
Column: Intertsil ODS-3
Moving phase: Tetrahydrofuran/water = 7/3
Flow rate: 1.0 ml/minute Example 3

The cross-linked charge transport layer of Example 3 is manufactured in the same manner as in Example 1 except that the composition of the liquid application of cross-linked charge transport layer is changed as shown in Table 1 and evaluated:

Example 4

The cross-linked charge transport layer of Example 4 is manufactured in the same manner as in Example 1 except that the composition of the liquid application of cross-linked charge transport layer is changed as shown in Table 1 and evaluated:

Example 5

The cross-linked charge transport layer of Example 5 is manufactured in the same manner as in Example 1 except that the composition of the liquid application of cross-linked charge transport layer is changed as shown in Table 1 and evaluated:

Example 6

The cross-linked charge transport layer of Example 6 is manufactured in the same manner as in Example 1 except that the composition of the liquid application of cross-linked charge transport layer is changed as shown in Table 1 and evaluated:

Example 7

The cross-linked charge transport layer of Example 7 is manufactured in the same manner as in Example 1 except that the composition of the liquid application of cross-linked charge transport layer is changed as shown in Table 1 and evaluated:

Example 8

The cross-linked charge transport layer of Example 8 is manufactured in the same manner as in Example 1 except that the composition of the liquid application of cross-linked charge transport layer is changed as shown in Table 1 and evaluated:

Example 9

The cross-linked charge transport layer of Example 9 is manufactured in the same manner as in Example 1 except that the composition of the liquid application of cross-linked charge transport layer is changed as shown in Table 1 and evaluated:

Example 10

The cross-linked charge transport layer of Example 10 is manufactured in the same manner as in Example 1 except that the composition of the liquid application of cross-linked charge transport layer is changed as shown in Table 1 and evaluated:

Example 11

The cross-linked charge transport layer of Example 11 is manufactured in the same manner as in Example 1 except that the composition of the liquid application of cross-linked charge transport layer is changed as shown in Table 1 and evaluated:

Example 12

The cross-linked charge transport layer of Example 12 is manufactured in the same manner as in Example 1 except that the composition of the liquid application of cross-linked charge transport layer is changed as shown in Table 1 and evaluated:

Example 13

The cross-linked charge transport layer of Example 13 is manufactured in the same manner as in Example 1 except that the composition of the liquid application of cross-linked charge transport layer is changed as shown in Table 1 and evaluated:

Example 14

The cross-linked charge transport layer of Example 14 is manufactured in the same manner as in Example 1 except that the composition of the liquid application of cross-linked charge transport layer is changed as shown in Table 1 and evaluated:

Example 15

The cross-linked charge transport layer of Example 15 is manufactured in the same manner as in Example 1 except that the composition of the liquid application of cross-linked charge transport layer is changed as shown in Table 1 and evaluated:

Example 16

The cross-linked charge transport layer of Example 16 is manufactured in the same manner as in Example 1 except that the composition of the liquid application of cross-linked charge transport layer is changed as shown in Table 1 and evaluated:

Example 17

The cross-linked charge transport layer of Example 17 is manufactured in the same manner as in Example 1 except that the composition of the liquid application of cross-linked charge transport layer is changed as shown in Table 1 and evaluated:

Example 18

The cross-linked charge transport layer of Example 18 is manufactured in the same manner as in Example 1 except that the composition of the liquid application of cross-linked charge transport layer is changed as shown in Table 1 and evaluated:

TABLE 1

| | Compound (compound B) having three or more [tetrahydro-2H-pyran-2-yl)oxy] methyl groups Specific example compound No. | Compound (compound A) represented by Chemical Structure 1 | |
|---|---|---|---|
| | | Specific example compound No. | Polymerization reaction ratio (%) |
| Example 2 | B20 | A1 | 91 |
| Example 3 | B26 | A1 | 98 |
| Example 4 | B26 | A2 | 89 |
| Example 5 | B26 | A5 | 87 |
| Example 6 | B26 | A9 | 59 |
| Example 7 | B26 | A11 | 57 |
| Example 8 | B26 | A13 | 52 |
| Example 9 | B26 | A14 | 58 |
| Example 10 | B26 | A15 | 48 |
| Example 11 | B26 | A16 | 50 |
| Example 12 | B41 | A1 | 93 |
| Example 13 | B44 | A2 | 87 |
| Example 14 | B51 | A1 | 91 |
| Example 15 | B58 | A5 | 85 |
| Example 16 | B61 | A1 | 90 |
| Example 17 | B63 | A2 | 87 |
| Example 18 | B65 | A1 | 95 |

Regardless of the Chemical Structure of the compound (compound B) having three or more [tetrahydro-2H-pyran-2-yl)oxy]methyl groups linked with the aromatic rings, the polymerization reaction ratio significantly changes depending on the chemical structure of the charge transport compound (compound A) represented by the Chemical Structure 1. Specific examples No. A1, A2, and A5 having triphenyl amine structures show high polymerization reaction ratio.

The polymerization reaction ratio tends to decrease as the molecular weight of the triaryl amine structure increases.

That is, it is inferred that, as the molecular sizes increase, the steric barrier with the compound (compound B) having three or more [tetrahydro-2H-pyran-2-yl)oxy]methyl groups linked with the aromatic rings increases so that the polymerization reaction ratio decreases.

The compound B (the charge transport compound having three or more [tetrahydro-2H-pyran-2-yl)oxy]methyl groups linked with the aromatic ring) is not detected at all in the liquid extraction obtained after heating and drying.

As described above, the polymerization reaction property of the polymerized three-dimensional cross-linked layer formed by the reaction between the charge transport compound (compound B) having three or more [tetrahydro-2H-pyran-2-yl)oxy]methyl groups linked with the aromatic rings and the compound (compound A) represented by the Chemical Structure 1 in which part of [tetrahydro-2H-pyran-2-yl)oxy]methyl groups is detached is verified.

Example 19

The liquid application of an undercoating layer, the liquid application of a charge generating layer, and the liquid application of a charge transport layer having the following recipes are applied to an aluminum cylinder having a diameter of 30 mm in this order followed by drying to form an undercoating layer having a thickness of 3.5 μm, a charge generating layer having a thickness of 0.2 μm, and a charge transport layer having a thickness of 25 μm.

The liquid application of the cross-linked charge transport layer having the following recipe is spray-coated on the prepared charge transport layer followed by drying at 135° C. for 30 minutes to form a cross-linked charge transport layer having a thickness of 5.0 μm. The photoreceptor of Example 21 is thus manufactured.

| Composition of Liquid Application of Undercoating Layer | |
|---|---|
| Alkyd resin (Beckozole 1307-60-EL, manufactured by Dainippon Ink and Chemicals, Inc.) | 6 parts |
| Melamine resin (SuperBeckamine G-821-60, manufactured by Dainippon Ink and Chemicals, Inc.) | 4 parts |
| Titanium oxide (CR-EL, manufactured by ISHIHARA SANGYO KAISHA, LTD): | 40 parts |
| Methylethylketone: Component of Liquid Application of Charge Generating Layer | 50 parts |
| Polyvinyl butyral {XYHL, manufactured by Union Carbide Corporation (UCC)} | 0.5 parts |
| Cyclohexanone | 200 parts |
| Methylethylketone: | 80 parts |
| Bisazo pigment represented by the following Chemical Structure 19 | 2.4 parts |

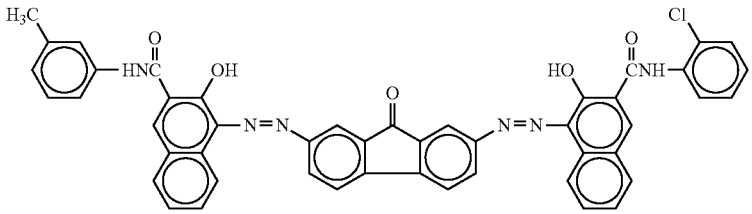

Chemical Structure 19

| Composition of Liquid Application of Charge Transport Layer | |
|---|---|
| Bisphenol Z polycarbonate (PanLite TS-2050, manufactured by Teijin Chemicals Ltd.) | 10 parts |
| Tetrahydrofuran: | 100 parts |
| Tetrahydrofuran solution of 1% by weight silicon oil (KF50-100CS, manufactured by Shin-Etsu Chemical Co., Ltd.): | 0.2 |
| Charge transport material (Compound No. A'1) having a low molecular weight represented by the following Chemical Structure 18 | 5 parts |

-continued

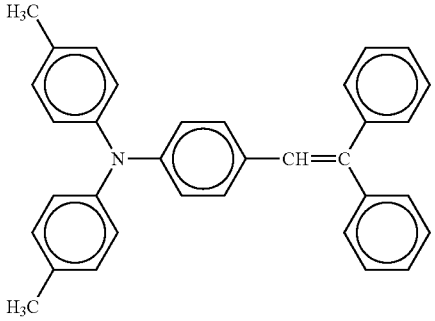

Chemical Structure 18

Composition of Liquid Application of Cross-Linked Charge Transport Layer

| | |
|---|---|
| Compound B (having four oxymethyl groups): specific example (compound No. B20)) | 6.5 parts |
| Charge transport compound (compound A): specific example (Compound No. A1) | 3.5 parts |
| Acid catalyst: paratoluene sulphonic acid monohydrate (manufactured by Tokyo Chemical Industry Co., Ltd.) | 0.02 parts |
| Solvent: Tetrahydrofuran | 90 parts |

Example 20

The photoreceptor of Example 20 is manufactured in the same manner as in Example 1 except that the composition of the liquid application of cross-linked charge transport layer is changed as shown in Table 2 and evaluated:

Example 21

The photoreceptor of Example 21 is manufactured in the same manner as in Example 1 except that the composition of the liquid application of cross-linked charge transport layer is changed as shown in Table 2 and evaluated:

Example 22

The photoreceptor of Example 22 is manufactured in the same manner as in Example 1 except that the composition of the liquid application of cross-linked charge transport layer is changed as shown in Table 2 and evaluated:

Example 23

The photoreceptor of Example 23 is manufactured in the same manner as in Example 1 except that the composition of the liquid application of cross-linked charge transport layer is changed as shown in Table 2 and evaluated:

Example 24

The photoreceptor of Example 24 is manufactured in the same manner as in Example 1 except that the composition of the liquid application of cross-linked charge transport layer is changed as shown in Table 2 and evaluated:

Example 25

The photoreceptor of Example 25 is manufactured in the same manner as in Example 1 except that the composition of the liquid application of cross-linked charge transport layer is changed as shown in Table 2 and evaluated:

Example 26

The photoreceptor of Example 26 is manufactured in the same manner as in Example 1 except that the composition of the liquid application of cross-linked charge transport layer is changed as shown in Table 2 and evaluated:

Example 27

The photoreceptor of Example 27 is manufactured in the same manner as in Example 1 except that the composition of the liquid application of cross-linked charge transport layer is changed as shown in Table 2 and evaluated:

Example 28

The photoreceptor of Example 28 is manufactured in the same manner as in Example 1 except that the composition of the liquid application of cross-linked charge transport layer is changed as shown in Table 2 and evaluated:

Example 29

The photoreceptor of Example 29 is manufactured in the same manner as in Example 1 except that the composition of the liquid application of cross-linked charge transport layer is changed as shown in Table 2 and evaluated:

Example 30

The photoreceptor of Example 30 is manufactured in the same manner as in Example 1 except that the composition of the liquid application of cross-linked charge transport layer is changed as shown in Table 2 and evaluated:

Example 31

The photoreceptor of Example 31 is manufactured in the same manner as in Example 1 except that the composition of the liquid application of cross-linked charge transport layer is changed as shown in Table 2 and evaluated:

Example 32

The photoreceptor of Example 32 is manufactured in the same manner as in Example 1 except that the composition of the liquid application of cross-linked charge transport layer is changed as shown in Table 2 and evaluated:

Example 33

The photoreceptor of Example 33 is manufactured in the same manner as in Example 1 except that the composition of the liquid application of cross-linked charge transport layer is changed as shown in Table 2 and evaluated:

Example 34

The photoreceptor of Example 34 is manufactured in the same manner as in Example 1 except that the composition of the liquid application of cross-linked charge transport layer is changed as shown in Table 2 and evaluated:

Example 35

The photoreceptor of Example 35 is manufactured in the same manner as in Example 1 except that the composition of the liquid application of cross-linked charge transport layer is changed as shown in Table 2 and evaluated:

Example 36

The photoreceptor of Example 36 is manufactured in the same manner as in Example 1 except that the composition of the liquid application of cross-linked charge transport layer is changed as shown in Table 2 and evaluated:

Example 37

The photoreceptor of Example 37 is manufactured in the same manner as in Example 1 except that the composition of the liquid application of cross-linked charge transport layer is changed as shown in Table 2 and evaluated:

Example 38

The photoreceptor of Example 38 is manufactured in the same manner as in Example 1 except that the composition of the liquid application of cross-linked charge transport layer is changed as shown in Table 2 and evaluated:

Example 39

The photoreceptor of Example 39 is manufactured in the same manner as in Example 1 except that the composition of the liquid application of cross-linked charge transport layer is changed as shown in Table 2 and evaluated:

Example 40

The photoreceptor of Example 40 is manufactured in the same manner as in Example 1 except that the composition of the liquid application of cross-linked charge transport layer is changed as shown in Table 2 and evaluated:

Example 41

The photoreceptor of Example 41 is manufactured in the same manner as in Example 1 except that the composition of the liquid application of cross-linked charge transport layer is changed to the following:

| Composition of Liquid Application of Cross-Linked Charge Transport Layer | |
|---|---|
| Charge transport compound (compound B): specific example (compound No. B 26) | 6.5 parts |
| Charge transport compound (compound A): specific example (compound No. A 1) | 3.5 parts |
| Acid catalyst: paratoluene sulphonic acid monohydrate (manufactured by Tokyo Chemical Industry Co., Ltd.) | 0.04 parts |
| Solvent: Tetrahydrofuran | 90 parts |

Example 42

The photoreceptor of Example 42 is manufactured in the same manner as in Example 1 except that the composition of the liquid application of cross-linked charge transport layer is changed to the following:

| Composition of Liquid Application of Cross-Linked Charge Transport Layer | |
|---|---|
| Charge transport compound (compound B): specific example (compound No. B 26) | 6.5 parts |
| Charge transport compound (compound A): specific example (Compound No. A 1) | 3.5 parts |
| Acid catalyst: Nacure 2500 (manufactured by Kusumoto Chemicals, Ltd.) | 0.1 parts |
| Solvent: Tetrahydrofuran | 90 parts |

TABLE 2

| | Compound (compound B) having three or more [tetrahydro-2H-pyran-2-yl)oxy] methyl groups | | Compound (compound A) represented by Chemical Structure 1 | |
|---|---|---|---|---|
| | Specific example compound No. | Content (% by weight) | Specific example compound No. | Content (% by weight) |
| Example 19 | B20 | 65 | A1 | 35 |
| Example 20 | B26 | 65 | A1 | 35 |
| Example 21 | B33 | 65 | A1 | 35 |
| Example 22 | B37 | 65 | A1 | 35 |
| Example 23 | B41 | 65 | A1 | 35 |
| Example 24 | B44 | 65 | A1 | 35 |
| Example 25 | B51 | 65 | A1 | 35 |
| Example 26 | B58 | 65 | A1 | 35 |
| Example 27 | B61 | 65 | A1 | 35 |
| Example 28 | B64 | 65 | A1 | 35 |
| Example 29 | B65 | 65 | A1 | 35 |
| Example 30 | B26 | 65 | A2 | 35 |
| Example 31 | B26 | 65 | A5 | 35 |
| Example 32 | B26 | 65 | A9 | 35 |
| Example 33 | B26 | 65 | A11 | 35 |
| Example 34 | B26 | 65 | A13 | 35 |
| Example 35 | B26 | 65 | A15 | 35 |
| Example 36 | B26 | 65 | A16 | 35 |
| Example 37 | B26 | 35 | A15 | 65 |

TABLE 2-continued

| | Compound (compound B) having three or more [tetrahydro-2H-pyran-2-yl)oxy] methyl groups | | Compound (compound A) represented by Chemical Structure 1 | |
|---|---|---|---|---|
| | Specific example compound No. | Content (% by weight) | Specific example compound No. | Content (% by weight) |
| Example 38 | B26 | 50 | A15 | 50 |
| Example 39 | B26 | 80 | A15 | 20 |
| Example 40 | B26 | 90 | A15 | 10 |
| Example 41 | B26 | 65 | A1 | 35 |
| Example 42 | B26 | 65 | A1 | 35 |

Comparative Example 3

The photoreceptor of Comparative Example 3 is manufactured in the same manner as in Example 1 except that the composition of the liquid application of cross-linked charge transport layer is changed to the following:

| Composition of Liquid Application of Cross-Linked Charge Transport Layer | |
|---|---|
| Charge transport compound (compound B): specific example (compound No. B 26) | 10 parts |
| Acid catalyst: paratoluene sulphonic acid monohydrate (manufactured by Tokyo Chemical Industry Co., Ltd.) | 0.02 parts |
| Solvent: Tetrahydrofuran | 90 parts |

Comparative Example 4

The photoreceptor of Comparative Example 4 is manufactured in the same manner as in Example 1 except that the composition of the liquid application of cross-linked charge transport layer is changed to the following:

| Composition of Liquid Application of Cross-Linked Charge Transport Layer | |
|---|---|
| Charge transport compound (compound B): specific example (compound No. B26) | 6.5 parts |
| Charge transport material (compound No. A'1) having a low molecular weight represented by the following Chemical Structure 18 | 3.5 parts |

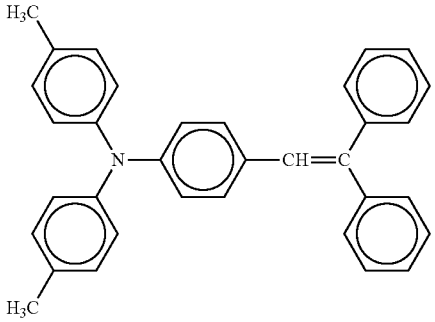

Chemical Structure 18

-continued

| Composition of Liquid Application of Cross-Linked Charge Transport Layer | |
|---|---|
| Acid catalyst: paratoluene sulphonic acid monohydrate (manufactured by Tokyo Chemical Industry Co., Ltd.) | 0.02 parts |
| Solvent: Tetrahydrofuran | 90 parts |

Comparative Example 5

The photoreceptor of Comparative Example 5 is manufactured in the same manner as in Example 1 except that the composition of the liquid application of cross-linked charge transport layer is changed to the following:

| Composition of Liquid Application of Cross-Linked Charge Transport Layer | |
|---|---|
| Methylol compound prepared in Synthesis Example 2: | 6.5 parts |
| Charge transport material (Compound No. A'1) having a low molecular weight represented by the following Chemical Structure 18 | 3.5 parts |

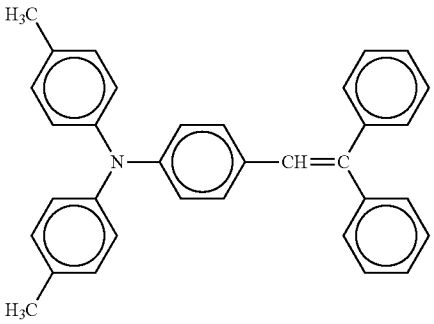

Chemical Structure 18

| | |
|---|---|
| Acid catalyst: paratoluene sulphonic acid monohydrate (manufactured by Tokyo Chemical Industry Co., Ltd.) | 0.02 parts |
| Solvent: Tetrahydrofuran | 90 parts |

Comparative Example 6

The photoreceptor of Comparative Example 6 is manufactured in the same manner as in Example 1 except that the composition of the liquid application of cross-linked charge transport layer is changed to the following:

| Composition of Liquid Application of Cross-Linked Charge Transport Layer | |
|---|---|
| Charge transport compound (compound B): specific example (compound No. B26) | 6.5 parts |
| Charge transport material (compound No. A'2) having a low molecular weight represented by the following Chemical Structure 20 | 3.5 parts |

-continued

| Composition of Liquid Application of Cross-Linked Charge Transport Layer | |
|---|---|
| 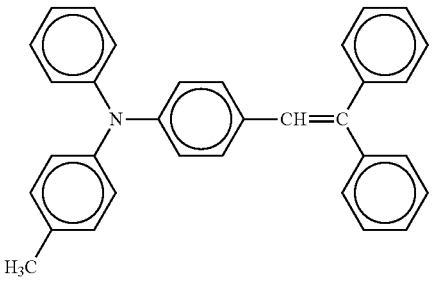 Chemical Structure 20 | |
| Acid catalyst: paratoluene sulphonic acid monohydrate (manufactured by Tokyo Chemical Industry Co., Ltd.) | 0.02 parts |
| Solvent: Tetrahydrofuran | 90 parts |

Comparative Example 7

The photoreceptor of Comparative Example 7 is manufactured in the same manner as in Example 1 except that no cross-linked charge transport layer is provided.

Comparative Example 8

The photoreceptor of Comparative Example 8 is manufactured n the same manner as in Example 1 except that the charge transport compound B'1 represented by the Chemical Structure 21 instead of the specific example (compound No. B 26) of the compound B.

However, the surface of the thus-obtained photoreceptor is liquid and the specific example compound No. A 1 is crystallized so that the photoreceptor is not evaluated.

Cheimcal structure21

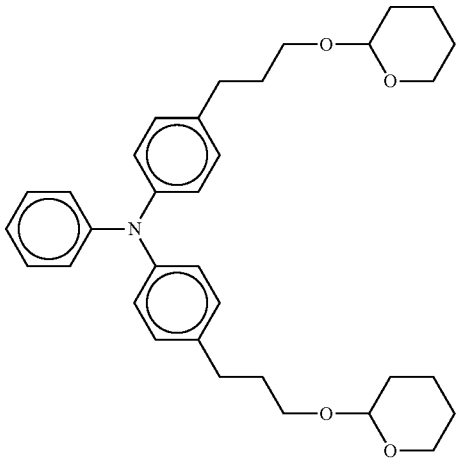

Comparative Example 9

The photoreceptor of Comparative Example 9 is manufactured in the same manner as in Example 1 except that the composition of the liquid application of cross-linked charge transport layer is changed to the following:

| Composition of Liquid Application of Cross-Linked Charge Transport Layer | |
|---|---|
| Charge transport Compound B'2 represented by the following Chemical Structure 22 instead of the specific example compound No. B26 of the compound B: | 3.0 parts |
| 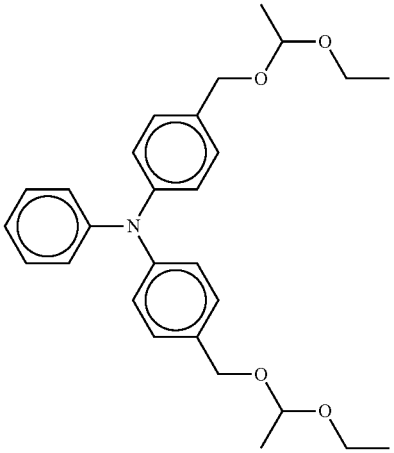 Chemical Structure 22 | |
| Resole type phenolic resin: PL-2211 (manufactured by GUNEI CHEMICAL INDUSTRY CO., LTD.): | 3.5 parts |
| Compound represented by the Chemical Structure 1: specific example compound No. A1 | 3.5 parts |
| Acid catalyst: Nacure 2500 (manufactured by Kusumoto Chemicals, Ltd.) | 0.2 parts |
| Solvent 1: Isopropanol | 15 parts |
| Solvent 2: Methylethylketone | 5 parts |

However, the surface of the thus-obtained photoreceptor is liquid and the specific example compound No. A1 is crystallized so that the photoreceptor is not evaluated.

Solubility Test & Surface Smoothness Evaluation of Cross-Linked Charge Transport Layer The cross-linking property of the cross-linked charge transport layer is examined by the solubility test. In the solubility test, each of the liquid applications of the cross-linked charge transport layers of Examples 19 to 42 and Comparative Examples 3 to 5 is directly applied to the aluminum substrate followed by heating and drying to form a film (layer). A cotton stick is dipped in tetrahydrofuran. The surface of the cured film is abraded with the cotton stick and observed.

In addition, with regard to the surface smoothness of the cross-linked charge transport layer, the values of ten point height of irregularities (Rz) according to JIS-1982 is obtained by a form measuring device (Surfcom 1400D, manufactured by TOKYO SEIMITSU CO., LTD.). Values of 1 μm or less is determined as "good" and, the values greater than 1 μm, "bad".

Results of Solubility Test

In Examples 19 and 42 and Comparative Examples 3 and 5, the cross-linked charge transport layers are insoluble. In Comparative Example 6, the cross-linked charge transport is dissolved.

Results of Surface Smoothness Test

The evaluations of Examples 19 and 42 and Comparative Examples 3 and 6 about the surface smoothness test are good.

Evaluation on Photoreceptor

Each of the photoreceptors manufactured in Examples 19 to 42 and Comparative Examples 3 to 7 are mounted onto the process cartridge for a digital full color multi-functional machine (imagioNeo 455, manufactured by Ricoh Co., Ltd.). With a voltage at dark portion of 750 (−V), a test pattern of each of intermediate color band patterns of yellow, magenta, cyan, and black is continuously printed on 500 sheets of A4 (My Recycle Paper GP, manufactured by Ricoh Co., Ltd.) with a resolution of 600 dpi×600 dpi repeatedly until the total number of printouts reaches 100,000 sheets The mechanical strength, the electrical characteristics, and the image characteristics 1 are evaluated.

Furthermore, after each of the photoreceptors specified above is mounted onto the process cartridge, slanted grate inside patterns (1 to 5) are printed on 50,000 sheets by a remodeled image forming apparatus based on an image forming apparatus (imagioNeo 270, manufactured by Ricoh Co., Ltd.) using semiconductor laser beams of 655 nm as the light source of the image forming apparatus while the initial voltage at the dark portion is set to be −700 V. The image characteristics 2 are evaluated at this point in time.

Mechanical Strength

The abrasion amount of the photoreceptors is obtained by measuring the difference between the layer thicknesses between the initial printing and after printing 100,000 sheets. The results are shown in Table 3.

Electrical Characteristics

The voltages at the irradiated portions are measured when the amount of light of the light source for image forming at the initial printing and after 100,000 sheet printing is about 0.4 $\mu J/cm^2$.

The absolute value of the difference between the voltages at the irradiated portions is set to be a variation. The variation at the irradiated portions is evaluated according to the following criteria. The results are shown in Table 5. The evaluation criteria are as follows:

E (Excellent): less than 10 V
G (Good): 10 V to less than 15 V
F (Fair): 15 V to less than 20 V
B (Bad): 20 V to less than 30 V
VB (Very Bad): 30 V or more Image Characteristics 1

The manufactured photoreceptors are exposed to nitrogen oxide with a concentration of 40 ppm and nitrogen dioxide with a concentration of 10 ppm at 30° C. and 85 RH % for 48 hours by using an $NO_x$ exposure tester (manufactured by Dylec Inc.) to evaluate the image quality.

An image chart of 600 dpi 2×2 is output and measured by an image densitometer (X-Rite 939, available from SDG K. K.).

The results are shown in Table 5. The evaluation criteria for the image density are as follows:

E (Excellent): 0.35 or greater
G (Good): 0.30 to less than 0.35
F (Fair): 0.25 to less than 0.30
B (Bad): 0.20 to less than 0.25
VB (Very Bad): Less than 0.20

Image Characteristics 2

The image after 50,000 printouts is observed and the number of white spots per unit of area is counted in the solid image portion.

The results are shown in Table 3. The evaluation criteria are as follows:

E (Excellent): 0 to less than 5 spots (/100 $cm^2$)
G (Good): 5 to less than 10 spots (/100 $cm^2$)
F (Fair): 10 to less than 25 spots (/100 $cm^2$)
B (Bad): 25 to less than 50 spots (/100 $cm^2$)
VB (Very Bad): 50 or more spots (/100 $cm^2$)

TABLE 3

| | Mechanical Characteristics Amount of abrasion after 100,000 outputs (mmμ) | Electrical Characteristics Voltage at irradiated (light) portions after 100,000 outputs | Image Characteristics 1 Image density after exposure to $NO_x$ in high humidity environment | Image Characteristics 2 Defective Image after 50,000 outputs |
|---|---|---|---|---|
| Example 19 | 0.2 | E | E | E |
| Example 20 | 0.3 | E | E | E |
| Example 21 | 0.3 | E | E | E |
| Example 22 | 0.3 | E | E | E |
| Example 23 | 0.3 | E | E | E |
| Example 24 | 0.4 | E | E | E |
| Example 25 | 0.3 | G | G | E |
| Example 26 | 0.3 | G | G | E |
| Example 27 | 0.4 | G | G | E |
| Example 28 | 0.2 | G | G | E |
| Example 29 | 0.2 | G | G | E |
| Example 30 | 0.5 | E | E | E |
| Example 31 | 0.5 | E | E | E |
| Example 32 | 0.4 | E | E | E |
| Example 33 | 0.4 | E | E | E |
| Example 34 | 0.4 | E | E | E |
| Example 35 | 0.3 | E | E | E |
| Example 36 | 0.3 | E | E | E |
| Example 37 | 0.6 | E | E | F |
| Example 38 | 0.4 | E | E | G |
| Example 39 | 0.2 | E | G | E |
| Example 40 | 0.2 | G | F | G |
| Example 41 | 0.3 | E | G | E |
| Example 42 | 0.3 | E | G | G |
| Comparative Example 3 | 0.2 | F | B | G |
| Comparative Example 4 | 0.5 | G | F | VB |
| Comparative Example 5 | 0.5 | B | VB | VB |
| Comparative Example 6 | 7.5 | E | E | E |
| Comparative Example 7 | 5.6 | E | E | E |

As described above, it is found that the photoreceptor of Comparative Example 3 in which no charge transport material represented by the Chemical Structure 1 is used has good mechanical strength such as good abrasion resistance and strength enough to prevent occurrence of white spots but is inferior with regard to the potential stability and the image stability.

Although the photoreceptor of Comparative Example 4 in which the charge transport compound (compound No. A'1, represented by the Chemical Structure 18) having no polymerization reaction property is not significantly inferior with regard to the abrasion resistance, a great number of white spots are seen and the image density is found to decrease due to the exposure to $NO_x$.

In the three-dimensional cross-linking in which the charge transport compound is molecule-dispersed greatly, it is inferred that having a good combination of the stability and the strength is difficult.

In the photoreceptor of Comparative Example 5 in which the methylol compound having a structure similar to that of the charge transport compound having four [tetrahydro-2H-pyran-2-yl)oxy]methyl groups to the aromatic rings is used with the charge transport compound represented by the Chemical Structure 1, the compatibility of both compounds is not good so that the abrasion resistance is good but the electrical potential variation and the image density decrease, which leads to production of defective images.

The photoreceptor of Comparative Example 6 using the compound having a structure similar to that of the charge transport compound represented by the Chemical Structure 1 which has one phenyl group having no substitution group linked with the nitrogen atom cannot form a good three-dimensional cross-linked layer.

Although the image density does not decrease due to the exposure to $NO_x$ in a high humidity environment, the abrasion resistance is extremely inferior so that the protective layer disappears while printing the image on 100,000 sheets.

In the photoreceptor of Comparative Example 6 in which a three-dimensional cross-linked layer is not used as the surface layer, the electrical characteristics and the image characteristics are good but the amount of the abrasion is extremely large.

That is, compared with a typical photoreceptor, the photoreceptor of the present disclosure demonstrates excellent durability and has a good combination of the abrasion resistance and the gas resistance stability.

In Comparative Examples 8 or 9, which uses the compound having only two [tetrahydro-2H-pyran-2-yl)oxy]methyl groups to the aromatic rings of the charge transport compound or the compound similar thereto, curing is not sufficient due to poor compatibility so that a desired photoreceptor is not formed.

In addition, it is also found that each of the photoreceptors of Examples 19 to 36, 41, and 42 having a three-dimensional cross-linked charge transport layer which is manufactured by three or more [tetrahydro-2H-pyran-2-yl)oxy]methyl groups linked with aromatic rings in an amount of 65% by weight and the charge transport compound represented by the Chemical Structure 1 in an amount of 35% by weight has stable electrical characteristics and image characteristics without producing defective images while maintaining the excellent abrasion resistance.

It is also found that the photoreceptor of Examples 37 having a three-dimensional cross-linked charge transport layer which is manufactured by three or more [tetrahydro-2H-pyran-2-yl)oxy]methyl groups linked with aromatic rings in an amount of 35% by weight and the charge transport compound represented by the Chemical Structure 1 in an amount of 65% by weight has no practical problem although it is slightly inferior with regard to the abrasion resistance. However, since the number of the cross-linking reaction points decreases, white spots are detected a lot in number.

It is also found that the photoreceptor of Examples 38 having a three-dimensional cross-linked charge transport layer which is manufactured by three or more [tetrahydro-2H-pyran-2-yl)oxy]methyl groups linked with aromatic rings in an amount of 50% by weight and the charge transport compound represented by the Chemical Structure 1 in an amount of 50% by weight has the same properties as those of Examples 1 to 16.

It is also found that the photoreceptor of Examples 39 having a three-dimensional cross-linked charge transport layer which is manufactured by three or more [tetrahydro-2H-pyran-2-yl)oxy]methyl groups linked with aromatic rings in an amount of 80% by weight and the charge transport compound represented by the Chemical Structure 1 in an amount of 20% by weight has excellent abrasion resistance but the image density slightly decreases due to the exposure to $NO_x$ in a high humidity environment.

Since the amount of the charge transport compound represented by the Chemical Structure 1 is small, the stability deteriorates.

It is also found that the photoreceptor of Examples 40 having a three-dimensional cross-linked charge transport layer which is manufactured by three or more [tetrahydro-2H-pyran-2-yl)oxy]methyl groups linked with the aromatic rings in an amount of 90% by weight and the charge transport compound represented by the Chemical Structure 1 in an amount of 10% by weight is inferior with regard to the electrical potential variation and the decrease in the image density due to the exposure to $NO_x$ in a high humidity environment since the amount of the charge transport compound represented by the Chemical Structure 1 is less.

In the combination of the charge transport compounds A and B, the compatibility between both compounds is good so that a good, uniform, and firm three-dimensional cross-linked layer is formed. By using a known particular charge transport compound having an extremely low polarity and an excellent stability as a component for the three-dimensional cross-linked layer, it is possible to obtain a photoreceptor having an excellent stability. In addition, the composition materials of the three-dimensional cross-linked layer are charge transport compounds only, which makes it possible to obtain an excellent charge transport property.

By using the photoreceptor using this three-dimensional cross-linked layer as the surface of the photoreceptor, it is possible to provide an image forming method, an image forming apparatus, and a process cartridge which stably produce quality images with a high image density over an extended period of time even under the exposure to the $NO_x$ in a high humidity and high concentration conditions.

As described above, the present disclosure provides a durable and stable photoreceptor that produces quality images without defects such as white spots over repetitive use while having excellent charge transport properties, reducing the electrical potential variation regardless of the burden on the usage environment, and maintaining the abrasion resistance and an image forming method, an image forming apparatus, and a process cartridge that use the photoreceptor.

What is claimed is:

1. A photoreceptor comprising:

an electroconductive substrate; and a photosensitive layer overlying the electroconductive substrate;

wherein an uppermost surface layer of the photosensitive layer comprises a three-dimensional cross-linked product formed by polymerization reaction of a charge transport compound A represented by the following Chemical Structure 1 and a charge transport compound B having three or more [tetrahydro-2H-pyran-2-yl)oxy]methyl groups linked with aromatic rings in which part of the [tetrahydro-2H-pyran-2-yl)oxy]methyl groups is severed and detached:

Chemical Structure 1

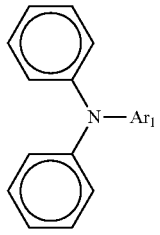

where $Ar_1$ represents an aromatic hydrocarbon group having 6 to 20 carbon atoms that may have an alkyl group having one to four carbon atoms as a substitution group.

2. The photoreceptor according to claim 1, wherein the compound A is one or more compounds selected from the group consisting of the following chemical compounds represented by the following Chemical Structures 2 to 8, Chemical Structure 2

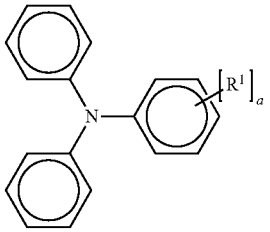

where $R_1$ represents a methyl group and a represents 0 or an integer of from 1 to 5, Chemical Structure 3

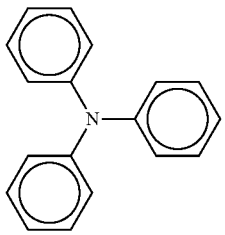

Chemical Structure 4

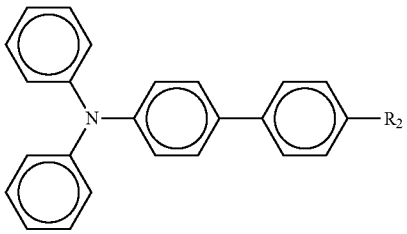

where $R_2$ represents a hydrogen atom, a methyl group, an ethyl group, and a tertial butyl group, Chemical Structure 5

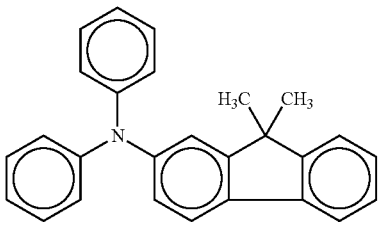

Chemical Structure 6

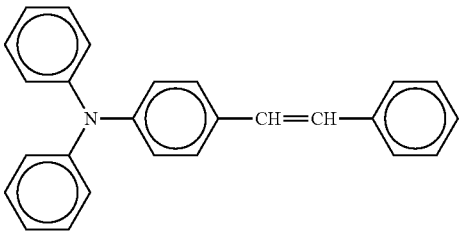

-continued

Chemical Structure 7

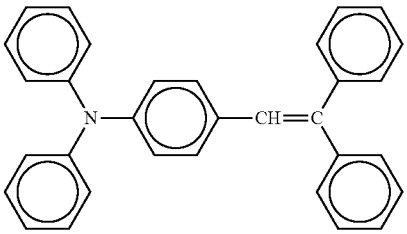

Chemical Structure 8

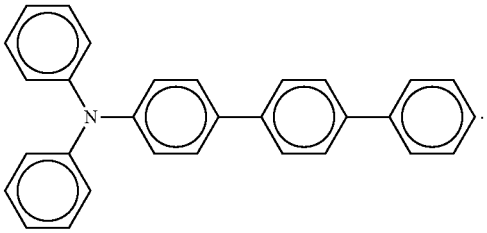

3. The photoreceptor according to claim 2, wherein the compound B is one or more compounds selected from the group consisting of the following chemical compounds represented by the following Chemical Structures 9 to 14, Chemical Structure 9

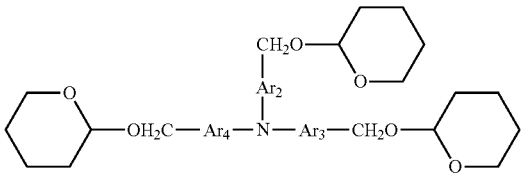

where $Ar_2$, $Ar_3$, and $Ar_4$ independently represent divalent groups of an aromatic hydrocarbon having 6 to 18 carbon atoms that may have an alkyl group as a substitution group, Chemical Structure 10

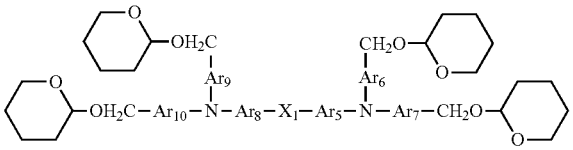

where $X_1$ represents an alkylene group having one to four carbon atoms, an alkylidene group having two to six carbon atoms, a divalent group in which two alkylidene groups having two to six carbon atoms are bonded via a phenylnene group, and an oxygen atom and $Ar_5$, $Ar_6$, $Ar_7$, $Ar_8$, $Ar_9$, and $Ar_{10}$ independently represent divalent groups of an aromatic hydrocarbon having 6 to 18 carbon atoms that may have an alkyl group as a substitution group, Chemical Structure 11

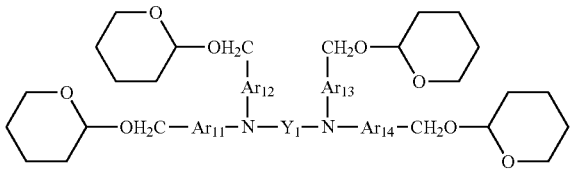

where $Y_1$ represents a divalent group of benzene, biphenyl, terphenyl, stilbene, distilbene, and a condensed polycyclic aromatic hydrocarbon and $Ar_{11}$, $Ar_{12}$, $Ar_{13}$, and $Ar_{14}$ independently represent divalent groups of an aromatic hydrocarbon having 6 to 18 carbon atoms that may have an alkyl group as a substitution group, Chemical Structure 12

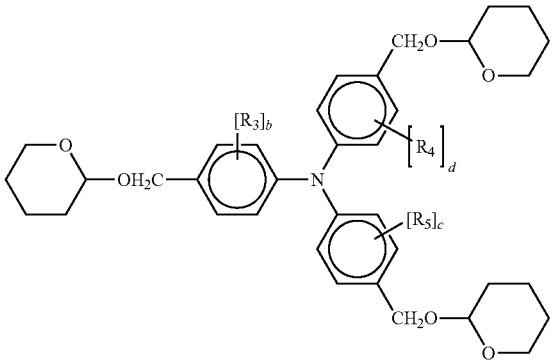

where $R_3$, $R_4$, and $R_5$ independently represent hydrogen atoms, methyl groups, and ethyl groups and b, c, and d independently represent integers of from 1 to 4, Chemical Structure 13

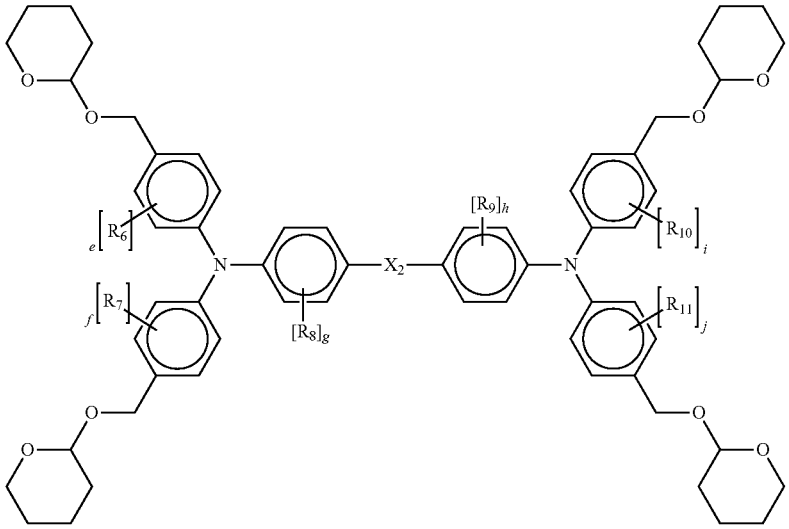

where $X_2$ represents —$CH_2$—, —$CH_2CH_2$—, —$C(CH_3)_2$—Ph—$C(CH_3)_2$—, —$C(CH_2)_5$—, and —O—, $R_6$, $R_7$, $R_8$, $R_9$, $R_{10}$, and $R_{11}$ independently represent hydrogen atoms, methyl groups, and ethyl groups, and e, f, g, h, i, and j independently represent integers of from 1 to 4, Chemical Structure 14

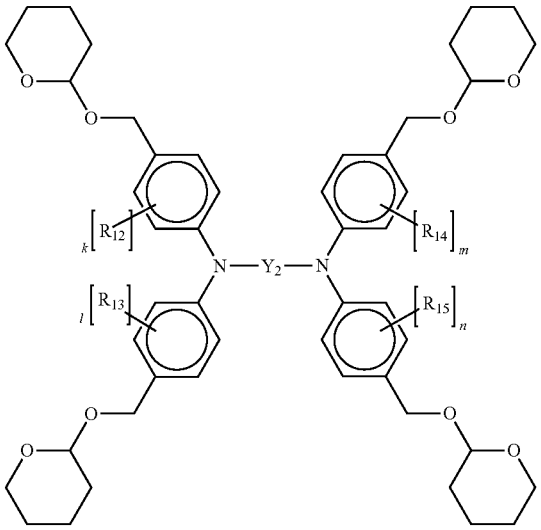

where $Y_2$ represents a divalent group of benzene, biphenyl, terphenyl, stilbene, and naphthalene, $R_{12}$, $R_{13}$, $R_{14}$, and $R_{15}$ independently represent hydrogen atoms, methyl groups, and ethyl groups, and k, l, m, and n independently represent integers of from 1 to 4.

4. The photoreceptor according to claim 3, wherein a mixing ratio of the compound A to the compound A and the compound B is from 20% by weight to 60% by weight.

5. The photoreceptor according to claim 1, wherein the photosensitive layer comprises a charge generating layer, a charge transport layer overlying the charge generating layer, and a cross-linked charge transport layer overlying the charge transport layer, and wherein the cross-linked charge transport layer comprises the three-dimensional cross-linked product.

6. The photoreceptor according to claim 1, wherein the polymerization reaction is conducted by adding an acid catalyst to the charge transport compound A and the charge transport compound B followed by heating to sever and detach the part of the [tetrahydro-2H-pyran-2-yl)oxy]methyl groups to form the three-dimensional cross-linked product.

7. The photoreceptor according to claim 1, wherein a mixing ratio of the compound A to the compound A and the compound B is from 20% by weight to 60% by weight.

8. The photoreceptor according to claim 1, wherein the compound B is one or more compounds selected from the group consisting of the following chemical compounds represented by the following Chemical Structures 9 to 14, Chemical Structure 9

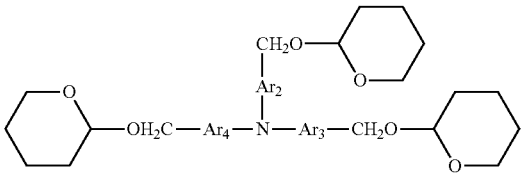

where $Ar_2$, $Ar_3$, and $Ar_4$ independently represent divalent groups of an aromatic hydrocarbon having 6 to 18 carbon atoms that may have an alkyl group as a substitution group, Chemical Structure 10

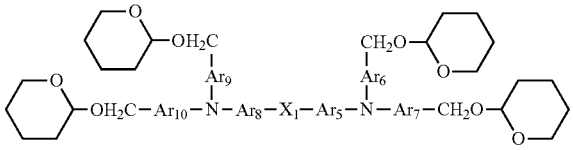

where $X_1$ represents an alkylene group having one to four carbon atoms, an alkylidene group having two to six carbon atoms, a divalent group in which two alkylidene groups having two to six carbon atoms are bonded via a phenylnene group, and an oxygen atom and $Ar_5$, $Ar_6$, $Ar_7$, $Ar_8$, $Ar_9$, and $Ar_{10}$ independently represent divalent groups of an aromatic hydrocarbon having 6 to 18 carbon atoms that may have an alkyl group as a substitution group, Chemical Structure 11

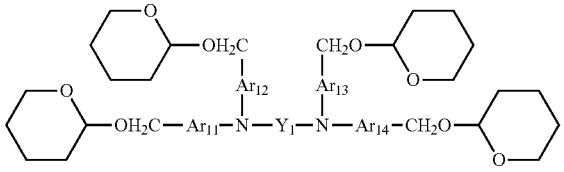

where $Y_1$ represents a divalent group of benzene, biphenyl, terphenyl, stilbene, distilbene, and a condensed polycyclic aromatic hydrocarbon and $Ar_{11}$, $Ar_{12}$, $Ar_{13}$, and $Ar_{14}$ independently represent divalent groups of an aromatic hydrocarbon having 6 to 18 carbon atoms that may have an alkyl group as a substitution group, Chemical Structure 12

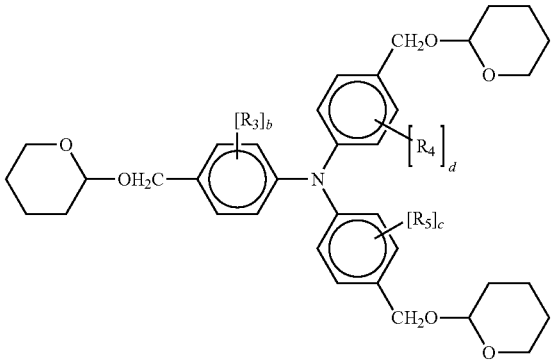

where $R_3$, $R_4$, and $R_5$ independently represent hydrogen atoms, methyl groups, and ethyl groups and b, c, and d independently represent integers of from 1 to 4, Chemical Structure 13

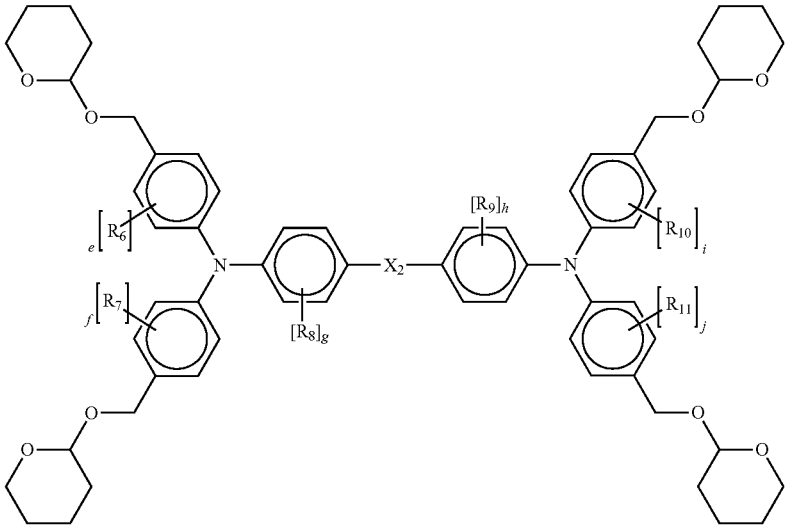

where $X_2$ represents —$CH_2$—, —$CH_2CH_2$—, —$C(CH_3)_2$—Ph—$C(CH_3)_2$—, —$C(CH_2)_5$—, and —O—, $R_6$, $R_7$, $R_8$, $R_9$, $R_{10}$, and $R_{11}$ independently represent hydrogen atoms, methyl groups, and ethyl groups, and e, f, g, h, i, and j independently represent integers of from 1 to 4, Chemical Structure 14

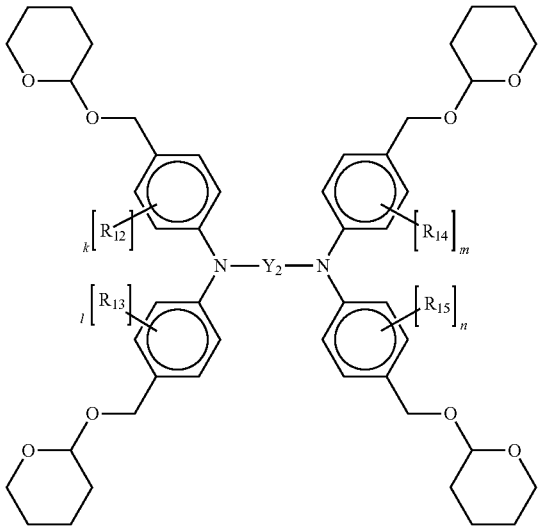

where $Y_2$ represents a divalent group of benzene, biphenyl, terphenyl, stilbene, and naphthalene, $R_{12}$, $R_{13}$, $R_{14}$, and $R_{15}$ independently represent hydrogen atoms, methyl groups, and ethyl groups, and k, l, m, and n independently represent integers of from 1 to 4.

9. An image forming method comprising:

charging a surface of the photoreceptor of claim 1;

irradiating the surface of the photoreceptor with light to form a latent electrostatic image thereon;

developing the latent electrostatic image with toner to obtain a visual image;

transferring the visual image onto a recording medium; and fixing the visual image on the recording medium.

10. An image forming apparatus comprising:

the photoreceptor of claim 1;

a charger to charge a surface of the photoreceptor;

an irradiator to irradiate the surface of the photoreceptor with light to form a latent electrostatic image thereon;

a development device to develop the latent electrostatic image with toner to form a visual image;

a transfer device to transfer the visual image onto a recording medium; and a fixing device to fix the visual image on the recording medium.

11. A process cartridge detachably attachable to an image forming apparatus, comprising:

the photoreceptor of claim 1; and at least one device selected from the group consisting of a charger, an irradiator, a development device, a transfer device, a cleaning device, and a discharger.

* * * * *